US006769754B2

(12) United States Patent
Imanaka et al.

(10) Patent No.: US 6,769,754 B2
(45) Date of Patent: Aug. 3, 2004

(54) INK JET RECORDING APPARATUS UTILIZING SOLID SEMICONDUCTOR ELEMENT

(75) Inventors: Yoshiyuki Imanaka, Kanagawa (JP); Ichiro Saito, Kanagawa (JP); Hiroyuki Ishinaga, Tokyo (JP); Masahiko Kubota, Tokyo (JP); Muga Mochizuki, Kanagawa (JP); Ryoji Inoue, Kanagawa (JP); Takaaki Yamaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/879,110

(22) Filed: Jun. 13, 2001

(65) Prior Publication Data

US 2002/0008722 A1 Jan. 24, 2002

(30) Foreign Application Priority Data

Jun. 16, 2000 (JP) ..... 2000-181638
Jun. 16, 2000 (JP) ..... 2000-181833
Jun. 16, 2000 (JP) ..... 2000-181838

(51) Int. Cl.[7] ..... B41J 2/195
(52) U.S. Cl. ..... 347/7; 347/19
(58) Field of Search ..... 347/5, 7, 40, 43, 347/85, 86, 87, 19

(56) References Cited

U.S. PATENT DOCUMENTS 4,709,246 A 11/1987 Piatt et al. ..... 347/40
4,937,593 A * 6/1990 Prats ..... 346/139 R
5,258,800 A 11/1993 Seki et al. ..... 354/402
6,003,972 A * 12/1999 Narushima ..... 347/43
6,106,101 A * 8/2000 Suzuki ..... 347/40
6,286,927 B1 * 9/2001 Taneya et al. ..... 347/19
6,312,074 B1 * 11/2001 Walker ..... 347/7

FOREIGN PATENT DOCUMENTS

| | | |
|---|---|---|
| EP | 0 878 316 A | 11/1998 |
| EP | 0 925 928 A2 | 6/1999 |
| EP | 1 153 752 A | 11/2001 |
| FR | 2 744 391 | 8/1997 |
| JP | 6-143607 | 5/1994 |
| JP | 2947245 B2 | 7/1999 |
| WO | WO 98/04414 | 2/1998 |

OTHER PUBLICATIONS

Patent Abstracts of Japan, vol. 1996, No. 5, May 31, 1996 & JP 08 02135 A (TEC Corp), Jan. 23, 1996 *abstract*.

(List continued on next page.)

*Primary Examiner*—Anh T. N. Vo
(74) *Attorney, Agent, or Firm*—Fitzpatrick, Cella, Harper & Scinto

(57) ABSTRACT

To supply electromotive force to a solid semiconductor element in an ink tank in a non-contact and stable manner. An electromagnetic apparatus (a standstill electromotive force supply unit) is placed at a home position HP. When a carriage is at a standstill at this home position HP, if the electromagnetic apparatus is AC-driven, magnetic properties of both ends (magnetic poles) continue to change mutually and penetrate a solid semiconductor element in the ink tank on the carriage so that a constantly changing magnetic flux is generated. Electromotive force is generated by electromagnetic induction on a coil of the solid semiconductor element. In addition, if the carriage reciprocates during printing operation, the coil L of the solid semiconductor element crosses inside the magnetic flux due to a plurality of permanent magnets (a movement time electromotive force supply unit) arranged on a carrier path (range of movement), and so the electromotive force is generated on the coil by electromagnetic induction. Such electromotive force is converted into energy for activating and operating the solid semiconductor element.

50 Claims, 35 Drawing Sheets

OTHER PUBLICATIONS

Patent Abstracts of Japan, vol. 14. No. 418 (M–1022), Sep. 10, 1990 & JP 02 162055 A (Fuji Xerox Co Ltd), Jun. 1990 *abstract*.

Patent Abstracts of Japan, vol. 18, No. 452 (M–1661), Aug. 23, 1994 & JP 06 143724 A (Canon Inc) May 24, 1994 *abstract*.

Patent Abstracts of Japan, vol. 5, No. 96, Jun. 23, 1981 & JP 56 039414 A (Ricoh Co. Ltd.), Apr. 15, 1981 *abstract*.

IBM Technical Disclosure Bulletin, NN78122686, vol. 21, No. 7, Dec. 1978, Floating Ink–Density Sensor; N. Kong.

IBM Technical Disclosure Bulletin, NN7707569, vol. 20, No. 2, Jul. 1977, Ink Concentration Monitor; J. W. Haskell.

IBM Technical Disclosure Bulletin, NB80123160, vol. 23, No. 7B, Dec. 1980, Continuous Liquid Level Sensor, W.E. Broom and H. J. Gardner.

* cited by examiner

INK JET RECORDING APPARATUS UTILIZING SOLID SEMICONDUCTOR ELEMENT

BACKGROUND OF THE INVENTION

1. Field of the Invention

The present invention relates to an ink jet recording apparatus utilizing a solid semiconductor element, and an particular, to the ink jet recording apparatus capable of gathering information on a position of recording means and ink inside an ink tank by having the solid semiconductor element built in an ink jet head (recording means) or an ink tank.

2. Related Background Art

Conventionally, in an ink jet recording apparatus wherein images are printed on paper as dot patterns by moving a carriage equipped with an ink jet recording head in a direction of printing while discharging ink from a plurality of discharge nozzles provided on the ink jet recording head (hereafter, also merely referred to as a recording head), an ink tank accommodating ink for recording is provided so as to supply the ink of the ink tank to the recording head via an ink supply route.

As for the ink jet recording apparatus, one of the major factors for producing high-precision and high-quality records is to keep accurate a relative positional relation between a discharge position of the ink and a record medium (recording paper or the like). At its designing, the relative relationship between the carriage and its carrying mechanism and the record medium's supporting and carrying mechanisms is precisely set, and based on that precondition, timing of carriage movement and ink discharge for acquiring a desired record image is determined and the records are produced. There are cases, however, where the discharge position of the ink somewhat goes wrong due to an error in manufacturing or assembly, wear over time, mechanical deterioration and so on. In that case, it becomes difficult to make ink droplets adhere to the record medium at a desired position or a shape and a size of the ink adhering to the record medium change so that quality of the formed images deteriorates.

Therefore, the ink jet recording apparatus for which a mechanism for detecting a position of the carriage equipped with the recording head is provided is used. This detects the position of the carriage by using a linear encoder and so on as appropriate.

In addition, as for the ink jet recording apparatus, another major factor for producing high-precision and high-quality records is that a state such as a type, a residual amount, ingredients or condition of the ink inside the ink tank is grasped at a correct time. For instance, as to the residual amount of the ink inside the ink tank that is one item of the state to be grasped, various ink residual amount detecting apparatuses are proposed.

For instance, according to the Japanese Patent Application Laid-Open No. 6-143607, two (a pair of) electrodes 702 are placed on an inner surface on the bottom side of an ink tank 701 filled with nonconductive ink as shown in FIG. 1, and a floating object 703 on which an electrode 704 is placed in an opposite position to the electrodes 702 is floating in the ink inside the ink tank 701. It is disclosed that the two electrodes 702 are connected to a detecting portion (unillustrated) for detecting a conduction state of both electrodes respectively, and if it detects their conduction state, it issues an ink residual amount error indicating that there is no ink in the ink tank 701 and stops operation of an ink jet recording head 705.

In addition, the Japanese Patent No. 2947245 discloses an ink cartridge 805 for an ink jet printer as shown in FIG. 2, which has a configuration wherein its lower part is formed toward its bottom in a state of a funnel, two electric conductors 801 and 802 are provided on the bottom and a metal ball 804 of smaller specific gravity than ink 803 is placed inside. In such a configuration, a fluid level of the ink 803 lowers as the ink 803 is consumed and reduced. The position of the metal ball 804 floating on the surface of the ink 803 lowers in conjunction with it. If the fluid level of the ink 803 lowers to the position of the bottom of the ink cartridge housing, the metal ball 804 contacts the two electric conductors 801 and 802. And then, the electric conductors 801 and 802 are brought into conduction so that a current passes between them. It is possible to detect an ink end state by detecting that current. If the ink end state is detected, information indicating the ink end state is given to a user.

The above described carriage position detecting mechanism of the conventional ink jet recording apparatus basically performs only one-dimensional position detection in a movement direction of the carriage, and so it is not possible to know space between an ink discharge port and the record medium and so on. In addition, as the linear encoder is expensive, the cost of the ink jet recording apparatus itself increases.

Moreover, it is necessary, in a configuration wherein the ink residual amount inside the ink tank is detected, to place the electrodes for detection inside the ink tank. Furthermore, as the ink residual amount is detected from the conduction state of the electrodes, there are constraints to the ink to be used, such as no use of metal ion as the ink ingredient.

In addition, the above configuration only allows the ink residual amount to be detected, and other in-tank information cannot be known to the outside. For instance, information on pressure in the ink tank, change in physical properties of the ink and so on are important parameters for constantly operating the ink jet head with a stable discharge amount, and thus a tank capable of informing in real time an external ink jet recording apparatus of in-tank pressure incessantly changing in conjunction with in-tank ink consumption and transmitting change in physical properties of the ink to the outside is desired.

Furthermore, an ink tank capable of two-way exchange of information, that is, not only one-sidedly transmitting information detected inside the ink tank to the outside but also responding to inquiries from the outside with internal information is desired.

Here, the inventors focused attention on a ball semiconductor (solid semiconductor element) of BALL Semiconductor, Inc., which is a 1-millimeter silicon ball on which spherical surface a semiconductor integrated circuit is formed. As this solid semiconductor element is spherical, it is expected that, by accommodating it in the recording head or the ink tank mounted on the ink jet recording apparatus, detection of environmental information and two-way exchange of information with the outside can be implemented very efficiently compared with a plane figure.

The present applicant has proposed in the Japanese Patent Application No. 2000-114228 a solid semiconductor element suitable for gathering ink information, and an ink jet recording apparatus equipped with an ink tank having this semiconductor element built-in. The solid semiconductor element has information acquiring means for acquiring environmental information surrounding the element, and discriminating means for reading from information storing means information to refer the acquired information to and comparing the read stored information with the acquired information so as to determine necessity of transmitting the information. And in the case of determining that it is necessary to transmit the information, the discriminating means causes the acquired information to be transmitted to the outside by information communicating means. While this solid semiconductor element has the information acquiring means, the information communicating means and so on, it should be possible to provide it with various other functions, and so it is desired that this solid semiconductor element will be exploited in a wider variety of manners in order to contribute to quality improvement of ink jet recording.

It is possible, by placing at least one piece of such a solid semiconductor element in the recording head or the ink tank, to transmit position information on the recording head, information on the ink accommodated in the ink tank, in-tank pressure and so on to the external apparatus in real time so as to reflect them on ink jet recording operation.

In the case of placing such a solid semiconductor element in the ink tank in order to gather the information in the ink tank, it requires power for driving that solid semiconductor element, where the solid semiconductor element is floating in the ink tank and so energy must be transferred in a non-contact manner. Thus, means for supplying energy to the solid semiconductor element in a non-contact manner is sought.

Furthermore, as there is a possibility that conductive ink may be accommodated in the ink tank, if an attempt to supply energy to the solid semiconductor element in or via the ink by using an electromagnetic wave is made, the semiconductor element may be put in a shielded state due to the conductive ink or the electromagnetic wave may be disrupted by reflection so that desired energy may not be supplied in a stable manner.

Moreover, while the ink tank makes scan movement with the entire carriage during printing operation in the case of a configuration wherein the ink tank is mounted on the carriage together with the recording head, it is desirable to supply energy even during printing in order to maintain stable energy. In particular, it is desirable to have a configuration wherein kinetic energy during printing operation is exploited for driving the solid semiconductor element. On the other hand, in order to transmit the information in the ink tank in a non-contact manner, it is necessary, when a printing apparatus is not in operation, to prevent a malfunction so as not to transmit any information.

SUMMARY OF THE INVENTION

An object of the present invention is to provide an ink jet recording method, an ink jet recording head and an ink jet recording apparatus wherein a solid semiconductor element is utilized for detecting a recording head position to contribute to printing quality improvement by detecting the recording head position as appropriate, and the solid semiconductor element is utilized more effectively to be multifunction without making the configuration too complicated.

Another object of the present invention is to provide an ink jet recording apparatus having a configuration wherein the solid semiconductor element is placed in the ink tank and capable of transferring energy to this semiconductor element in a stable manner without contacting it, and further to provide an ink jet recording apparatus wherein, when the ink tank makes scan movement during printing operation, the kinetic energy is exploited to supply energy to the semiconductor element in a stable manner even during printing operation and besides, a malfunction is prevented when a printing apparatus is not in operation.

A further object of the present invention is to provide an ink information gathering method capable of gathering information on the ink of the ink jet recording apparatus as appropriate.

The present invention is characterized by configuration wherein the solid semiconductor element is placed in a component (the recording head or the ink tank) mounted on the carriage, and also communication means or energy supply means are fixedly placed in a scanning range of the carriage.

In addition, the present invention is characterized by, in the ink jet recording method in which recording is carried out by ejecting ink from recording means in the ink jet recording head while moving the carriage having the ink jet recording head is mounted thereon, transmitting an electric wave from fixed communication means to the solid semiconductor element fixed on the ink jet recording head, the semiconductor element receiving the electric wave and detecting a position of the recording means based thereon and controlling timing of ink discharge according to it.

The present invention allows an ink discharge position in the ink jet recording apparatus to be detected three-dimensionally, which can be used for controlling the ink discharge so as to render the records high-precision and high-quality. In particular, it allows the position to be detected not only one-dimensionally but also three-dimensionally in the carriage movement direction and thus it is highly effective in terms of improvement in printing quality since the space between the record medium and the discharge position can also be known.

Use of the solid semiconductor element makes it no longer necessary to install a linear encoder and so on on the recording apparatus body, and thus increases a degree of freedom of designing the ink jet recording apparatus, such as making carriage speed changeable. In addition, it does not require expensive components such as the linear encoder, and also allows the solid semiconductor element used for another purpose to additionally have a function of detecting a position, so that it can render the product further multifunction and low-cost by sharing components.

To be more specific, the solid semiconductor element can seek the ink discharge position of the recording means and correct timing of the ink discharge in order to set off a deviation of the detected discharge position from the desired discharge position. It is also possible to correct the timing of the ink discharge by having the solid semiconductor element transmit a discharge timing control signal for controlling the ink discharge to the recording means.

While the solid semiconductor element can receive, identify and analyze the electric wave to acquire a communication distance thereof, it is desirable that the semiconductor element should acquire the communication distance based on a deviation of the electric wave phase, acquire the position of the semiconductor element from the communication distance, and detect the discharge position of the recording means based on the position thereof.

As radiation is expanded to be wider than laser and the like by using the electric wave, it is not necessary to transmit it while chasing the moving carriage. In addition, as the solid semiconductor element can render inductance small, it is suitable for communication by the electric wave.

It is desirable that at least three of the above described fixed communication means should transmit the electric wave to the above described solid semiconductor element. In that case, it is desirable that each of the fixed communication means should transmit the electric wave of which frequency, amplitude or signal pattern is different.

By doing so, the position is detected by a trilateration method.

Furthermore, the present invention is that, in the ink jet recording apparatus having the recording head, the ink tank for accommodating the ink to be supplied to the recording head, and the moving carriage on which the recording head and the ink tank are mounted, the solid semiconductor element having an inductor is accommodated in the ink tank, and standstill electromotive force supply means for providing electrical energy to the standstill solid semiconductor element in a non-contact manner is placed at a specific position in the movement range of the carriage.

Thus, it is efficient since the electromotive force can be provided to the solid semiconductor element when the carriage stops, that is, when no printing is performed. In addition, it is not necessary to provide electrical wiring in the ink tank.

It is desirable that the specific position where the standstill electromotive force supply means is provided should be a home position. The home position is a position where the carriage stands by so that there is no damage to the recording head, the ink and so on when the ink jet recording apparatus is energized on and when no printing is performed and where the carriage certainly visits between completion of printing and start of printing of a magnetic field, so that there is little possibility that the electromotive force supply to the solid semiconductor element is delayed.

If the standstill electromotive force supply means includes an electromagnetic apparatus, it is easy to generate a changing magnetic flux around the solid semiconductor element.

In addition, it is also feasible, in the movement range of the carriage, to provide movement time electromotive force supply means for supplying electrical energy to the solid semiconductor element running on a carrier path in a non-contact manner.

According to this, it is possible to supply electromotive force to the solid semiconductor element even during movement of the carriage such as during printing operation, and to prevent shortage of electrical energy for operating the semiconductor element during printing. In addition, kinetic energy of the carriage can be effectively utilized in order to supply the electromotive force.

The movement time electromotive force supply means can include a plurality of electromagnetic apparatuses. Alternatively, the movement time electromotive force supply means can include a plurality of permanent magnets. This is because the movement time electromotive force supply means utilizes the carriage movement and does not need to change the magnetic flux.

It is desirable that the solid semiconductor element should at least partially contact the above described ink accommodated in the above ink tank, and be hollow-structured and floating in the above described ink accommodated in the above ink tank so that the above described inductor constantly faces a fixed direction. By doing so, the electromotive force can be certainly generated by utilizing electromagnetic induction.

It is desirable that electricity accumulating means should be mounted on the solid semiconductor element, since the supplied electromotive force or electric power that is converted from this electromotive force can be accumulated for subsequent operation of the semiconductor element.

It is also possible to have communication means for sending a signal to the solid semiconductor element, and the semiconductor element may have a function of transmitting whether or not there is sufficient electrical energy for driving the semiconductor element in response to a request from the communication means.

In addition, it may have the communication means for sending a signal to the solid semiconductor element, and the semiconductor element may have a function of detecting and transmitting at least one of the amount, type, ingredients and state of the ink in the ink tank in response to a request from the communication means.

Moreover, the "meta center" in this specification indicates a point of intersection of a line of action of weight in a balanced state and a line of action of buoyancy when inclined.

In addition, "solid" of the "solid semiconductor element" herein includes all of various cubic shapes such as a triangle pole, a sphere, a hemisphere, a square pole, an ellipsoid of revolution and a uniaxial spinning body.

Furthermore, the present invention is characterized by having energy converting means for converting energy from the outside into a different type of energy and also having in the ink tank light-emitting means for emitting light with the energy converted by the energy converting means.

As it has the light-emitting means for emitting light with the energy converted by the energy converting means, it can determine the type of the ink by allowing the light emitted from the solid semiconductor element to transmit through the ink and detecting strength in the wavelength of the transmitted light.

DETAILED DESCRIPTION OF THE PREFERRED EMBODIMENTS

Figure 1:
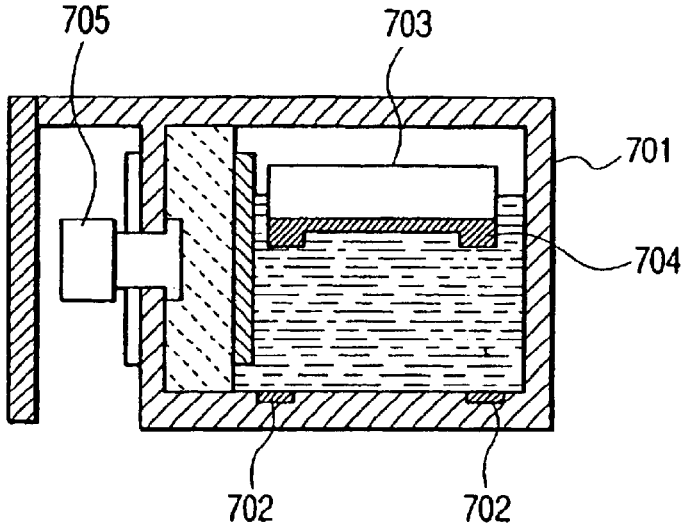
FIG. 1 PRIOR ART
FIG. 1 is a diagram showing an example of a conventional ink residual amount detecting apparatus.
Figure 2:
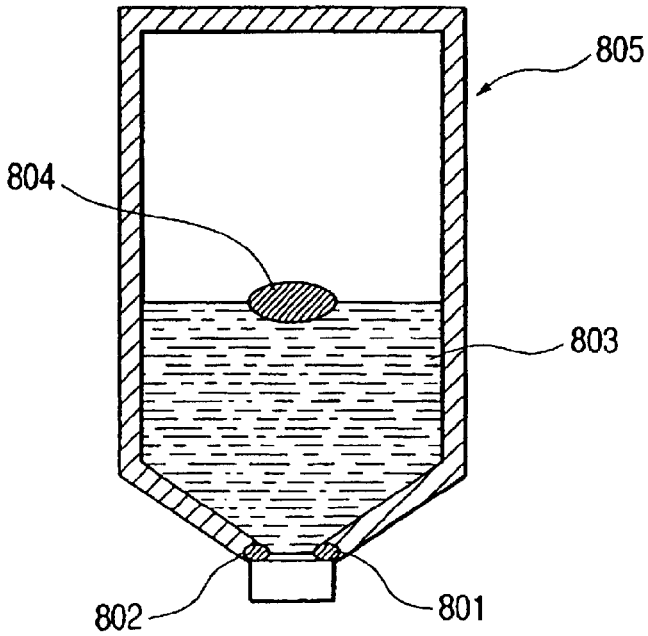
FIG. 2 PRIOR ART
FIG. 2 is a diagram showing another example of the conventional ink residual amount detecting apparatus.

Then embodiments of the present invention will be described hereafter by referring to the drawings.

First Embodiment

Figure 3:
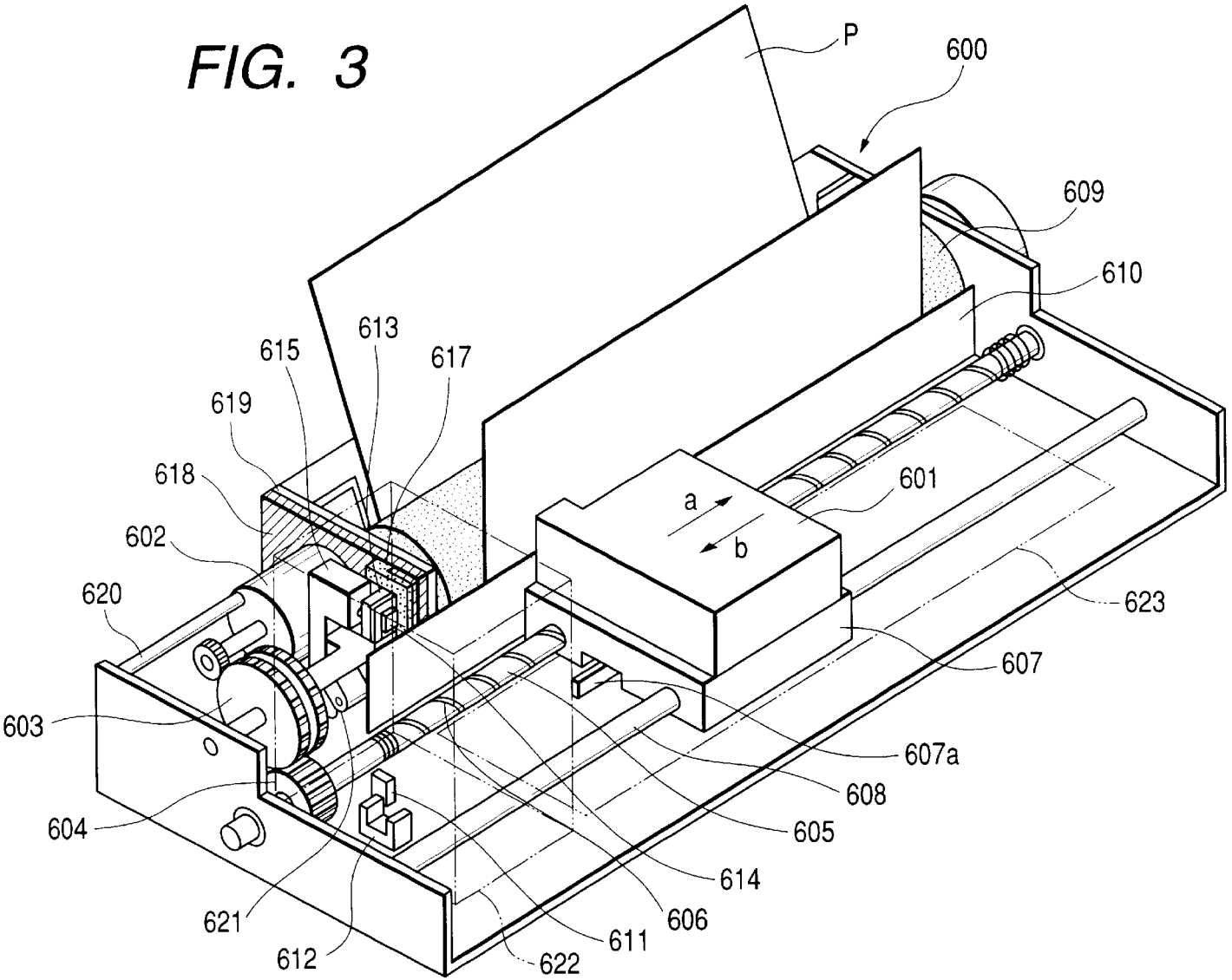
FIG. 3 is a slanting view showing an ink jet recording apparatus of a first embodiment of the present invention.

FIG. 3 shows a sketch of an ink jet recording apparatus of a first embodiment of the present invention. First, an overall configuration of this ink jet recording apparatus 600 will be briefly described.

Figure 4:
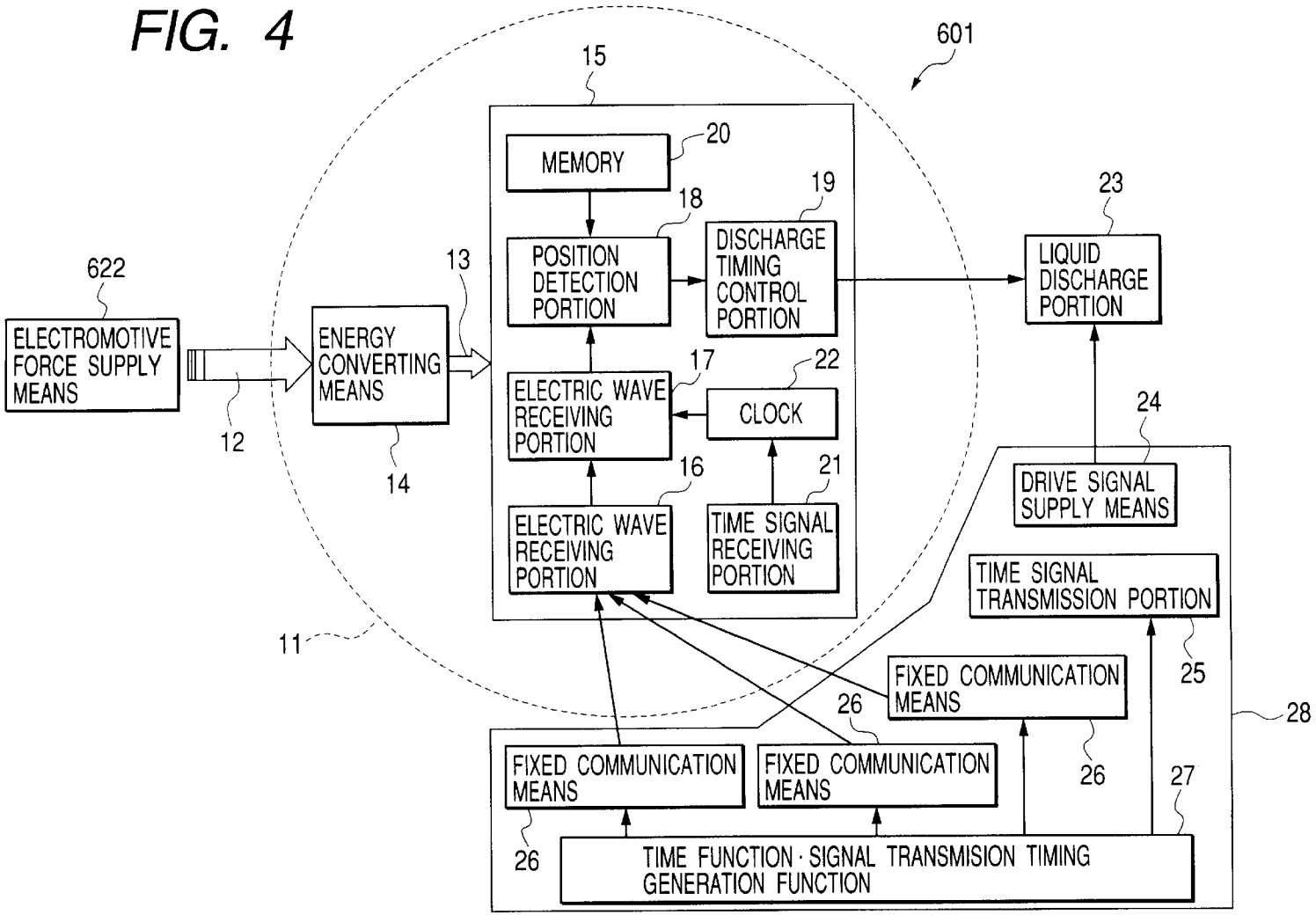
FIG. 4 is a block diagram of a major portion of the ink jet recording apparatus of the first embodiment.

This ink jet recording apparatus 600 has a head cartridge (ink jet recording head) 601 mounted, which has a liquid discharge portion (recording means) 23 for discharging ink to record printing as shown in FIG. 4 and an ink tank for holding the liquid supplied to the liquid discharge portion 23 as mentioned later. The liquid discharge portion 23 has a solid semiconductor element 11 provided, which has energy converting means 14 for converting electromotive force supplied from the outside into power and discharge control means 15 activated by power acquired by the energy converting means 14 as mentioned later. As shown in FIG. 4, a recording apparatus body 28 has an electromotive force supply means 622 for supplying electromotive force that is external energy to the solid semiconductor element 11 and three fixed communication means 26 for communicating information with the solid semiconductor element 11 installed. Moreover, the liquid discharge portion 23 can be considered to bubble the ink by heat of an electric thermal converting element such as a heater in a liquid path and discharge the ink from a micro-opening (discharge port) connected with the liquid path with its bubble growing energy.

The head cartridge 601 is mounted on a carriage 607 that engages with a spiral groove 606 of a lead screw 605 rotating via driving force transfer gears 603 and 604 in synchronization with forward and backward rotation of a drive motor 602 as shown in FIG. 3. The head cartridge 601 is reciprocated in directions of arrows a and b along a guide 608 together with the carriage 607 by power of the drive motor 602. The ink jet recording apparatus 600 has record medium carrying means (unillustrated) for carrying printing paper P as a record medium for receiving liquid such as the ink discharged from the head cartridge 601. A paper holder 610 of the printing paper P carried on a platen 609 by that record medium carrying means presses the printing paper P onto the platen 609 in the movement direction of the carriage 607.

Photocouplers 611 and 612 are placed close to an end of the lead screw 605. The photocouplers 611 and 612 are home position detection means for checking existence of a lever 607*a* of the carriage 607 in the area of the photocouplers 611 and 612 and switching the rotating direction of the drive motor 602. Close to an end of the platen 609, a supporting member 613 for supporting a cap member 614 covering the front having a discharge port of the head cartridge 601. In addition, it has ink absorbing means 615 for absorbing the ink accumulated inside the cap member 614 after being discharged from the head cartridge 601 when empty. This ink absorbing means 615 performs suction recovery of the head cartridge 601 via the opening of the cap member 614.

The ink jet recording apparatus 600 has a body supporter 619. This body supporter 619 has a moving member 618 supported to and fro, that is, perpendicular to the moving direction of the carriage 607. The moving member 618 has a cleaning blade 617 fixed thereon. The cleaning blade 617 is not limited to this form but can be a publicly known cleaning blade in another form. Furthermore, it has a lever 620 for starting suction in a suction recovery operation by the ink absorbing means 615, where the lever 620 moves along with movement of a cam 621 engaging with the carriage 607, and driving force from the drive motor 602 is put under movement control by publicly known communication means such as clutch switching. An ink jet recording control portion for giving a signal to a heater provided on the head cartridge 601 and governing drive control of the aforementioned mechanisms is provided on the side of the recording apparatus body 28 and not shown in FIG. 3.

In the ink jet recording apparatus 600 having the above-mentioned configuration, the head cartridge 601 reciprocates over the entire width of the printing paper P carried on the platen 609 by the above described record medium carrying means. If a driving signal is supplied from driving signal supply means 24 to the head cartridge 601 during such movement, a liquid discharge portion 23 discharges the ink (recording liquid) to the record medium according to this signal and recording is performed.

Next, the solid semiconductor element 11 to be accommodated in the ink tank of the head cartridge 601 of the ink jet recording apparatus 600 will be described in detail.

FIG. 4 is a block diagram of the ink jet head cartridge 601 including the solid semiconductor element 11 and the recording apparatus body 28. This solid semiconductor element 11 has the energy converting means 14 for converting into power 13 electromotive force 12 supplied from the electromotive force supply means 622 (or 623) to the solid semiconductor element 11 in a non-contact manner and the discharge control means 15 activated by the power acquired by the energy converting means 14, and is placed in the ink tank mentioned later. The electromotive force supplied in order to operate the solid semiconductor element 11 is generated by electromagnetic induction. The energy converting means 14 should desirably be formed on a surface or near the surface of the solid semiconductor element 11.

The discharge control means 15 has an electric wave receiving portion 16, an electric wave analyzing portion 17, a position detection portion 18, a discharge timing control portion 19, memory 20, a time signal receiving portion 21 and a clock 22. The electric wave receiving portion 16 receives electric waves from the three fixed communication means 26 of the recording apparatus body 28. The electric wave analyzing portion 17 identifies a frequency or an amplitude of the electric wave received by the electric wave receiving portion 16, and calculates a distance from each of the fixed communication means 26 to the electric wave receiving portion 16. The position detection portion 18 acquires an actual discharge position of this ink jet recording head 601 from the position of the electric wave receiving portion 16 in the ink jet recording apparatus 600, guided based on the distance from the three fixed communication means 26. The discharge timing control portion 19 transmits a discharge timing control signal for correcting discharge timing for rendering the actual discharge position as a discharge position for performing ideal ink discharge. The memory 20 stores data for acquiring the position of the electric wave receiving portion 16 in the ink jet recording apparatus 600 based on the distance from the three fixed communication means 26 to the electric wave receiving portion 16, data of relative positional relation between the position of the electric wave receiving portion 16 and the discharge position of the ink jet recording head 601, data for correcting the actual discharge position to be the discharge position for performing an ideal ink discharge and so on. The clock 22 supplies time data to the electric wave analyzing portion 17 in order to know in what timing the electric waves from the fixed communication means 26 were transmitted. The time signal receiving portion 21 receives a time signal from a time signal transmission portion 25 provided in the recording apparatus body 28 and corrects the clock 22 as appropriate in order to match the time between the recording apparatus body 28 and the clock 22 and know the electric wave transmission time from the fixed communication means 26. Moreover, the fixed communication means 26 and the time signal transmission portion 25 are controlled by a time function/signal transmission timing generation function 27.

Here, a principle of position detection will be briefly described. This embodiment employs a trilateration method that is similar to the position detection means widely known as the GPS (Global Positioning System).

Figure 5:
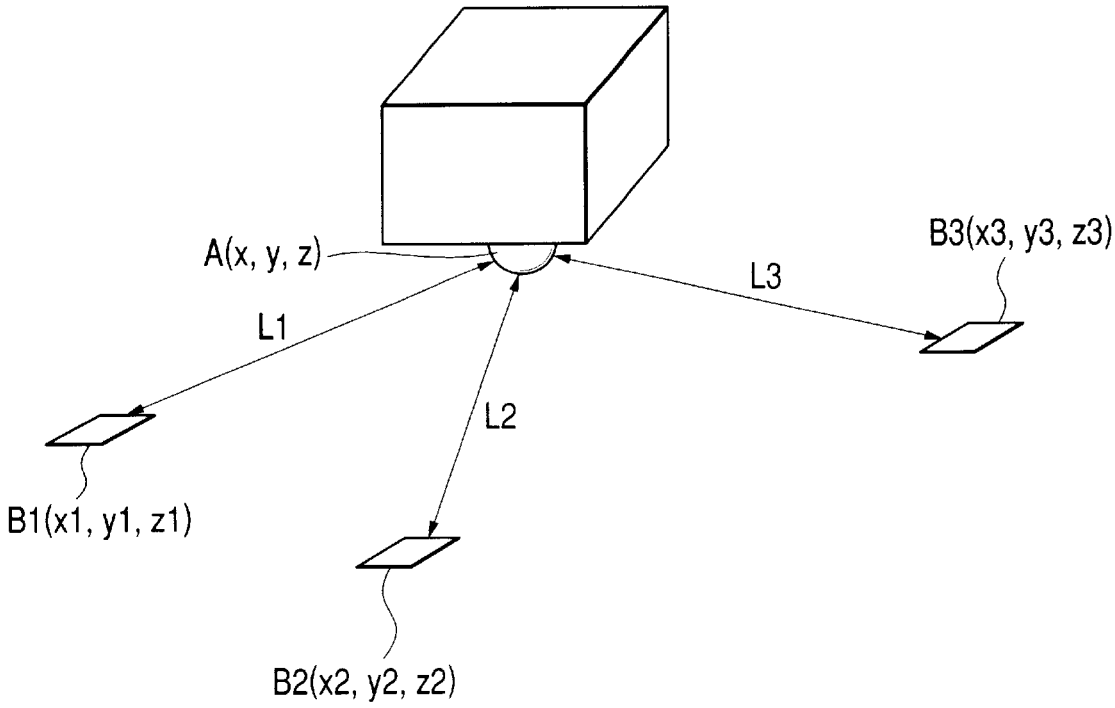
FIG. 5 is an illustration showing a principle of position detection.

As FIG. 5 shows, it is assumed that coordinates of known three points (three fixed communication means in this embodiment) B1, B2 and B3 are (x1, y1, z1), (x2, y2, z2) and (x3, y3, z3) respectively, and a coordinate of an unknown point (solid semiconductor element) A is (x, y, z). And it is assumed that distances from B1, B2 and B3 to A are L1, L2 and L3 respectively, so that the following relationship holds.

Distance from A to B1:

$$L1=\sqrt{(x1-x)^2+(y1-y)^2+(z1-z)^2}$$

Distance from A to B2:

$$L2=\sqrt{(x2-x)^2+(y2-y)^2+(z2-z)^2}$$

Distance from A to B3:

$$L3=\sqrt{(x3-x)^2+(y3-y)^2+(z3-z)^2}$$

Accordingly, if the distances L1, L2 and L3 are clarified, the three variables (x, y, z) are acquired by using the three equations for calculation.

Next, a method of seeking a distance in the present invention is briefly described. For instance, when transmitting an electric wave of which frequency is 100 MHz and speed is 300,000 km/s (=30 cm/ns), the time required for it to reach a receiving point after departing from a transmitting point is 1 ns if the distance between the transmitting point and the receiving point is 30 cm. Therefore, a phase at the transmitting point deviates from a phase at the receiving point by an equivalent of 1 ns. In the case of this example, the phase deviates by approximately 40 degrees. Thus, based on such a relationship, the distance between the two can be acquired by checking an amount of deviation of the phase from the predetermined phase on receipt at the receiving point (electric wave receiving portion of the solid semiconductor element) of the electric wave transmitted from the transmitting point (fixed communication means) in the predetermined phase.

Moreover, in this embodiment, as the electric waves from the three fixed communication means 26 are received by one electric wave receiving portion, the frequency, amplitude or pattern of the electric wave transmitted from each of the fixed communication means 26 is changed respectively in order to identify each electric wave. Thus, each of the fixed communication means 26 has an identification modulation function so as to transmit an electric wave unique to it.

As above, the position of the electric wave receiving portion 16 of the solid semiconductor element 11 in the ink jet recording apparatus 600 is calculated. And then, as a relative positional relation between the solid semiconductor element 11 and the ink discharge port in the ink jet recording head 601 is required on manufacturing the ink jet recording head 601, the position (actual discharge position) of the ink discharge port in the ink jet recording apparatus 600 can be acquired.

In producing records by the ink jet recording apparatus 600, one of the important factors in performing high-precision and high-quality printing is the positional relation. The positional relation between the record medium and the ink discharge position cannot always be kept as an ideal one due to an error in a movement mechanism of the carriage 607 caused by using it for a long period of time, for instance. It is not easily feasible, however, to mechanically correct this deviation of the relative positions because it requires highly large-scale work. Thus, it is thinkable to correct the deviation of the record medium and the ink discharge position by shifting the timing of discharging the ink so as to perform high-precision and high-quality printing. Accordingly, the actual ink discharge position is acquired by the above described method, and then the deviation from a desired position is checked, and besides, the discharge timing control signal for correcting the discharge timing as required for correcting the deviation is transmitted from the discharge timing control portion 19.

The above are the major workings of the solid semiconductor element 11 of this embodiment, and the data required for various calculation and so on are stored in the memory 20 in advance. Under normal conditions, such data is stored as initial data in the memory 20 on manufacturing of the ink jet recording head 601 or on manufacturing of the ink jet recording apparatus 600.

Under normal conditions, the ink jet recording head 601 has a driving signal supplied from the driving signal supply means 24 of the recording apparatus body 28 and discharges the ink selectively in synchronization with the movement of the carriage 607 so as to record a desired image and so on. In this embodiment, however, the timing of ink discharge instructed by the driving signal is corrected by the discharge timing control signal transmitted from the discharge timing control portion 19 of the solid semiconductor element 11 so as to discharge the ink. Nevertheless, the discharge timing control portion 19 does not transmit the discharge timing control signal in the case where the position detection portion 18 has detected that the actual discharge position coincides with the desired position.

Figure 6A:
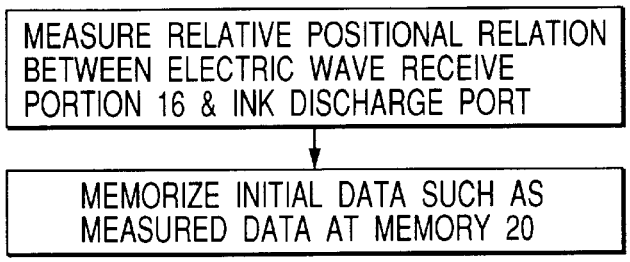
FIG. 6A is a flowchart of initialization on manufacturing the ink jet recording apparatus.
Figure 6B:
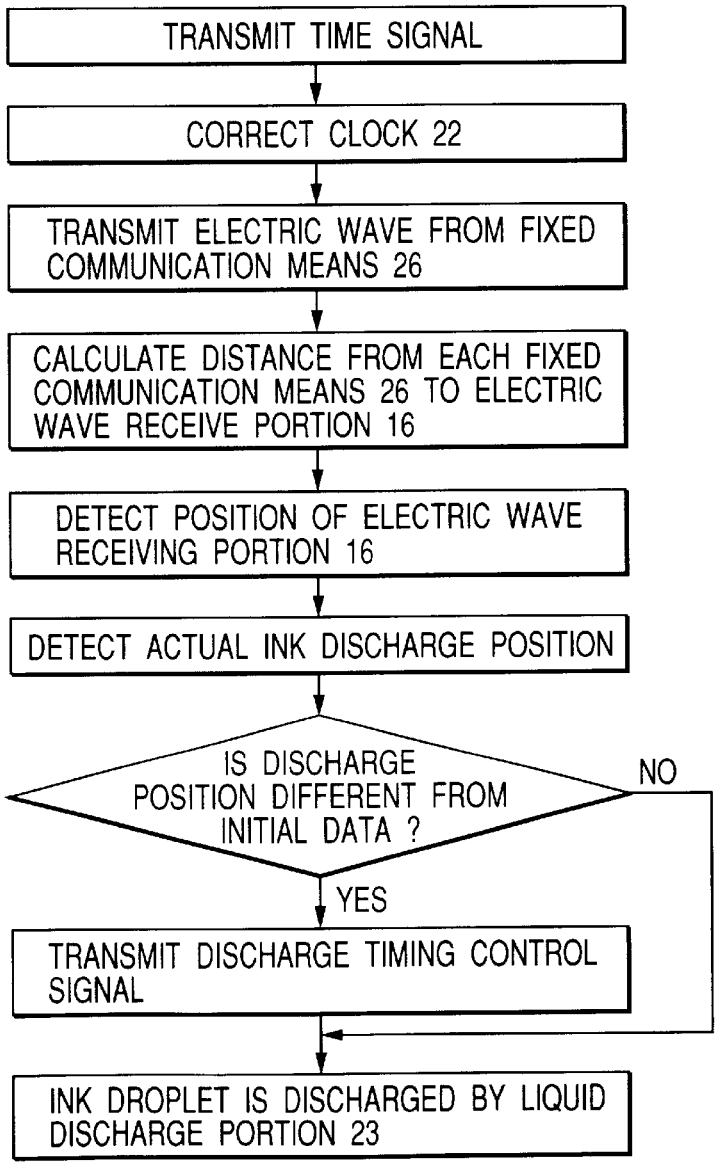
FIG. 6B is a flowchart on using it.

Here, an overview of operation of the ink jet recording apparatus of this embodiment will be described by referring to the flowcharts of FIG. 6A and FIG. 6B. FIG. 6A shows a manufacturing process of the head, and FIG. 6B shows use of the ink jet recording apparatus.

The ink jet recording apparatus 600 of this embodiment uses an unillustrated jig in the manufacturing process of the head to actually measure and acquire the relative positional relation between the electric wave receiving portion 16 of the solid semiconductor element 11 in the ink jet recording head 601 and the ink discharge port. And the measured data is stored as initial state data in the memory 20. And various data is stored in the memory 20 of the solid semiconductor element 11, such as how to adjust the discharge timing to correct such a positional relation when it deviates from the initial state, that is, when such a positional relation is not a desired one, and the equations required for calculation for the sake of position detection of the solid semiconductor element 11 as described above.

Thereafter, when the ink jet recording apparatus 600 is completed and used by a user, first, the time signal is transmitted from the time signal transmission portion 25 to the solid semiconductor element 11, and the time signal receiving portion 21 receives it and then determines whether the time of the time signal coincides with that of the clock 22, and in the case they do not coincide, it corrects the clock 22 to coincide therewith. And electric waves for position detection are transmitted from the three fixed communication means 26 to the solid semiconductor element 11. The electric wave receiving portion 16 receives them, and the electric wave analyzing portion 17 and the position detection portion 18 calculate the respective distances from the fixed communication means 26 to the electric wave receiving portion 16 based on the phase deviations as aforementioned so as to acquire the position of the electric wave receiving portion 16 in the ink jet recording apparatus 600 based thereon and acquire the position (actual discharge position) of the ink discharge port in the ink jet recording apparatus 600 based thereon. In the case where the position of the discharge port thus acquired is different from the initial state, the discharge timing is shifted in this embodiment in order to make up for this deviation. And then, the discharge timing control portion 19 transmits the discharge timing control signal to the liquid discharge portion 23. Moreover, all the various data and so on required for the above data processing are stored in the memory 20 in advance. In addition, it is desirable to store the deviation thus detected in the recording means.

The liquid discharge portion 23 is controlled by the driving signal supplied by the driving signal supply means 24 of the recording apparatus body 28 and the discharge timing control signal from the discharge timing control portion 19, and produces records by ejecting ink droplets onto the printing paper P in synchronization with feeding of the printing paper P and reciprocating movement of the carriage 607.

Moreover, the solid semiconductor element 11 is operated by the electromotive force supply means 622 supplying electromotive force 12 to the solid semiconductor element 11, and the energy converting means 14 converting the electromotive force 12 into the power 13 and then activating the discharge control means 15 by that power.

Figure 7:
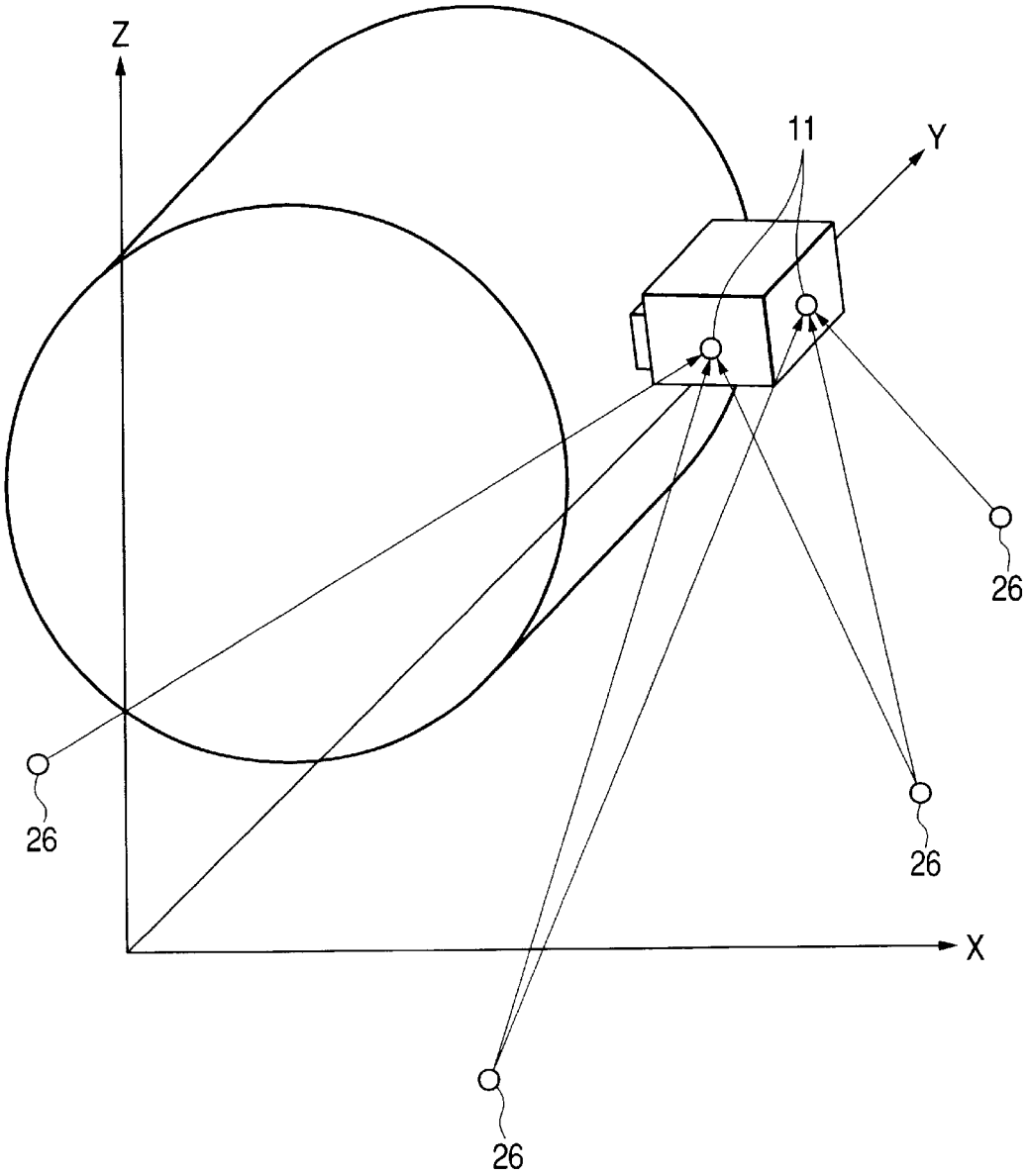
FIG. 7 is a sketch of the ink jet recording apparatus having a plurality of solid semiconductor elements.

It is also possible to have a configuration wherein a plurality of the solid semiconductor elements are provided in recording head. This is because providing only one solid semiconductor element may create a dead angle of communication considering that the carriage moves in an extended range, surrounded by various other members and also that records will be produced on a three-dimensional object in the future. In addition, in the case of providing a plurality of the solid semiconductor elements as described above, it is desirable to provide four or more of the fixed communication means 26 on the recording apparatus body as shown in FIG. 7. Thus, it is possible to make discharge position detection high-precision by providing two or more of the solid semiconductor element 11 and providing four or more of the fixed communication means 26.

In the case of providing a plurality of the solid semiconductor elements, while independent elements as shown in FIG. 4 can be separately prepared, it is also feasible to render certain functions in common so that the solid semiconductor elements can communicate with one another.

According to this embodiment, as the solid semiconductor element 11 has the energy converting means 14, it is no longer necessary to implement direct electrical wiring with the outside, and it is possible to use the solid semiconductor element 11 even at locations where direct electrical wiring with the outside is difficult so that the position of the discharge port can be grasped in real time during the movement of the carriage 607. In addition, as the solid semiconductor element 11 has the energy converting means 14, it is no longer necessary to place means for accumulating the electromotive force for operating the solid semiconductor element 11, and so it is possible to render the solid semiconductor element 11 smaller so that it can be placed even in a narrow location.

Moreover, as a two-way communication method between the solid semiconductor element and the outside, it is possible to apply a radio LAN system using a microwave band frequency or a radio access system utilizing a quasi-millimeter wave/millimeter wave frequency.

Here, an overview of sending and receiving by the radio LAN system will be described. The following will describe data transmission from the solid semiconductor element to the recording apparatus. Moreover, in the case of inversely performing data transmission from the recording apparatus to the solid semiconductor element, a data ID is placed on each side so that they can be identified thereby.

The solid semiconductor element on the transmitting side has a line monitoring portion, a data handling portion, an acknowledgement check portion and an error processing portion, and the recording apparatus on the receiving side has a data handling portion, an acknowledgement portion, an error processing portion, a display portion and so on placed.

Figure 8:
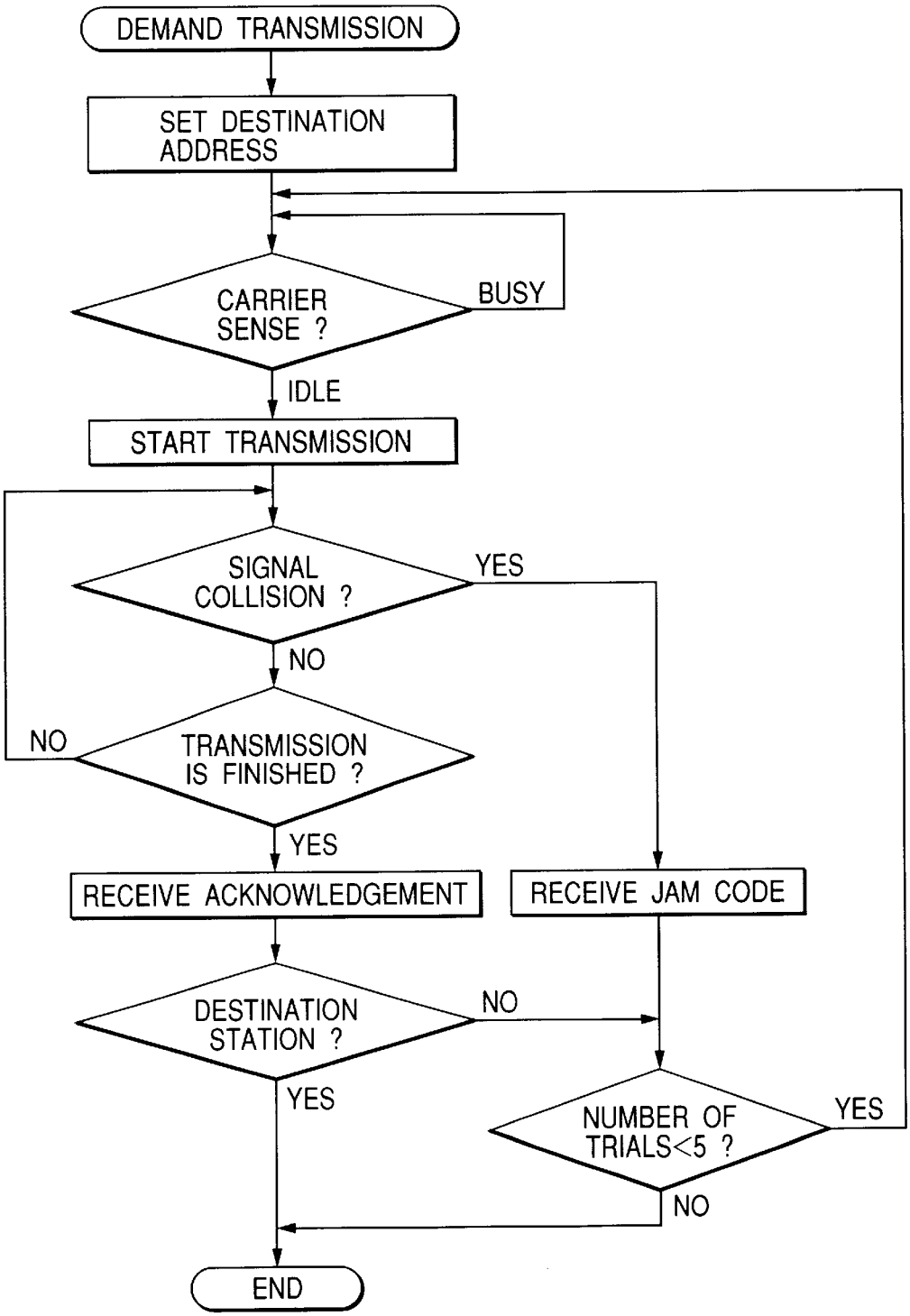
FIG. 8 is a diagram showing a flowchart as to the solid semiconductor element on the transmitting side in the case of performing two-way communication between the solid semiconductor element of the ink jet recording apparatus of the present invention and the recording apparatus body.

FIG. 8 shows a flowchart in the solid semiconductor element on the transmitting side. In the case of transmitting data, initialization is performed by a determined transmission protocol, and then an address on the receiving side is set and data is transmitted. In the case where signals collide during the transmission or no acknowledgement is returned from a specified apparatus on the receiving side, it is resent. While in operation, it displays a state of the line and whether or not there is an acknowledgement on a display portion placed on the recording apparatus on the receiving side so as to prompt the user to make an accurate determination.

Figure 9:
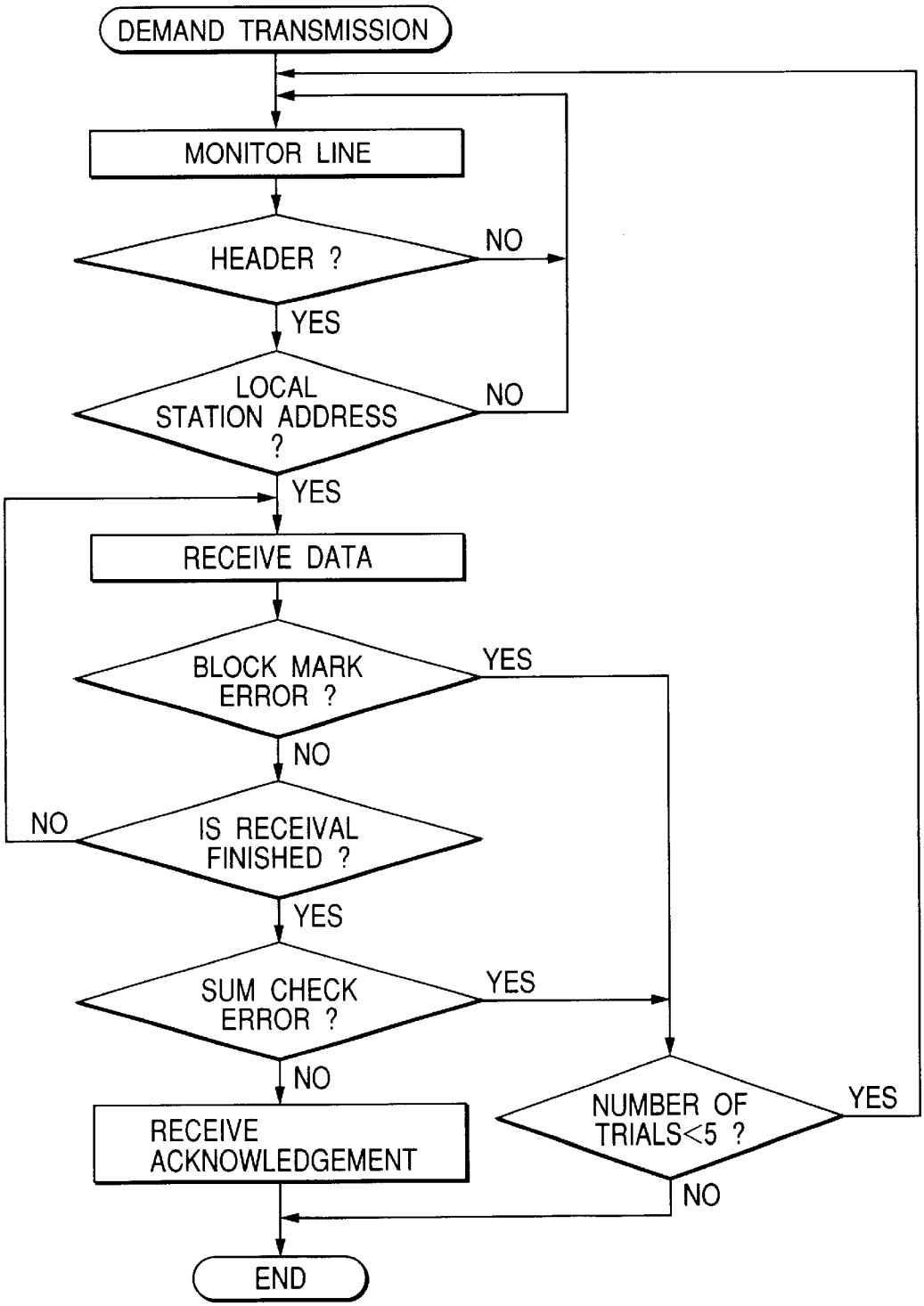
FIG. 9 is a diagram showing a flowchart as to the recording apparatus body on the receiving side in the case of performing two-way communication between the solid semiconductor element of the ink jet recording apparatus of the present invention and the recording apparatus body.

FIG. 9 shows a flowchart in the recording apparatus on the receiving side. On this receiving side, it constantly monitors the line, and if its own address is confirmed, it takes in the data from the line and accumulates it in a buffer on a main memory. In the case where a block mark per 16 bytes cannot be confirmed during receiving or a check sum does not match in an error detection process after completion of receiving, it interrupts receiving as a receiving error, monitors the line again, and waits for arrival of the header. In the case of receiving it without an error, it displays the received contents on the display portion.

The solid semiconductor element 11 can have various functions in addition to a series of the above described operation of discharge position detection and discharge timing control.

Second Embodiment

Next, a configuration wherein the solid semiconductor element is used for a configuration for detecting the state of the ink tank will be described.

Figure 10:
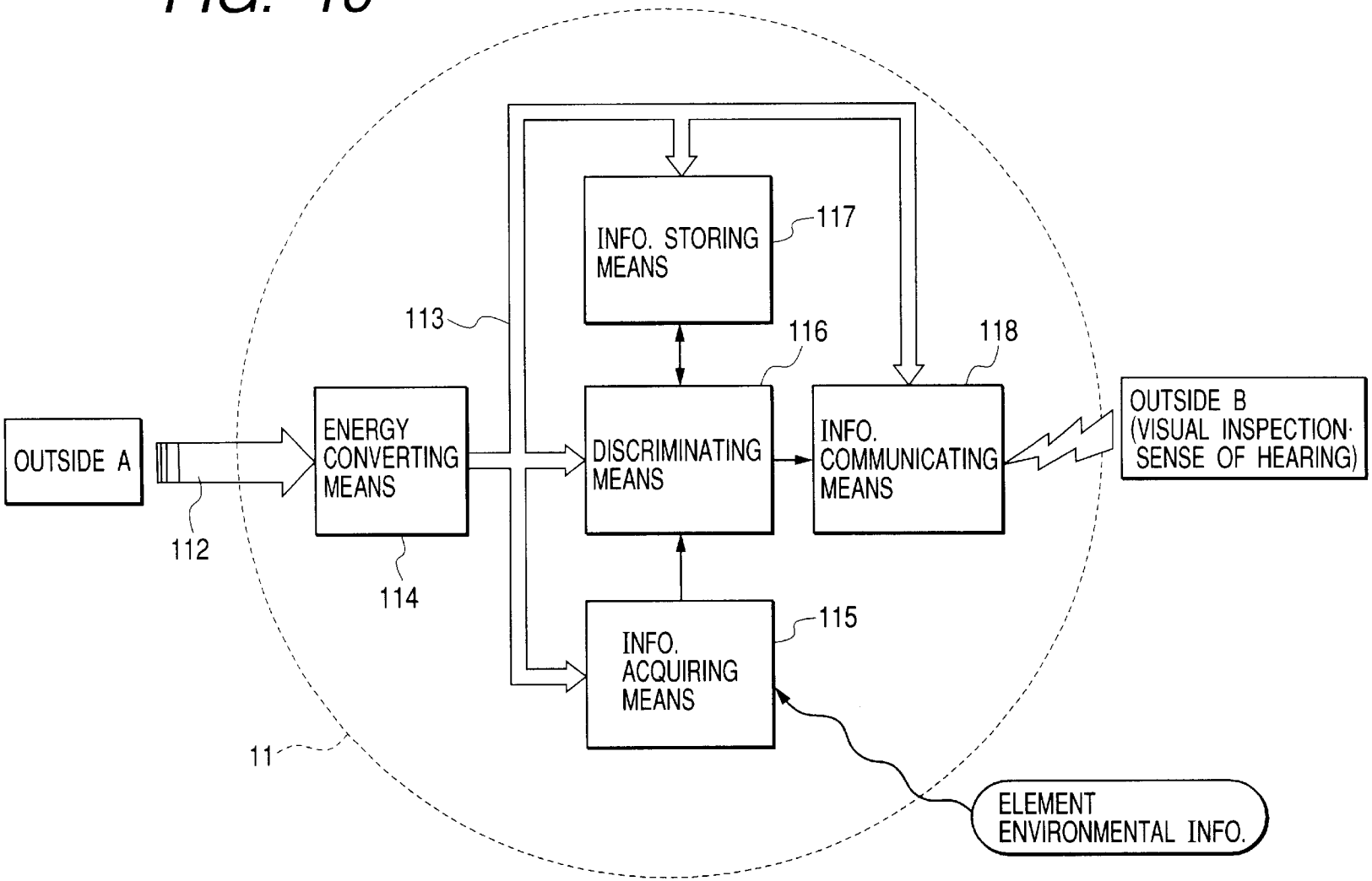
FIG. 10 is a block diagram showing internal configuration of the solid semiconductor element of a second embodiment and its exchanges with the outside.

FIG. 10 shows a block diagram showing internal configuration of the solid semiconductor element 11 used for the ink jet recording apparatus of a second embodiment of the present invention and its exchanges with the outside. As shown in FIG. 3, the ink jet recording apparatus 600 has the standstill electromotive force supply means 622 for supplying electromotive force that is external energy to the solid semiconductor element 11 and the movement time electromotive force supply means 623 as well as means for performing two-way communication of information with the solid semiconductor element 11 (unillustrated) installed therein. As mentioned later, the electromotive force supply means 622 and 623 generate the electromotive force for operating the solid semiconductor element 11 by the electromagnetic induction.

This solid semiconductor element 11 has an energy converting means 114 for converting into power 113 electromotive force 112 supplied from an outside A (electromotive force supply means 622 or 623) to the solid semiconductor element 11 in a non-contact manner and an information acquiring means 115 activated by the power acquired by the energy converting means 114, and a discriminating means 116, an information storing means 117 and an information communicating means 118, and is placed in the ink tank mentioned later. The electromotive force supplied to operate the solid semiconductor element 11 is generated by the electromagnetic induction. It is desirable that at least the energy converting means 114 and the information acquiring means 115 should be formed on or near the surface of the solid semiconductor element 11.

The information acquiring means 115 acquires information in the ink tank, which is environmental information of the solid semiconductor element 11. The discriminating means 116 compares the in-tank information acquired from the information acquiring means 115 with information stored in the information storing means 117 and determines whether or not the acquired in-tank information should be transmitted to the outside. The information storing means 117 stores the in-tank information acquired from the information acquiring means 115 and the conditions to be compared with this in-tank information. The information communicating means 118 converts the power into the energy for transmitting the in-tank information according to an order of the discriminating means 116 so as to display and transmit the in-tank information to an outside B.

Figure 11:
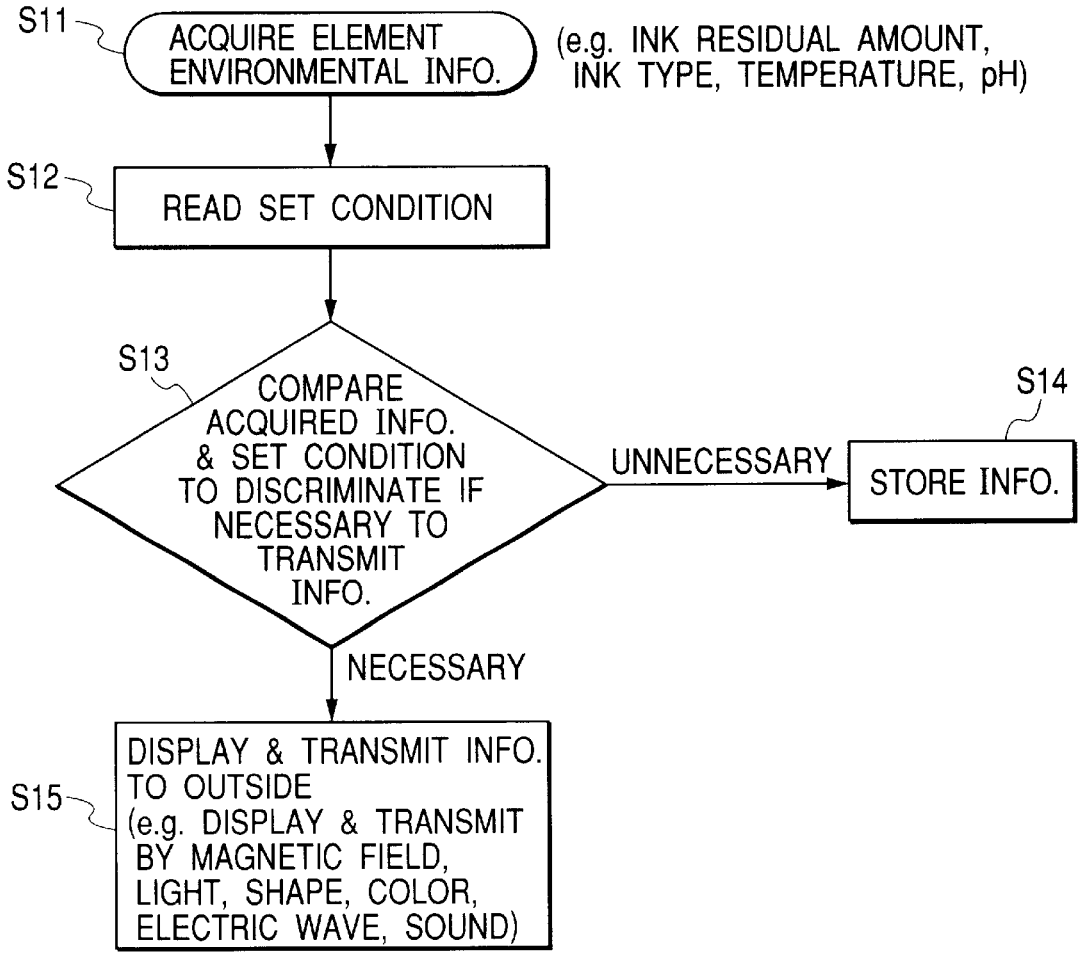
FIG. 11 is a flowchart for explaining operation of the solid semiconductor element shown in FIG. 10.
Figure 12:
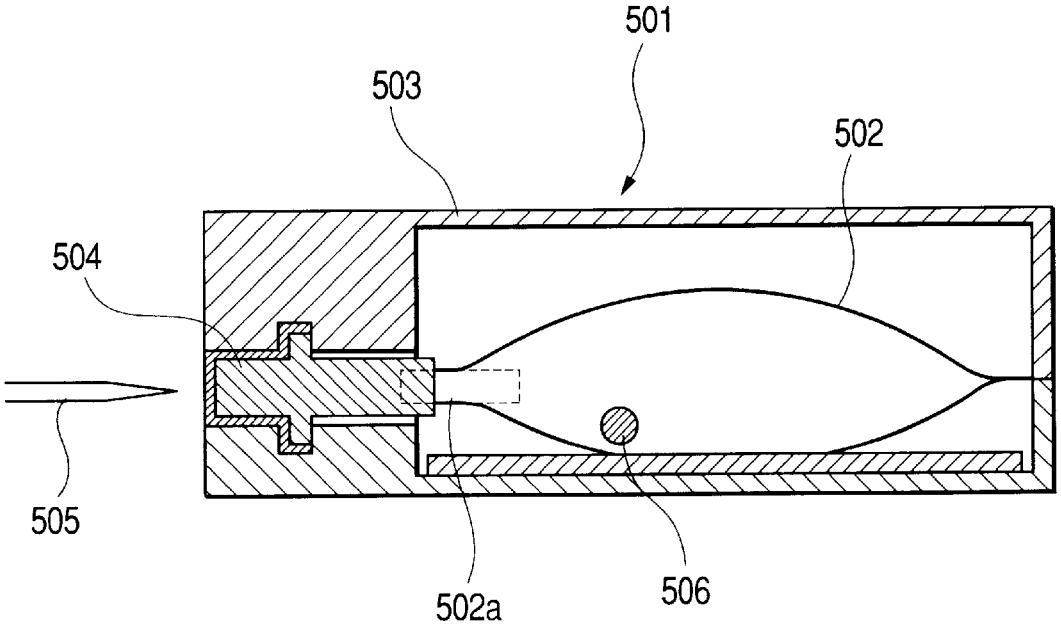
FIG. 12 is a diagram showing an example of configuration of an ink tank suitable for placing the solid semiconductor element.

FIG. 11 is a flowchart for explaining operation of the solid semiconductor element 11 shown in FIG. 10. As shown in FIG. 10 and FIG. 11, if the electromotive force 112 is given from an outside A (electromotive force supply means) to the solid semiconductor element 11, the energy converting means 114 converts the electromotive force 112 into the power 113, and activates by that power the information acquiring means 115, the discriminating means 116, the information storing means 117 and the information communicating means 118.

The activated information acquiring means 115 acquires information in the ink tank, which is environmental information around the solid semiconductor element, such as an ink residual amount, an ink type, temperature and pH (step S11 in FIG. 11). Next, the discriminating means 116 reads from the information storing means 117 conditions for referring the acquired in-tank information to (step S12 in FIG. 11), and compares the read conditions with the acquired in-tank information to determine necessity of transmitting the information (step S13 in FIG. 11). Here, the conditions preset in the information storing means 117 are a minimum residual amount of the ink (2 ml for instance), pH of the ink and so on for instance, and it is determined based thereon that, when the residual amount of the ink becomes 2 ml or less or pH of the ink greatly changes, it is necessary to transmit necessity of tank replacement to the outside.

In the case where the discriminating means 116 determines that it is not necessary to transmit the in-tank information to the outside in step S13, the current in-tank information is stored in the information storing means 117 (step S14 in FIG. 11). This stored information can also be compared with the information acquired next by the information acquiring means 115 by the discriminating means 116.

Moreover, in the case where the discriminating means 116 determines that it is necessary to transmit the in-tank information to the outside in a step S13, the power acquired by energy conversion is converted by the information communicating means 118 into the energy for transmitting the in-tank information to the outside. This energy for transmitting is capable of using magnetic fields, light, shape, color, electric waves, sound and so on, and for instance, in the case where it is determined that the ink residual amount has become 2 ml or less, it transmits necessity of tank replacement to the outside B (such as the ink jet recording apparatus) by sounding (step S15 in FIG. 11). In addition, the target of transmission is not limited to the ink jet recording apparatus body but it can also be transmitted to the human sense of sight or hearing especially in the case of light, shape, color, sound and so on. Furthermore, the transmitting method can be changed according to information, for instance, transmitting it by sound in the case where it is determined that the ink residual amount has become 2 ml or less, and by light in the case where pH of the ink has greatly changed.

In the case of being used for the ink jet recording apparatus, the standstill electromotive force supply means 622 for supplying electromotive force as external energy to the solid semiconductor element 11 should be placed at the home position so that the carriage 607 will certainly visit it between completion of printing and start of printing of a magnetic field, and consequently there is little possibility that the electromotive force supply to the solid semiconductor element is delayed. In addition, it is possible to know the internal state of the ink tank by using the electromotive force supply means, which can be used for inspection (quality assurance) if used by a factory or a distributor. The electromotive force supply means and method will be mentioned later.

This embodiment has the above-mentioned solid semiconductor elements accommodated in the ink tank. FIG. 12 to FIG. 15 show examples of configuration of this ink tank. As for an ink tank 501 shown in FIG. 12, it has a flexible ink bag 502 placed in a housing 503, a bag mouth 502*a* closed with a rubber plug 504 fixed on the housing 503, and a hollow needle 505 for leading the ink stuck into the rubber plug 504 and pierced through the inside of the bag so as to supply the ink to the unillustrated ink jet head. A solid semiconductor element 506 can be placed in the ink bag 502 of such an ink tank 501.

Figure 13:
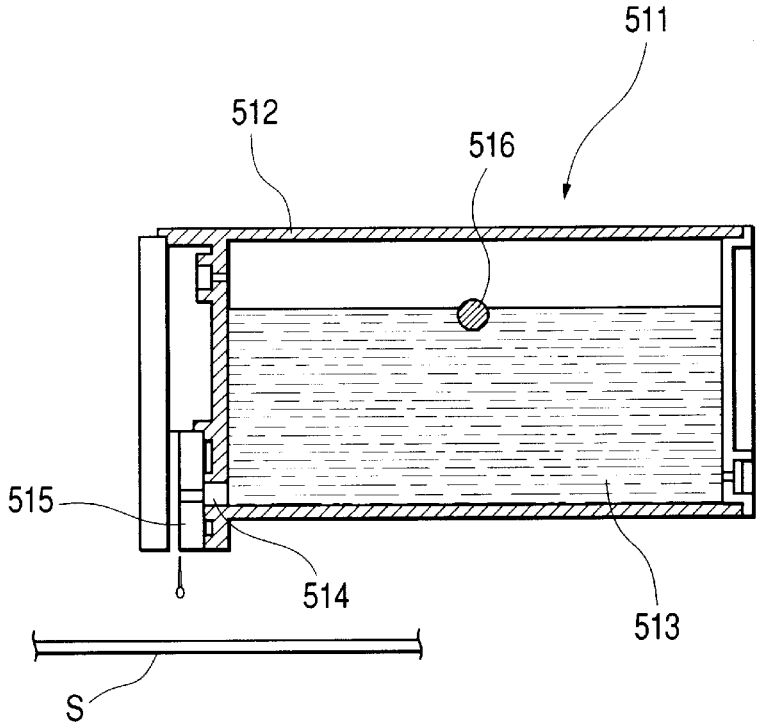
FIG. 13 is a diagram showing another example of configuration of an ink tank suitable for placing the solid semiconductor element.

In addition, an ink tank 511 shown in FIG. 13 has an ink supply port 514 of the housing 512 accommodating ink 513 on which an ink jet head 515 for discharging the ink onto recording paper S for recording is mounted. A solid semiconductor element 516 of the present invention can be placed in the ink 513 in such a tank 511.

Figure 14:
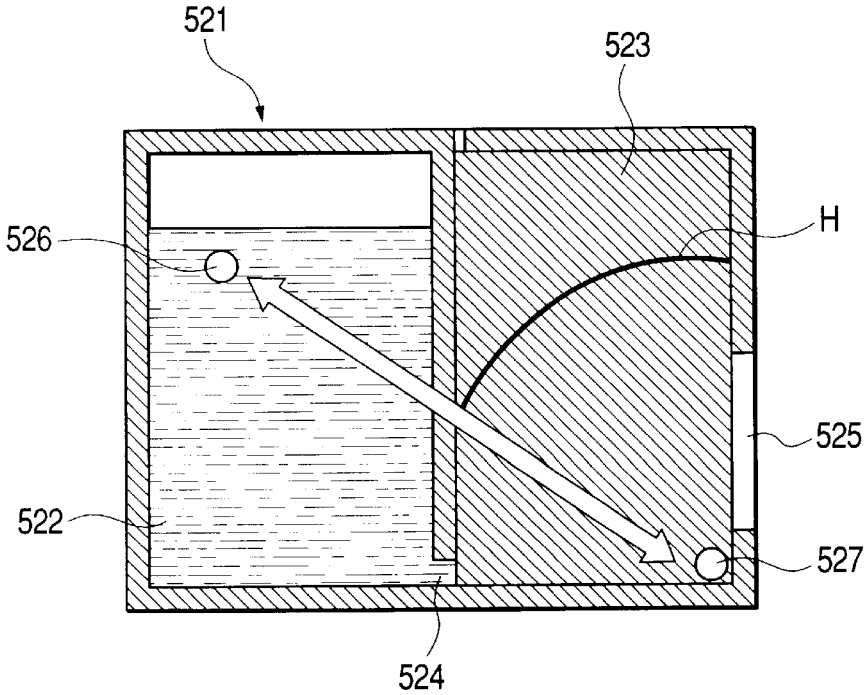
FIG. 14 is a diagram showing a further example of configuration of an ink tank suitable for placing the solid semiconductor element.

Moreover, an ink tank 521 shown in FIG. 14 is a tank similar to the one shown in the embodiment described later, and it has a first chamber in a completely sealed state for accommodating ink 522, a second chamber in a ventilating state for accommodating a negative pressure generating member 523, and a communicating path 524 for communicating the first chamber with the second chamber at the tank bottom. If the ink is consumed from an ink supply port 525 on the second chamber side, the air flows from the second chamber into the first chamber, and instead, the ink 522 of the first chamber is led out to the second chamber. It is also feasible, in the tank 521 of such a configuration, to place solid semiconductor elements 525 and 526 in the first chamber and the second chamber respectively so as to exchange information on the ink in each of the divided chambers.

Figure 15:
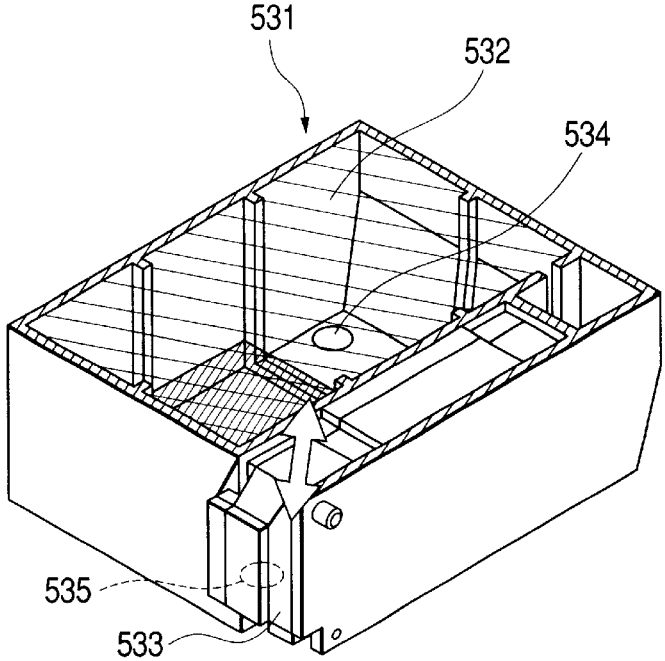
FIG. 15 is a diagram showing a still further example of configuration of an ink tank suitable for placing the solid semiconductor element.

In addition, an ink tank 531 shown in FIG. 15 has an ink jet head 533 mounted, which accommodates a porous member 532 holding the ink and uses the accommodated ink for recording. The tank 531 of such a configuration can also have solid semiconductor elements 534 and 535 placed on the ink tank side and on ink jet head side respectively to exchange information on the ink in the respective divided components as with the tank shown in the embodiment described later.

According to this embodiment, as the solid semiconductor elements have the energy converting means, it is no longer necessary to implement direct electrical wiring with the outside, and so it is possible to use the solid semiconductor elements in any location in the object, that is, even at locations where direct electrical wiring with the outside is difficult or in the ink as shown in FIG. 12 to FIG. 15 as described above. It becomes possible, by placing the solid semiconductor elements in the ink, to grasp the state of the ink correctly in real time.

In addition, as the solid semiconductor elements have the energy converting means, it is no longer necessary to place means (a power supply in this embodiment) for accumulating the electromotive force for operating the solid semiconductor elements, and so it is possible to render the solid semiconductor elements smaller so that they can be used in any location in the object, that is, even in a narrow location or in the ink as shown in FIG. 4 to FIG. 7.

Next, preferable concrete examples in the case of placing the solid semiconductor elements of this embodiment in the ink tank will be described further in detail.

First, the information acquiring means applicable to the solid semiconductor elements of this embodiment are taken as examples. In the case where solid semiconductor elements to be placed in the ink tank are created into spherical silicon, the following can be named as the above described information acquiring means. (1) A sensor for creating an $SiO_2$ film or an SiN film as an ion-sensitive film to detect pH of the ink. (2) A pressure sensor having a diaphragm configuration for detecting pressure change in the tank. (3) A sensor for converting light into thermal energy, creating photodiodes having pyroelectric effects, detecting a current position and detecting an ink residual amount. (4) A sensor for detecting whether or not there is ink from an in-tank water amount by utilizing the electrical conductivity of materials, and so on.

Figure 16:
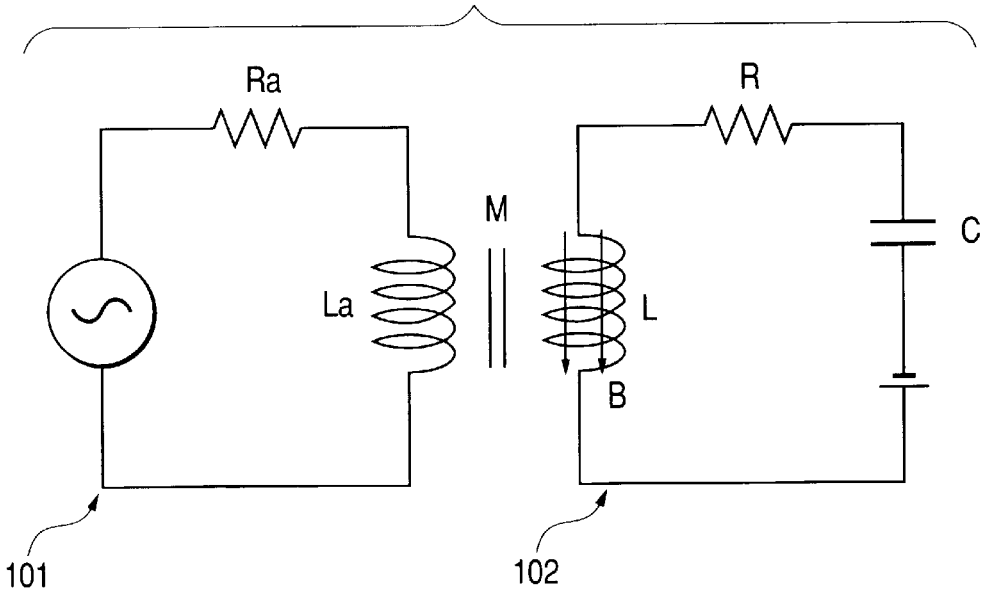
FIG. 16 is a diagram for explaining power generation principle of the solid semiconductor element of a second embodiment.

Next, the energy generating means applicable to the solid semiconductor elements of the present invention will be described. FIG. 16 is a diagram for explaining power generation principle of the energy generating means that is a component of the solid semiconductor element of the present invention.

First, this power generation principle will be described by referring to FIG. 16.

In this embodiment, a coil (an inductor) is provided to the solid semiconductor element so that the electromotive force supply means changes a magnetic flux around the coil so as to generate induced electromotive force to the coil by electromagnetic induction. To be more specific, if an electric conductor coil L of an oscillation circuit 102 is placed next to a coil La of an external resonance circuit 101 of the electromotive force supply means, and a current Ia is fed through the coil La through the external resonance circuit 101, a magnetic flux B piercing through the coil L of the oscillation circuit 102 is generated by the current Ia. Here, if the current Ia is changed, the magnetic flux B piercing through the coil L changes so that induced electromotive force V occurs to the coil L. Accordingly, the oscillation circuit 102 as the energy generating means is created in the spherical silicon, and the external resonance circuit 101 as the electromotive force supply means is placed on the ink jet recording apparatus outside the solid semiconductor element in such a way as to have the electric conductor coil L of the oscillation circuit 102 on the solid semiconductor element side placed next to the coil La of the external resonance circuit 101 outside the solid semiconductor element, so that the power for operating the solid semiconductor element is generated by the induced electromotive force due to the electromagnetic induction from the outside.

In addition, as the magnetic flux B piercing through the coil L of the number of turns N of the oscillation circuit 102, which is created in the spherical silicon as the energy generating means will be as follows assuming a proportionality constant is k, since it is proportionate to the product of the number of turns Na of the coil La of the external resonance circuit 101 and the current Ia.

$$B=k\times Na\times Ia \tag{1}$$

The electromotive force V occurring to the coil L will be as follows.

$$V=N\{dB/dt\}=-kNaN\{dIa/dt\}=-M\{dIa/dt\}(2)$$

Here, if permeability of a magnetic core of the coil is $\mu a$ and the magnetic field is H, the magnetic flux B will be as follows.

$$B=\mu aH(z)=\{\mu_a N_a I_a r_a^2/2(r_a^2+z^2)^{3/2} \tag{3}$$

Here, z indicates the distance between the coil of the external resonance circuit and the coil created in the spherical silicon.

The mutual inductance of the equation: M will be as follows.

$$M=\{\mu N/\mu aIa\}\int_s B\cdot dS=\{\mu\mu_a r_a^2 N_a NS/2\mu_o(r_a^2+Z^2)^{3/2}\} \tag{4}$$

Here, $\mu_0$ is space permeability.

And the impedance of the oscillation circuit created in the spherical silicon: Z will be as follows.

$$Z(\omega)=R+j\{\omega L-(1/\omega C)\}(5)$$

The impedance of the external resonance circuit: Za will be as follows.

$$Za(\omega)=Ra+j\omega La-\{\omega^2M^2/Z(\omega)\} \tag{6}$$

Here, J represents magnetization. And the impedance on resonance (when current value: Ia becomes maximum) of the external resonance circuit: Zo will be as follows.

$$Zo(\omega_0)=Ra+jLa\omega_0-(\omega_o^2M^2/R) \tag{7}$$

The delay of the phase of the external resonance circuit: $\phi$ will be as follows.

$$\tan\phi=\{jLa\omega_0-(\omega_o^2M^2/R)\}/R \tag{8}$$

And the resonance frequency of the external resonance circuit: of will be as follows.

$$f0=\tfrac{1}{2}\pi(LC)^{1/2} \tag{9}$$

Due to the above relationship, if the impedance of the oscillation circuit 102 created in the spherical silicon varies according to the change of the ink in the ink tank, it changes the frequency of the external resonance circuit 101 so that the above change of the ink shows in the amplitude and the phase difference of the impedance of the external resonance circuit 101. In addition, the phase difference and amplitude include the ink residual amount (that is, change of z).

For instance, as making the resonance frequency of the external resonance circuit 101 variable changes output (impedance) from the oscillation circuit 102 created in the spherical silicon according to environmental change, it is possible, by detecting this frequency dependence to detect whether or not there is ink and the ink residual amount.

Accordingly, it is possible to use the oscillation circuit 102 created in the spherical silicon not only as the energy generating means for generating power but also as part of means for detecting the change of the ink in the tank in the relationship between the oscillation circuit 102 and the external resonance circuit 101.

Based on such a principle, the concrete means and method for supplying the electromotive force to the solid semiconductor element will be described by referring to FIG. 17 to FIG. 24. Moreover, in order to make them easier to understand, FIGS. 17, 18, 20 and 23 only show the ink tank, leaving out the carriage and the recording head.

Figure 17:
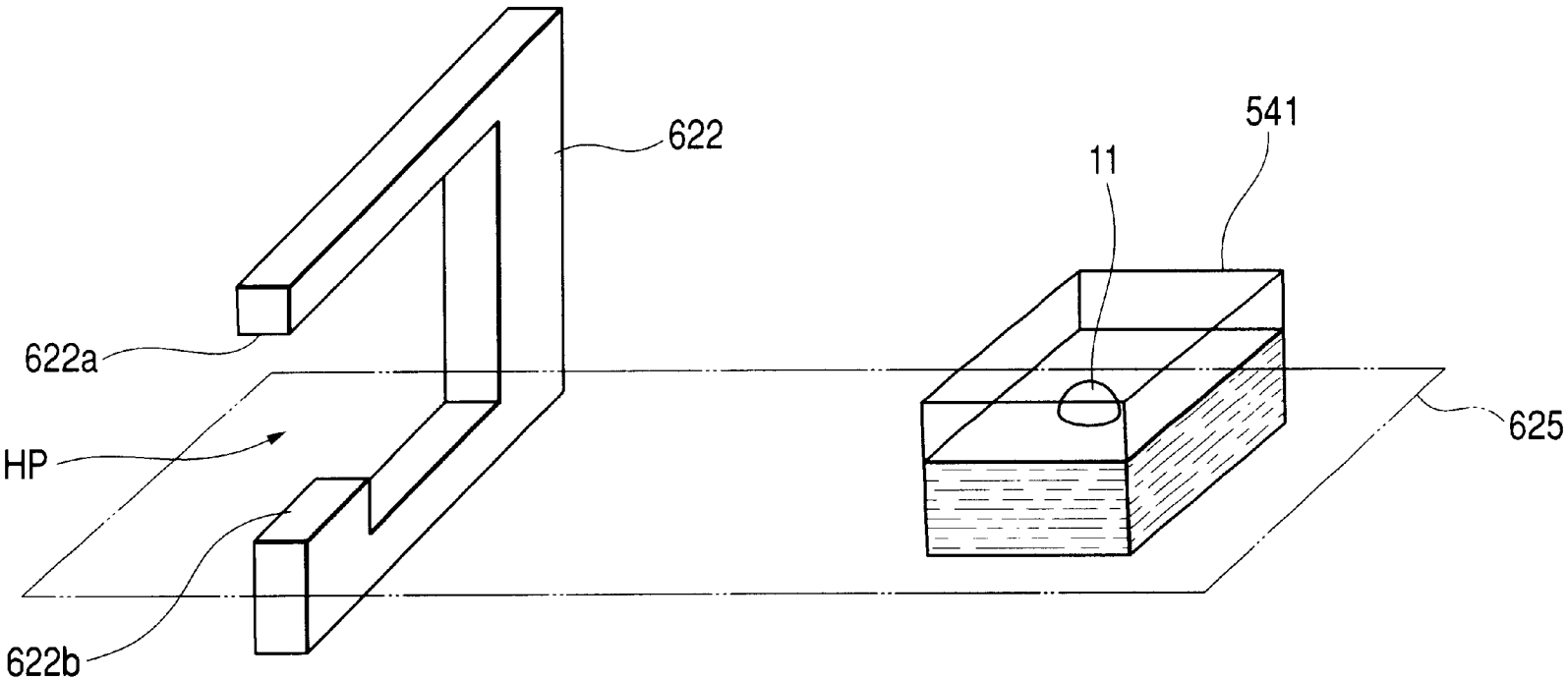
FIG. 17 is a schematic diagram showing standstill electromotive force generation means of the second embodiment.

As shown in FIG. 17, an ink tank 541 mounted on the carriage 607 reciprocates during printing and recording, and stops at the home position HP provided outside the recording area while not printing. While not printing, at the home position HP, the head cartridge 601 shown in FIG. 3 has the suction recovery process and so on performed by the cap member 614, the ink absorbing means 615 and the cleaning blade 617. In this embodiment, the electromotive force is supplied to the solid semiconductor element 11 while the carriage 607 is at standstill at the home position HP.

In order to generate the induced electromotive force on the solid semiconductor element 11 by electromagnetic induction in compliance with the above described principle, an electromagnetic apparatus 622 is placed as the standstill electromotive force supply means at the home position HP.

The electromagnetic apparatus 622 is roughly U-shaped, where both ends 622*a* and 622*b* are placed oppositely sandwiching a carrier path (range of movement) 625 of the carriage 607. And when the electromagnetic apparatus 622 is in operation, both the ends 622*a* and 622*b* become magnetic poles, that is, either an S pole or an N pole, and generate the magnetic flux piercing through the solid semiconductor element 11 in the ink tank 541 mounted on the carriage 607.

Figure 18:
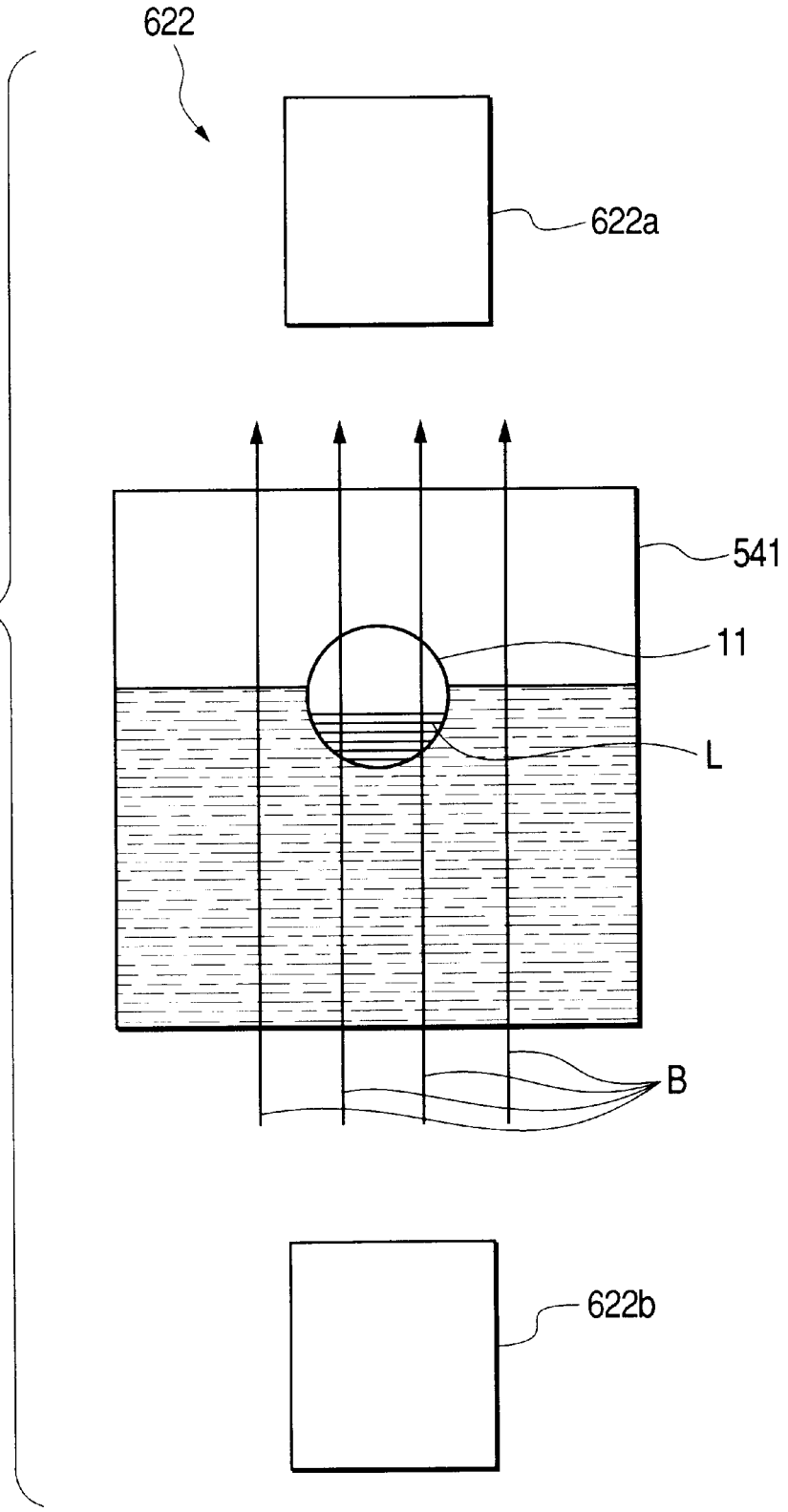
FIG. 18 is a schematic diagram for explaining operation of supplying electromotive force by the standstill electromotive force generation means shown in FIG. 17.
Figure 19A:
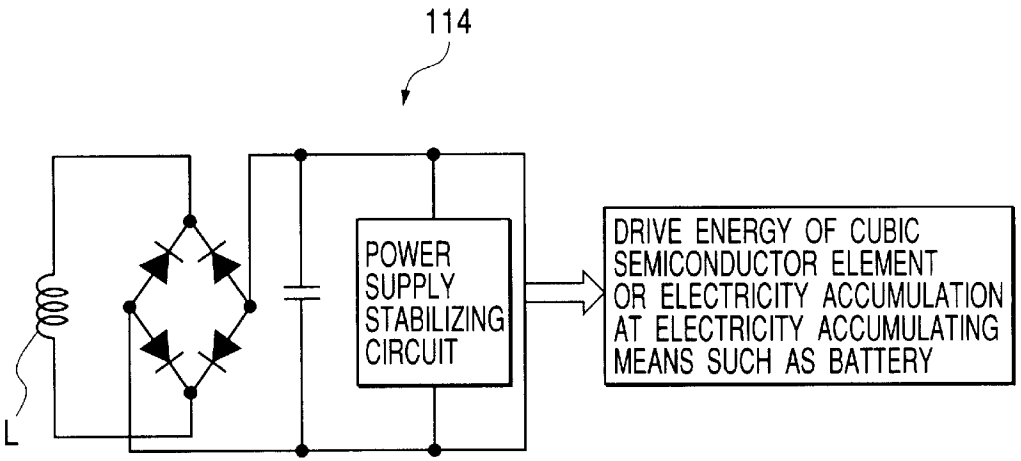
FIG. 19A is an electric circuit diagram showing a major portion of energy converting means of the solid semiconductor element of the second embodiment.
Figure 19B:
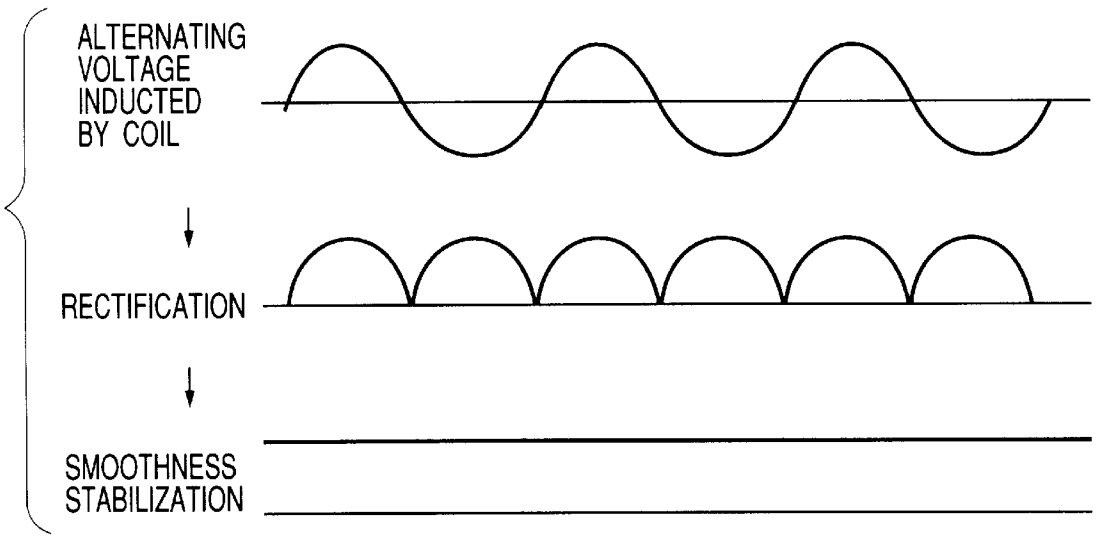
FIG. 19B is a graph for explaining energy conversion.

In this embodiment, as the electromagnetic apparatus 622 is AC-driven and magnetic properties of both the ends 622*a* and 622*b* continue to change mutually, as shown in FIG. 18, the magnetic flux B piercing through the solid semiconductor element 11 continues to change constantly. To be more specific, as the magnetic flux B piercing through the coil L shown in FIG. 16 changes, the AC-induced electromotive force occurs to the coil L. This AC-induced electromotive force is rectified and rendered smooth and stable as shown in FIG. 19B by the energy converting means 114 shown in FIG. 19A. And then, part of the power that has become a direct current is supplied to and activates the information acquiring means 115, the discriminating means 116, the information storing means 117 and the information communicating means 118 of the solid semiconductor element 11. In addition, the remaining power is accumulated by unillustrated electricity accumulating means such as a battery and a capacitor for the sake of subsequent activation and operation of the solid semiconductor element 11. According to such a configuration, the electromotive force can be supplied to the solid semiconductor element 11 in a non-contact manner at the home position HP while not printing.

Figure 20:
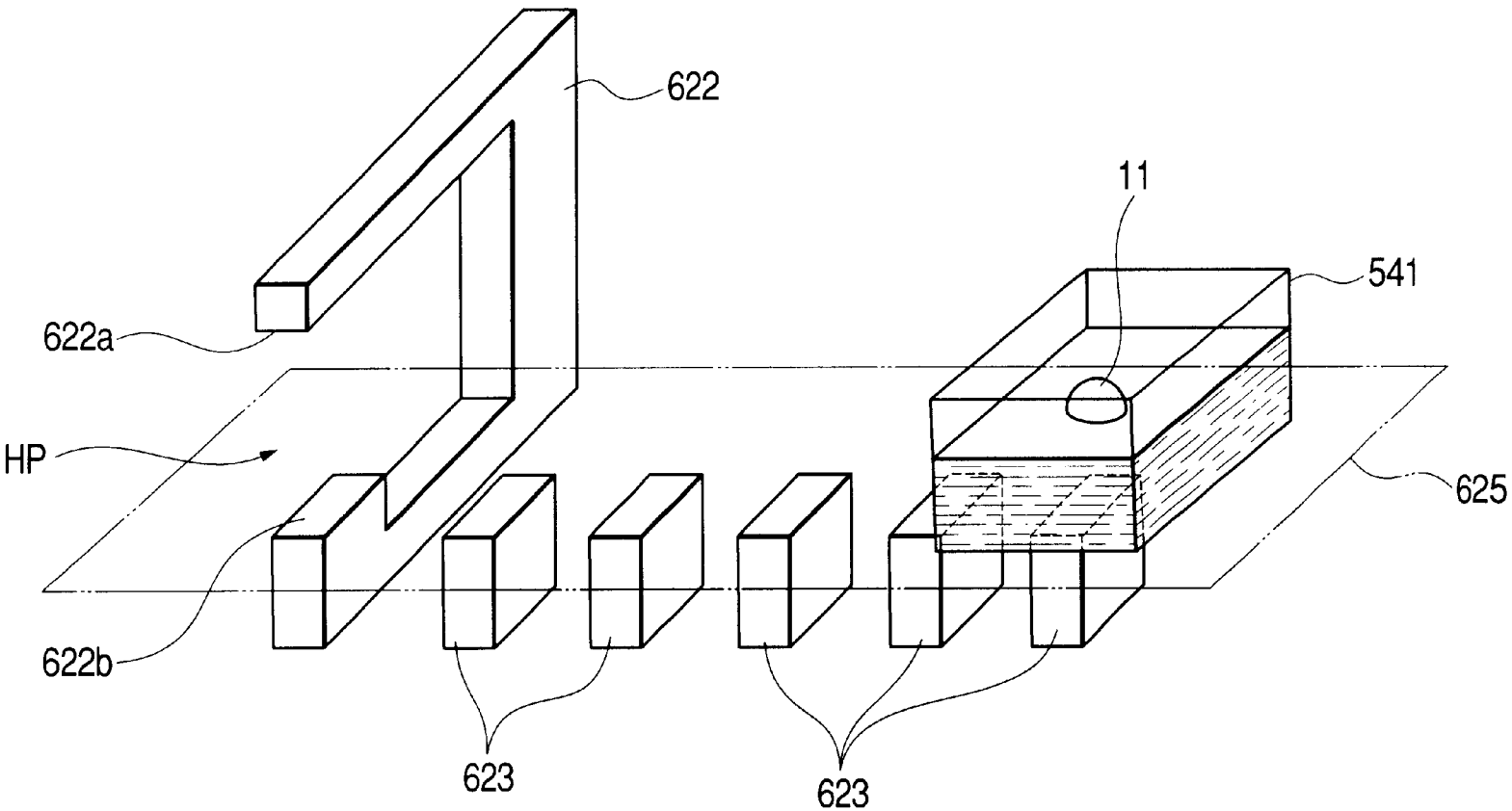
FIG. 20 is a schematic diagram showing the standstill electromotive force generation means and movement time electromotive force supply means of the second embodiment.
Figure 21:
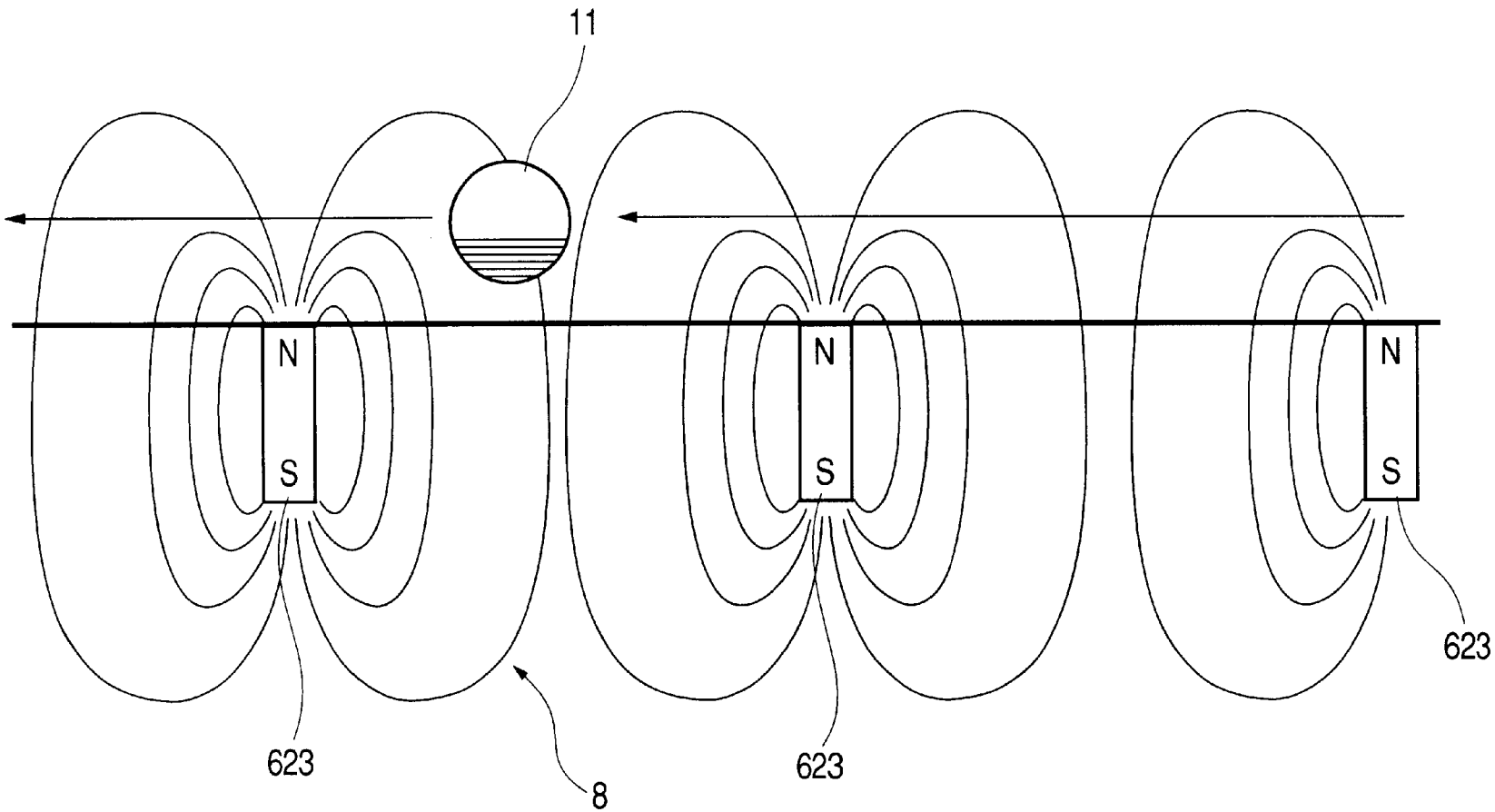
FIG. 21 is a schematic diagram for explaining operation of supplying electromotive force by the movement time electromotive force supply means shown in FIG. 20.
Figure 22:
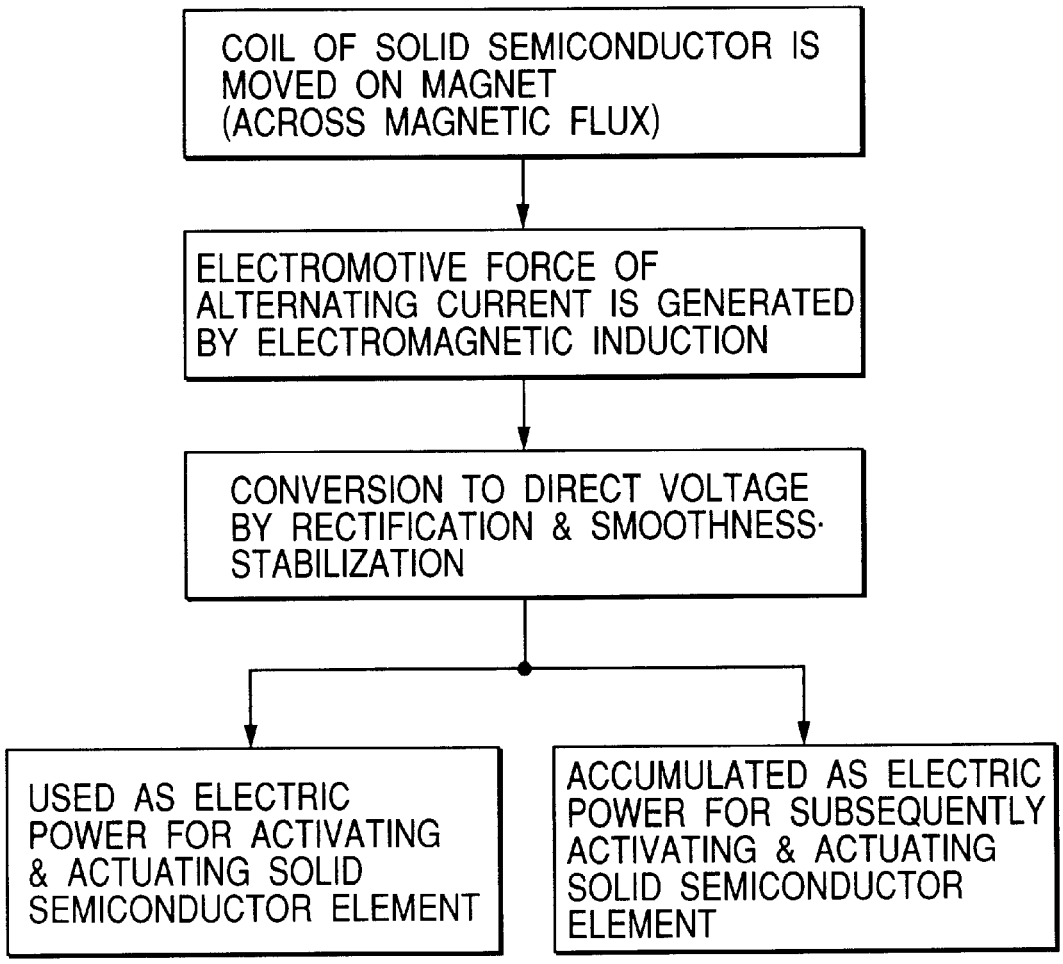
FIG. 22 is a flowchart for explaining operation of supplying electromotive force by the movement time electromotive force supply means shown in FIG. 20.

While it is preferable to have a configuration wherein the electromotive force is supplied to the solid semiconductor element 11 while the carriage 607 is at standstill at the home position HP as described above, it is more effective for activating and stabilizing operation of the solid semiconductor element 11 if the electromotive force can also be supplied during printing operation. For that purpose, this embodiment constitutes the movement time electromotive force supply means 623 by arranging a plurality of permanent magnets on the carrier path (range of movement) 625 of the carriage 607 as shown in FIG. 20. According to this configuration, if the carriage 607 reciprocates during printing operation, the coil L of the solid semiconductor element 11 crosses inside the magnetic flux B due to permanent magnets 623 as shown in FIG. 21, and so AC-induced electromotive force is generated on the coil L. And as described above, the AC-induced electromotive force is rectified and rendered smooth and stable to be used for activating and operating the means of the solid semiconductor element and also accumulated in the unillustrated battery and capacitor (see FIG. 22). According to this configuration, it is possible to constitute the movement time electromotive force supply means with permanent magnets 623 so as to generate the electromotive force by electromagnetic induction, utilizing the movement of the carriage 607. Accordingly, the power can be acquired either while the carriage 607 is at standstill at the home position HP or while it is moving for printing operation and so on, so that activation and operation of the solid semiconductor element 11 becomes highly stabilized with no possibility of power shortage.

Figure 23:
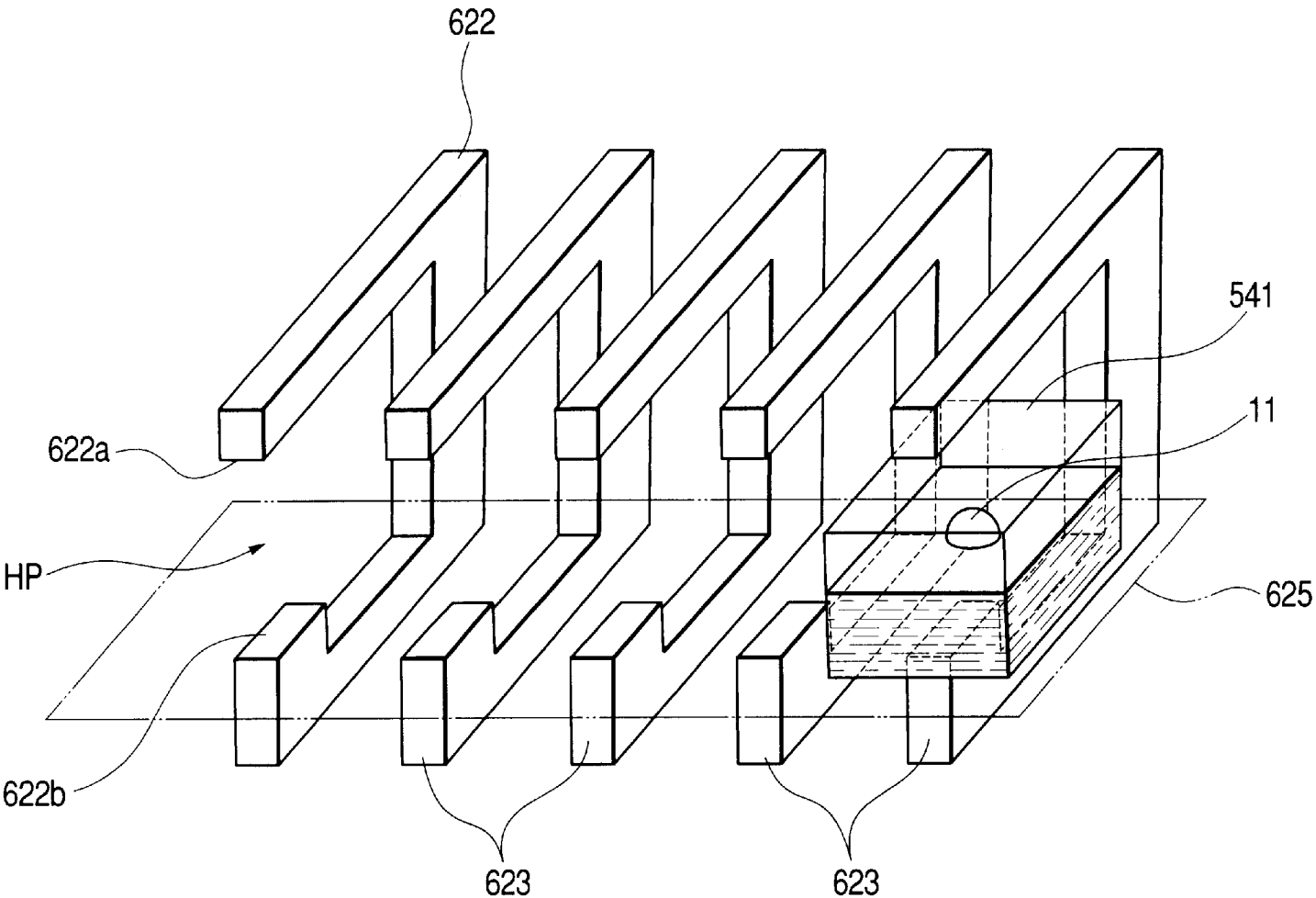
FIG. 23 is a schematic diagram showing another example of the standstill electromotive force generation means and the movement time electromotive force supply means of the second embodiment.

Moreover, as shown in FIG. 23, if both magnetic poles of the permanent magnets 623 are placed oppositely sandwiching a carrier path (range of movement) 625 of the carriage 607, the magnetic flux B piercing through the coil L of the solid semiconductor element 11 can be formed so that greater effects of the electromagnetic induction can be acquired. In addition, the electromagnetic apparatus can be used instead of the permanent magnets. In this case, it is not necessary to constantly change the magnetic flux by AC-driving unlike the electromagnetic apparatus 622 placed at the home position HP.

Figure 24:
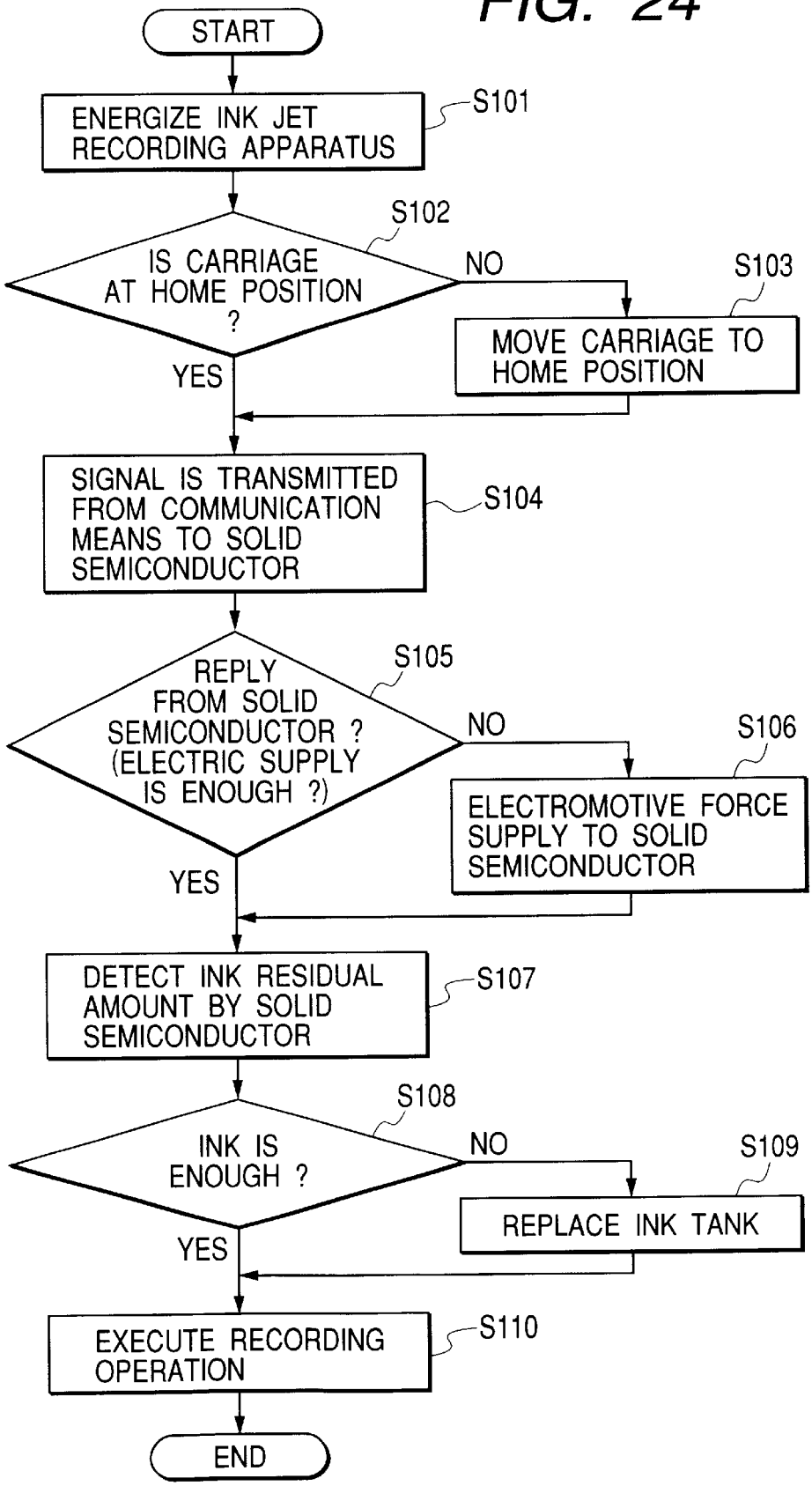
FIG. 24 is a flowchart explaining recording operation in the second embodiment.

Here, the ink jet recording apparatus of this embodiment will be described by referring to the flowchart in FIG. 24.

If the power of the ink jet recording apparatus is energized (S101), it is first checked whether the carriage 607 is at the home position HP by the photocouplers 611 and 612 (see FIG. 3) (S102). In the case where the carriage 607 is not at the home position HP, the drive motor 602 is operated so as to move the carriage 607 to the home position HP (S103).

At the home position HP, it is checked whether sufficient power is accumulated in the solid semiconductor element 11 in an ink tank 700 of the carriage 607. To be more specific, a signal is transmitted by the communication means of the ink jet recording apparatus body to the solid semiconductor element 11 (S104). If the solid semiconductor element 11 is in an operable state, it responds after receiving the signal (S105). As opposed to this, in the case where there is no response from the solid semiconductor element 11 to the communication means of the ink jet recording apparatus body, it is determined that sufficient power is not accumulated in the solid semiconductor element 11 and it is inoperative, so that the electromotive force is supplied thereto (S106). To be more specific, as described above, the electromagnetic apparatus 622 positioned at the home position HP is AC-driven so that the electromotive force is generated to the solid semiconductor element 11 by the electromagnetic induction.

Next, a signal is transmitted by the communication means of the ink jet recording apparatus body to operate the solid semiconductor element 11, and the ink residual amount in the ink tank 541 is detected based on the above described equation (S107) to determine whether or not there is ink (S108). In the case where it is determined that there is no ink or only insufficient ink, an instruction of the ink tank replacement is displayed (S109). In the case where it is determined that there is sufficient ink, as described above, records are produced by ejecting ink droplets from the liquid discharge head onto the printing paper P in synchronization with feeding of the printing paper P and reciprocating movement of the carriage 607 (S110). If the printing is completed, the entire operation is terminated.

Next, how to manufacture the solid semiconductor element of this embodiment 11 will be described. FIGS. 25A to 25G is a process drawing for explaining an example of the manufacturing method of the solid semiconductor element of the present invention, where each of the processes is shown as a section passing through the center of the spherical silicon. Moreover, a manufacturing method is exemplified here, whereby the center of gravity of the spherical silicon is made lower than the center, and the upper part inside the sphere is made hollow and the hollow portion is kept airtight.

Figure 25A:
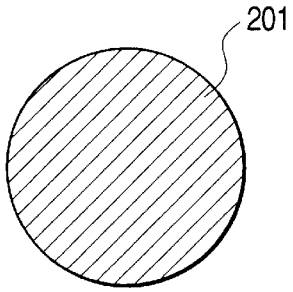
FIGS. 25A, 25B, 25C, 25D, 25E, 25F and 25G are process drawings for explaining a manufacturing method of the solid semiconductor element of the second embodiment.
Figure 25B:
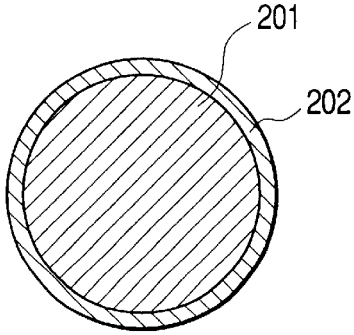
Figure 25C:
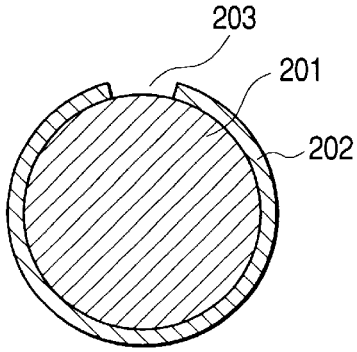

After forming a thermally oxidized $SiO_2$ film 202 on the entire surface of the spherical silicon in FIG. 25A as shown in FIG. 25B, patterning is performed by using a photolithography process, and an opening 203 is formed in part of the $SiO_2$ film as shown in FIG. 25C.

Figure 25D:
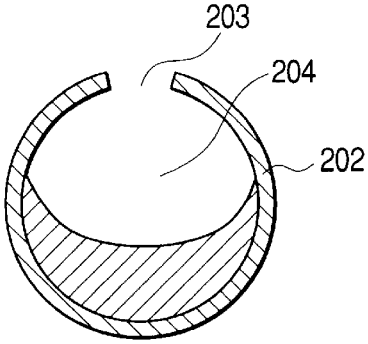
Figure 25E:
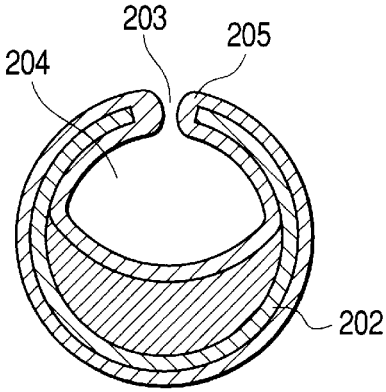

And as shown in FIG. 25D, the upper part of the silicon is partially removed by anisotropic etching using KOH solution through the opening 203 to form a hollow portion 204. Thereafter, as shown in FIG. 25E, an LPCVD method is used to form an SiN film 205 on inner and outer surfaces of the solid semiconductor element.

Figure 25F:
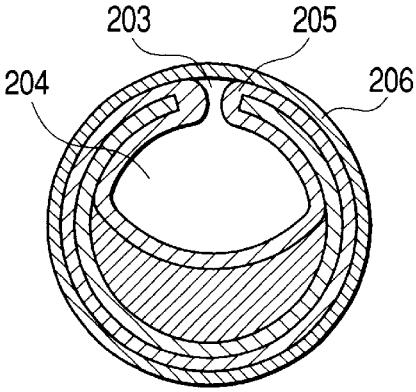
Figure 25G:
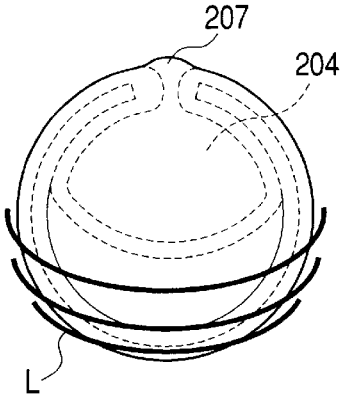

Furthermore, as shown in FIG. 25F, a metal CVD method is used to form a Cu film 206 on the entire surface of the solid semiconductor element. And as shown in FIG. 25G, patterning is performed to the Cu film 206 by using a known photolithography process, and the electric conductor coil L of the number of turns N that is a part of the oscillation circuit is formed. Thereafter, the solid semiconductor element comprising the electric conductor coil L is taken out of a vacuum device into the air, and the upper opening 203 is blocked by a sealing member 207 that is a resin, a plug or the like so as to render the hollow portion 204 in the sphere airtight. If manufactured in this manner, it allows the solid semiconductor element comprised of silicon itself to have buoyancy without having means for generating buoyancy by using power as in a third embodiment mentioned later.

In addition, N-MOS circuit elements are used for driving circuit elements other than the coil L to be formed in the spherical silicon before manufacturing such floating-type solid semiconductor elements. FIG. 18 shows a schematic section view wherein an N-MOS circuit element is vertically cut.

Figure 26:
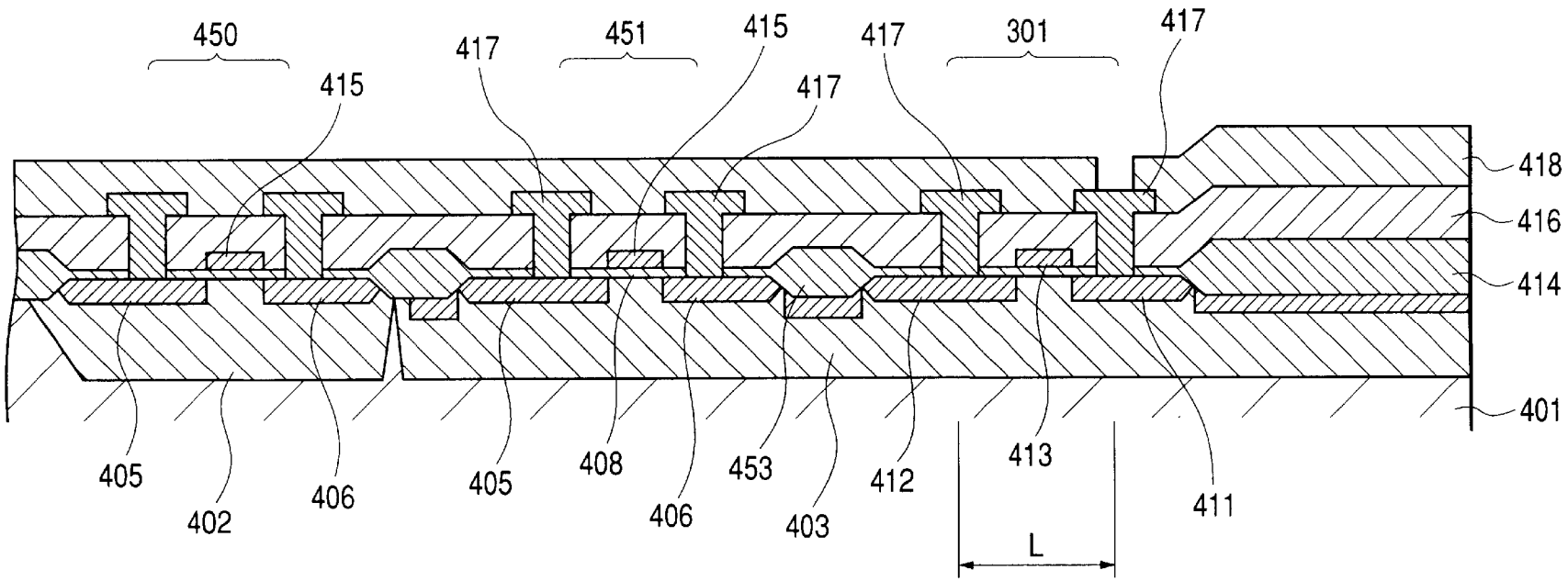
FIG. 26 is a schematic section view wherein an N-MOS circuit element used for the solid semiconductor element shown in FIGS. 25A to 25G is vertically cut.

According to FIG. 26, on an Si substrate 401 of a P electric conductor, P-Mos 450 is constituted in an N-type well area 402 and N-Mos 451 is constituted in a P-type well area 403 by impurity introduction and diffusion such as an ion plantation using a general Mos process. The P-Mos 450 and N-Mos 451 are comprised of gate wiring 415 by poly-Si deposited to thickness of 4,000 angstroms to 5,000 angstroms by the CVD method via a gate insulating film 408 of several-hundred angstrom thickness respectively, and a source area 405, a drain area 406 and so on to which N-type or P-type impurity introduction has been performed, and C-Mos logic is comprised of such P-Mos 450 and N-Mos 451.

An N-Mos transistor 301 for driving elements is also comprised of a drain area 411, a source area 412 and gate wiring 413 and so on on the P-type well substrate 402 by the processes such as impurity introduction and diffusion.

Here, if the N-Mos transistor 301 is used as an element-driving driver, a distance L between the drain gates comprising one transistor becomes approximately 10 $\mu$m as a minimum value. A part of a breakdown of the 10 $\mu$m is width of contact 417 of the source and the drain that is 2×2 $\mu$m, whereas it is actually 2 $\mu$m that is ½ thereof since a half thereof is shared with an adjacent transistor. The rest of the breakdown is comprised of a distance between the contact 417 and the gate 413 that is 4 $\mu$m of 2×2 $\mu$m, and width of the gate 413 that is 4 $\mu$m, so that the total is 10 $\mu$m.

Among the elements, an oxide film separating area 453 is formed by field oxidation of thickness of 5,000 angstroms to 10,000 angstroms for element separation. This field oxide film acts as a first thermal storage layer 414.

After the elements are formed, an interlayer insulating film 416 is deposited with PSG and BPSG films and so on to be approximately 7,000 angstroms thick by the CVD method and flattened by heat treatment, and then wiring is performed by an AI electrode 417 to be a first wiring layer via a contact hole. Thereafter, an interlayer insulating film 418 that is the $SiO_2$ film by a plasma CVD method is deposited to be 10,000 angstroms to 15,000 angstroms thick and a through hole is further formed.

This N-Mos circuit is formed before forming the floating-type solid semiconductor element as in FIGS. 25A to 25G. And connections are made to the oscillation circuit as the energy generating means and the sensor portion as the information acquiring means and so on of the present invention via the above through hole.

In addition, whatever state the ink tank on which the floating-type solid semiconductor element of this embodiment is placed is in, a stable magnetic flux (magnetic field) must be working between the oscillation circuit created in the spherical silicon by the above-mentioned manufacturing method and the external resonance circuit shown in FIG. 16. In the case of floating in liquid such as the ink, however, a liquid level may oscillate due to external oscillation. Even in such a case, the center of gravity of the floating-type solid semiconductor element is determined in this embodiment in order to maintain a stable state in the liquid.

Figure 27B:
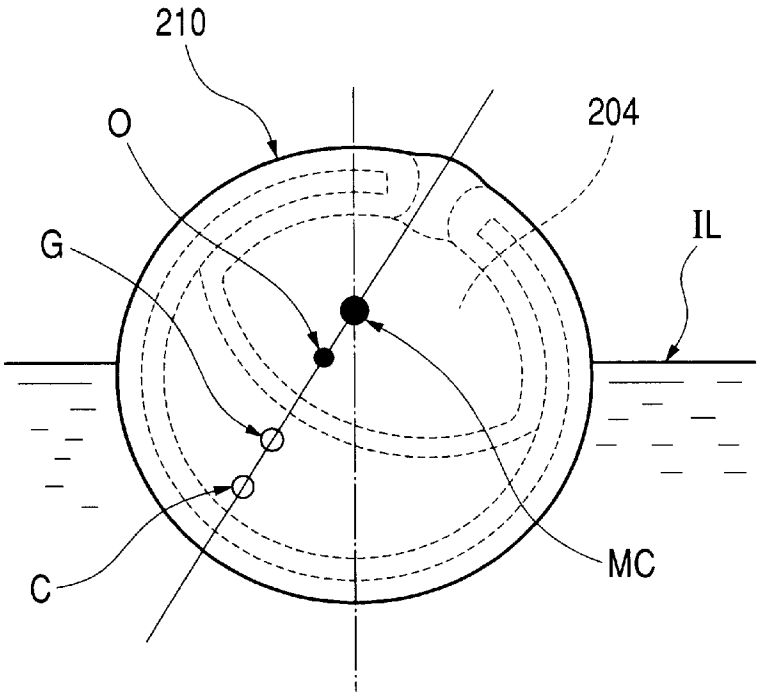
FIGS. 27A and 27B are diagrams for explaining conditions for the solid semiconductor element manufactured by the method shown in FIGS. 25A to 25G to remain stable in fluid.
Figure 27A:
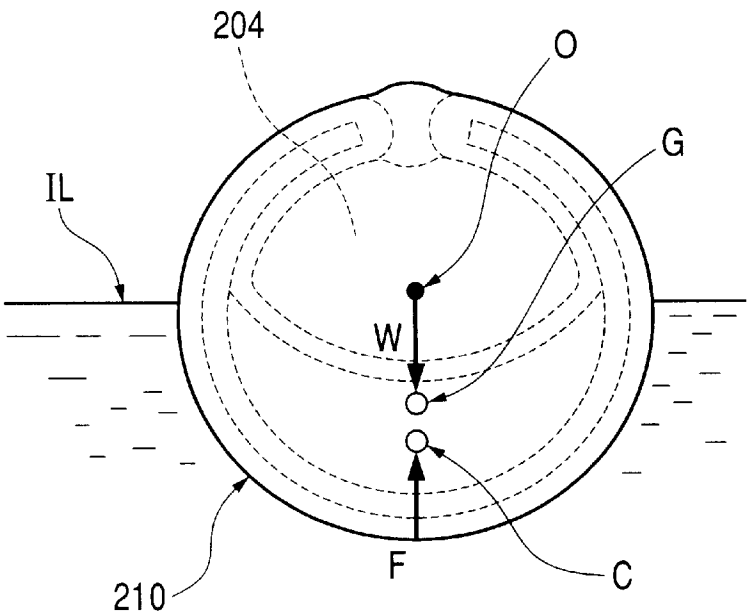

As shown in FIGS. 27A and 27B, in the case of floating a solid semiconductor element 210 of this embodiment in the liquid, the following relationship must hold in order to be in a balanced state as shown in FIG. 27A:

(1) Buoyancy F=Object weight W; and (2) The line of action of buoyancy and the line of action of weight (a line passing through the center of gravity G) coincide.

Reference character S indicates an ink level.

And as in FIG. 27B, when the liquid is oscillated by external force and the solid semiconductor element 210 inclines a little from the balanced state, the center of buoyancy moves so that the buoyancy and the weight make a couple of forces.

Here, the point of intersection of the line of action of weight in the balanced state (a dashed line in FIG. 27B) and the line of action of buoyancy when inclined (a solid line in FIG. 27B) is referred to as a meta center MC, and a distance h between the meta center and the center of gravity is referred to as height of the meta center.

As shown in this embodiment, the meta center of the solid semiconductor element 210 is at a higher position than the center of gravity, and so the couple of forces (restoring force) works in a direction to return to the original balanced position. This restoring force: T will be as follows.

$$T=Wh\sin\theta=Fh\sin\theta=\rho gVh\sin\theta(>0)$$

Here, volume of the liquid eliminated by the solid semiconductor element 210 is V, and specific weight of the solid semiconductor element 210 is ρg.

Thus, in order to make this restoring force positive, it is a necessary and sufficient condition to be h>0.

And it will be as follows from FIG. 27B.

$$h=(I/V)-\overline{CG}$$

Here, I is moment of inertia about an axis O. Accordingly, it will be as follows.

$$(I/V)>\overline{CG}$$

The above is a necessary condition for the solid semiconductor element 210 to float stably in the ink, supply the induced electromotive force from the external resonance circuit and perform two-way communication with the communication means outside the solid semiconductor element.

As for a method of the two-way communication with the external communication means, sending and receiving and so on in this case, as aforementioned, it is a configuration wherein it is possible to apply the radio LAN system using a microwave band frequency or the radio access system utilizing a quasi-millimeter wave/millimeter wave frequency, and the solid semiconductor element on the transmitting side has the line monitoring portion, the data handling portion, the acknowledgement check portion and the error processing portion, and the recording apparatus on the receiving side has the data handling portion, the acknowledgement portion, the error processing portion, the display portion and so on placed. A flowchart in the solid semiconductor element on the transmitting side is as shown in FIG. 8, and a flowchart in the recording apparatus on the receiving side is as shown in FIG. 9.

In addition, the solid semiconductor element of the present invention is preferably applied to an ink jet printer wherein the ink accommodated in the removably placed ink tank is supplied to the ink jet recording head, and the ink information and the tank information on the ink jet printer printed on the recording paper with the ink droplets ejected from the recording head is detected, and the information is transmitted to the ink jet printer to control the printer by the most suitable method and control it for maintaining the optimum state in the tank.

Moreover, while the exterior of the ink jet recording apparatus is unillustrated in this embodiment, it is possible, in the case of using an exterior cover and also an ink tank that are translucent or something similar capable of showing the inner state, to use light as the communication means so that the user can see the light of the tank and easily understand that "the tank should be replaced" for instance, making the user desirous of replacing the tank. Conventionally, it was not easy for the user to understand what message was being given even if a button on the apparatus body lighted up since it had several display functions. However, this embodiment makes it very easy to understand the necessity of tank replacement.

Third Embodiment

Figure 28:
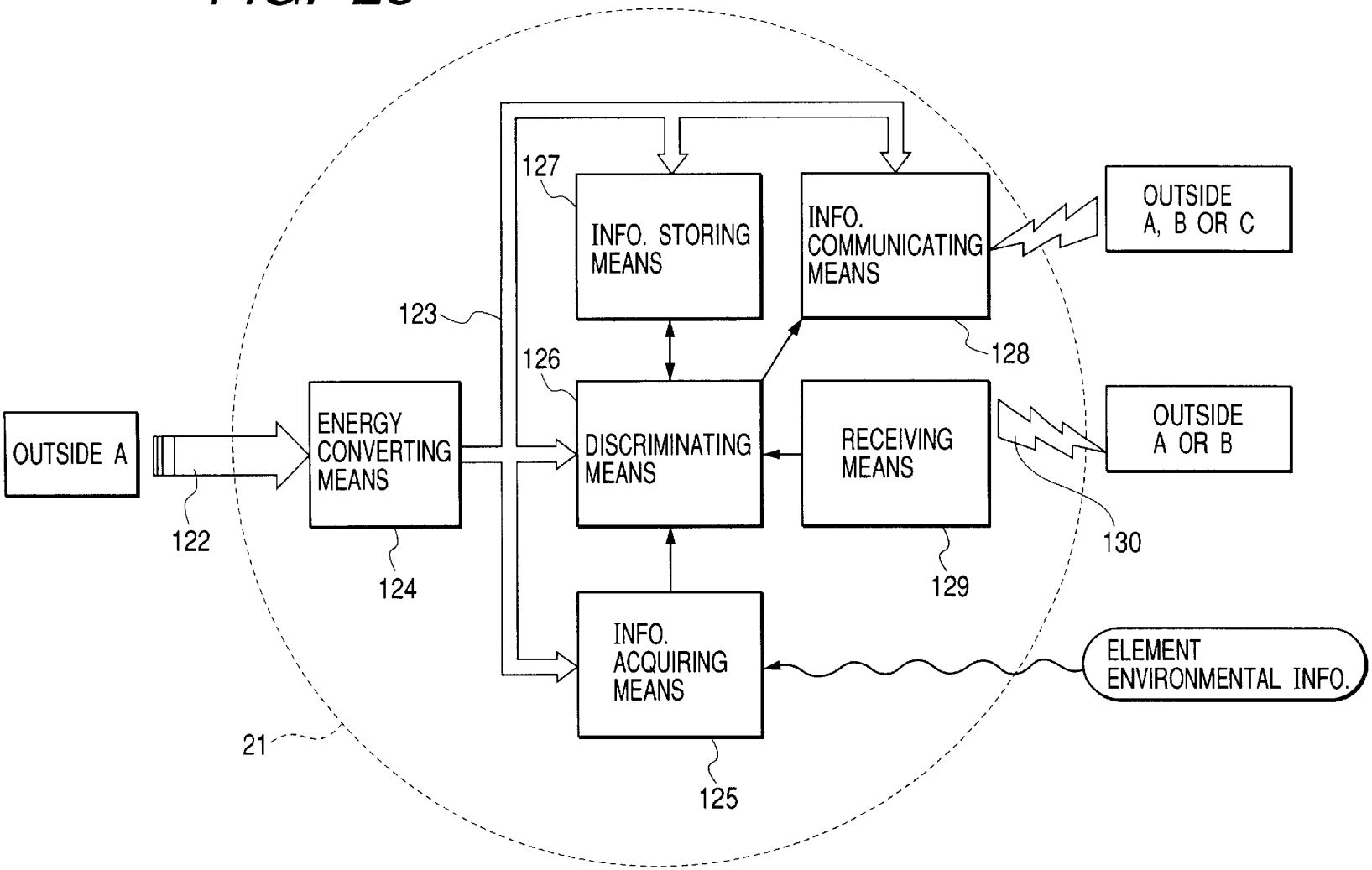
FIG. 28 is a block diagram showing the internal configuration of the solid semiconductor element of a third embodiment and its exchanges with the outside.

FIG. 28 is a block diagram showing the internal configuration of the solid semiconductor element of a third embodiment and its exchanges with the outside. Moreover, as this embodiment is the same as the first embodiment as to the constitution other than the solid semiconductor element, such description is omitted.

The solid semiconductor element 21 shown in this diagram has an energy converting means 124 for converting into power 123 electromotive force 122 supplied from the outside A (electromotive force supply means 622 or 623) to the solid semiconductor element 21 in a non-contact manner, an information acquiring means 125 activated by the power acquired by the energy converting means 124, a discriminating means 126, an information storing means 127, an information communicating means 128 and a receiving means 129, and is placed in the ink tank. It is different from the second embodiment in that it has a receiving function. In addition, it is desirable that at least the energy converting means 124, the information acquiring means 125 and the receiving means 129 are formed on or near the surface of the solid semiconductor element.

The information acquiring means 125 acquires the information in the ink tank that is environmental information of the solid semiconductor element 21. The receiving means 129 receives an input signal 120 from the communication means of the outside A or the outside B. The discriminating means 126 has the information acquiring means 125 acquire the in-tank information according to the input signal from the receiving means 129, and compares the acquired in-tank information with the information stored in the information storing means 127 so as to determine whether or not the acquired in-tank information meets predetermined conditions. The information storing means 127 stores various conditions to be compared with the acquired in-tank information and the in-tank information acquired from the information acquiring means 125. The information communicating means 128 converts the power into energy for transmitting the in-tank information according to an order of the discriminating means 126 so as to display and transmit the results of determination by the discriminating means 126 to the outside A, the outside B or the outside C.

Figure 29:
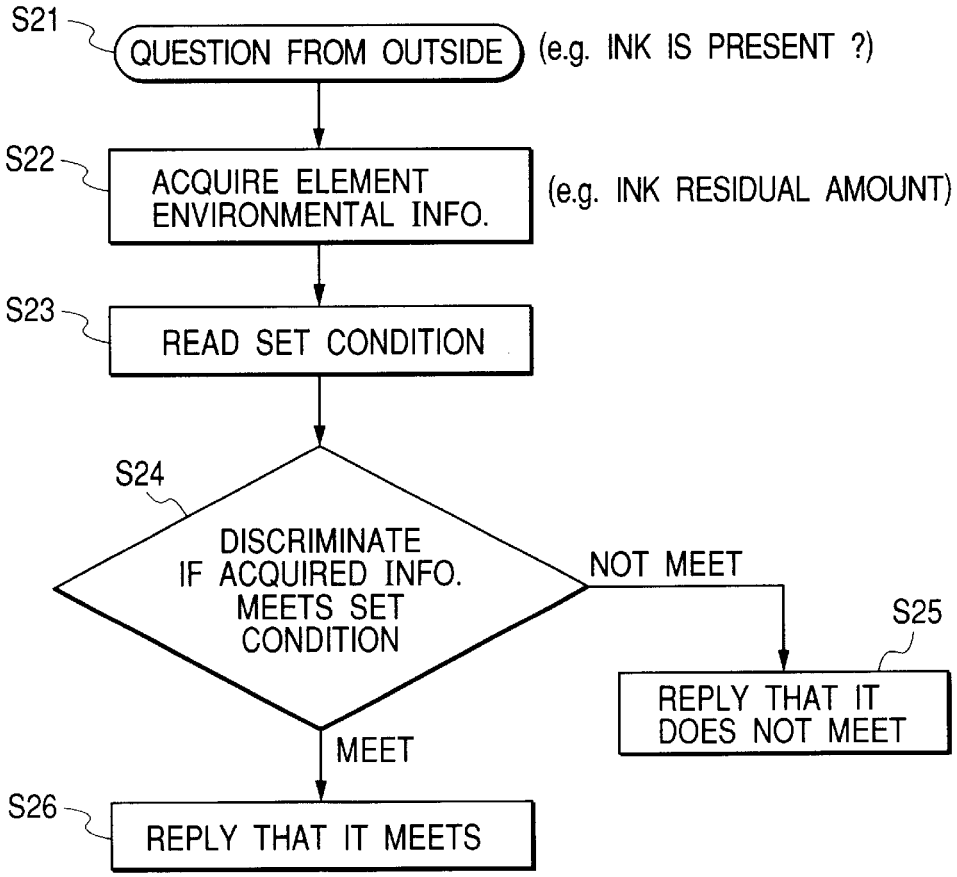
FIG. 29 is a flowchart for explaining operation of the solid semiconductor element shown in FIG. 28.

FIG. 29 is a flowchart for explaining operation of the solid semiconductor element shown in FIG. 28. Referring to FIG. 28 and FIG. 29, if electromotive force 122 is given from the outside A (electromotive force supply means) to the solid semiconductor element 21, the energy converting means 124 converts the electromotive force 122 into power 123, and activates by that power the information acquiring means 125, the discriminating means 126, the information storing means 127, the information communicating means 128 and the receiving means 129.

In this state, a signal 130 for asking for the information in the ink tank is transmitted from the outside A or the outside B to the solid semiconductor element 21. This input signal 130 is a signal for asking the solid semiconductor element whether or not there is still the ink remaining in the ink tank for instance, which is received by the receiving means 129 (step S21 in the FIG. 29). Then, the discriminating means 126 has the information acquiring means 125 acquire the information in the ink tank, such as the ink residual amount, the ink type, the temperature and pH (step S22 in FIG. 293), and reads from the information storing means 127 the conditions for referring the acquired in-tank information to (step S23 in FIG. 29), and determines whether or not the acquired information meets predetermined conditions (step S24 in FIG. 29).

In the case where it is determined that the acquired information does not meet the predetermined conditions in step S24, it informs the outside A, the outside B or the outside C to that effect, and in the case where it is determined that the information meets them, it informs them to that effect (steps S25 and S26). At this time, the acquired information can also be transmitted together with the results of determination. It is transmitted by having the information communicating means 128 convert the power acquired by the energy conversion into the energy for transmitting the information in the ink tank to the outside. This energy for transmitting is capable of using magnetic fields, light, shape, color, electric waves, sound and so on and can be changed according to the results of determination, and the transmitting method can be changed according to the contents of questions (for instance, whether the ink residual amount has become 2 ml or less, or whether pH of the ink has changed) as aforementioned.

Moreover, it is also possible to give the electromotive force to the solid semiconductor element 21 together with the input signal 130 from the outside A or the outside B, giving the signals according to their uses, for instance, a signal for asking about the ink residual amount in the case where that electromotive force is the electromagnetic induction, and a signal for asking about pH in the case of light.

According to this embodiment, as it has a function of receiving signals from the outside, it is possible to answer questions by various kinds of signals from the outside in addition to the effects of the second embodiment, so that information can be exchanged between the solid semiconductor element and the outside.

Moreover, while the solid semiconductor element to be preferably placed in the ink tank was described so that it is required to have the information acquiring means, it is also feasible to have a basic configuration of this embodiment wherein the solid semiconductor element has no such means and outputs to the outside the information stored therein in advance according to the input signals from the outside.

Fourth Embodiment

Figure 30:
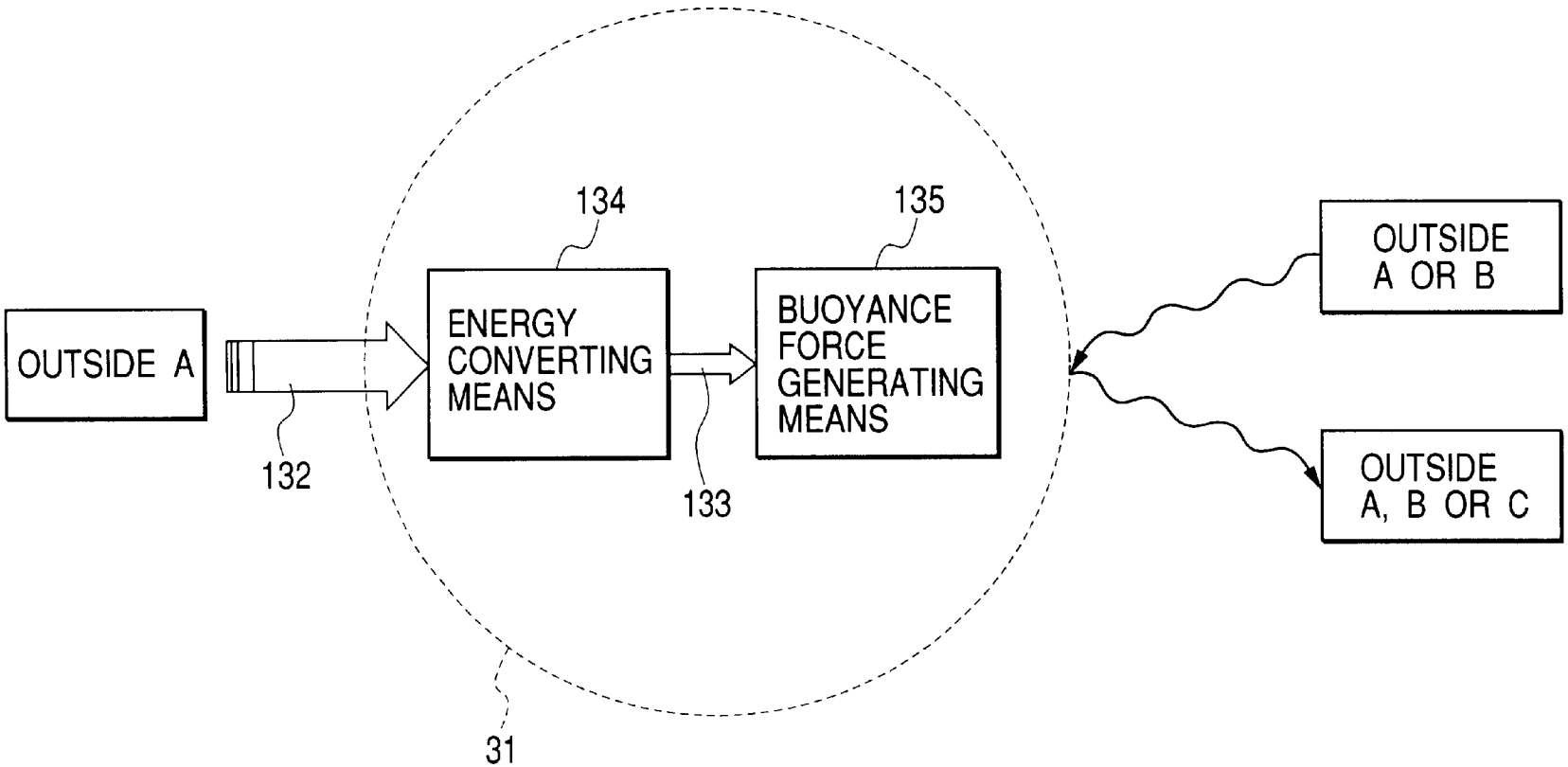
FIG. 30 is a block diagram showing the internal configuration of the solid semiconductor element of a fourth embodiment and its exchanges with the outside.

FIG. 30 is a block diagram showing the internal configuration of the solid semiconductor element of a fourth embodiment of the present invention and its exchanges with the outside. Moreover, as this embodiment is the same as the second embodiment as to the constitution other than the solid semiconductor element, such description is omitted.

The solid semiconductor element 31 of the form shown in this diagram has an energy converting means 134 for converting into power 133 electromotive force 132 supplied from the outside A to the solid semiconductor element 31 in a non-contact manner, and a buoyancy force generating means 135 for generating buoyancy by using the power acquired by the energy converting means 134, and is placed in the ink in the ink tank.

In such a form, if the electromotive force 132 is given from the outside A to the solid semiconductor element 31, the energy converting means 134 converts the electromotive force 132 into the power 133, and the buoyancy force generating means 135 generates buoyancy by using the power 133 and floats the solid semiconductor element 31 on the ink level. This buoyancy does not necessarily have to be on the ink level, but can be arranged so that the solid semiconductor element is always positioned at a fixed distance lower than the ink level in order to prevent discharging in a state where there is no ink.

Figure 31A:
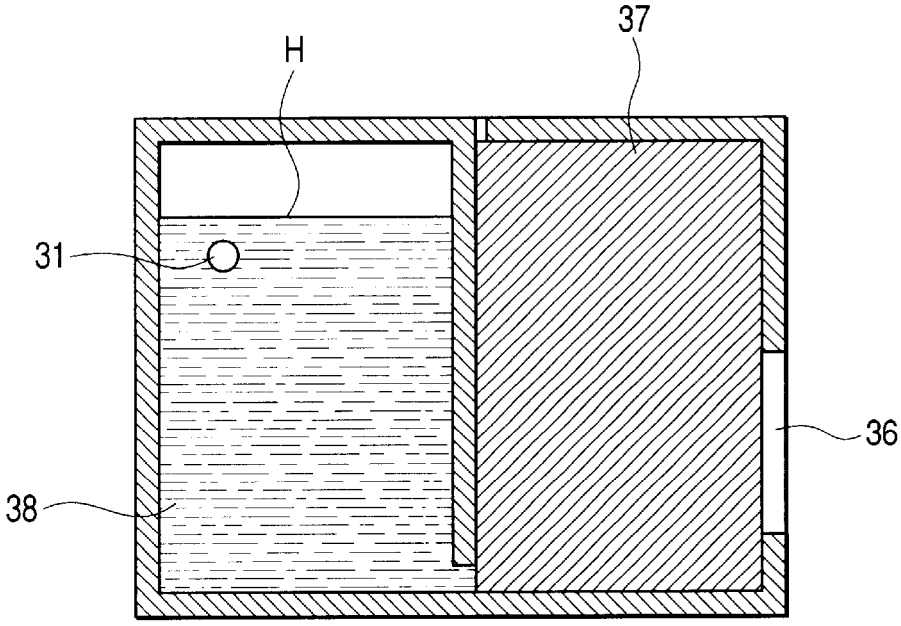
FIGS. 31A and 31B are diagrams showing a position of the solid semiconductor element shown in FIG. 30 floated in ink in the ink tank together with change of ink residual amount.
Figure 31B:
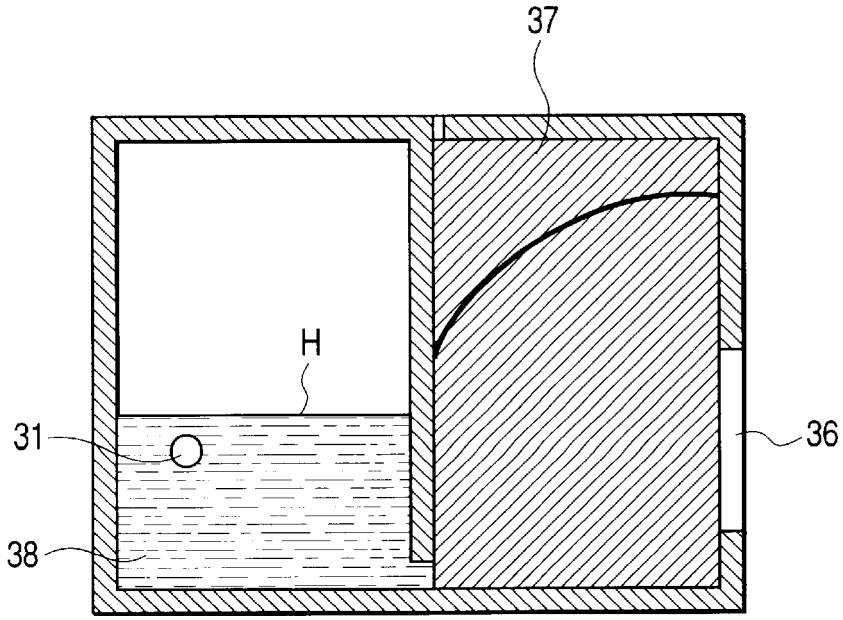

For instance, FIGS. 31A and 31B show positions of the solid semiconductor element floating in the ink in the ink tank together with change of ink consumption. In the tank shown in FIGS. 31A and 31B, as the ink of a negative pressure generating member 37 is led to the outside from an ink supply port 36, the ink equivalent to the consumed amount is held by the negative pressure generating member 37. Thus, the solid semiconductor element 31 in raw ink 38 is positioned at a fixed distance lower than the ink level H and moves along with the lowering position of an ink level H due to the ink consumption.

Figure 32:
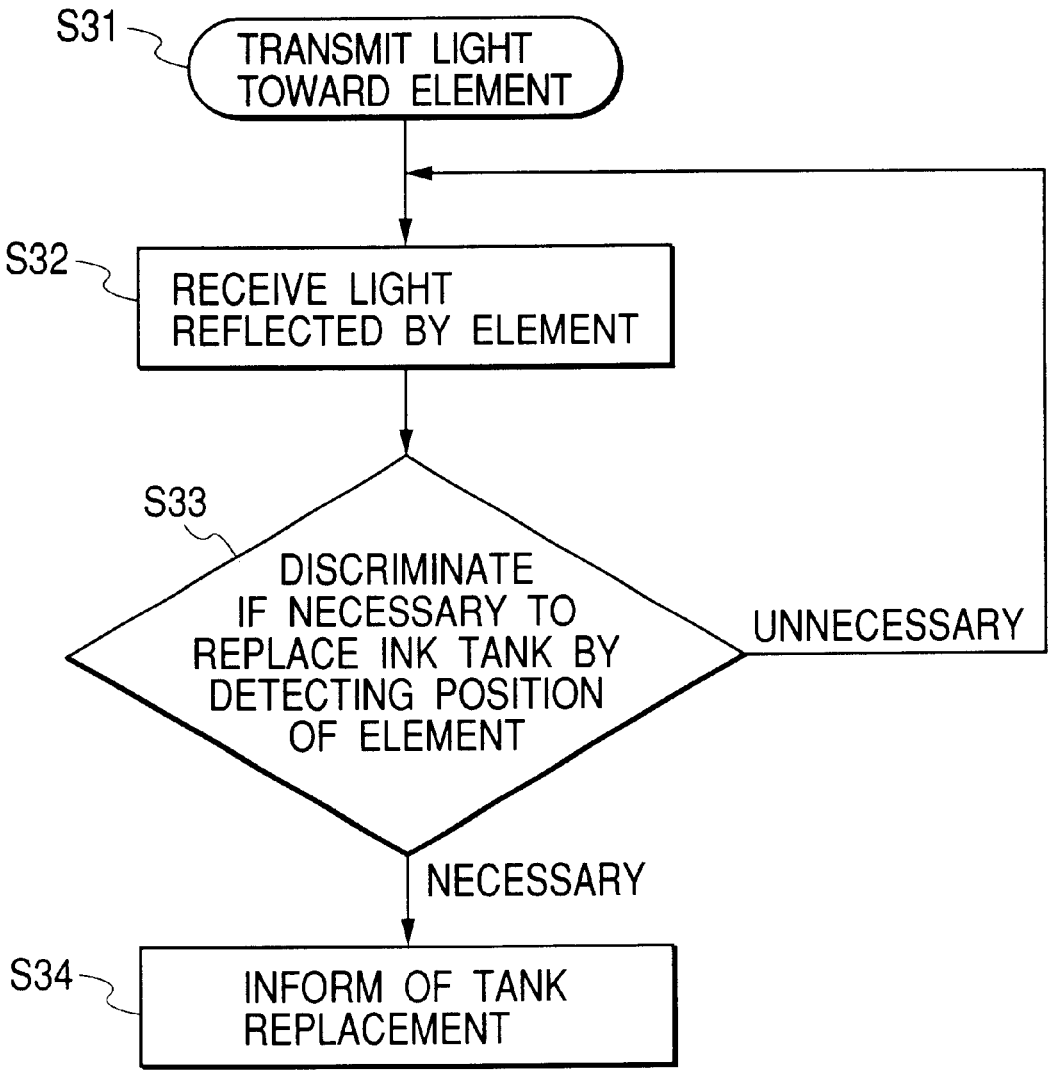
FIG. 32 is a flowchart for checking the position of the solid semiconductor element shown in FIG. 30 and determining necessity of replacing the tank.

FIG. 32 is a flowchart for checking the position of the solid semiconductor element 31 and determining necessity of replacing the tank. Referring to the steps S31 to S34 in FIG. 32, light is emitted to the solid semiconductor element 31 by the outside A or the outside B (the communication means of the ink jet recording apparatus, for instance), which light is received by the outside A or the outside B (the ink jet recording apparatus, for instance) or the outside C so as to detect the position of the solid semiconductor element 31, and the ink jet recording apparatus determines whether or not the ink tank replacement is necessary based on that position, so that it sends a notice by sound, light and so on in the case where it is necessary.

To detect the position of the solid semiconductor element, a method wherein light emitting means and light receiving means are placed oppositely and the position is checked by the solid semiconductor element portion not passing light, or a method wherein it is checked by the light emitted from the light emitting means reflected toward the light receiving means and so on are used.

According to this embodiment, even in the case where buoyancy and so on required for the solid semiconductor element change depending on the environment in which it is used, such as cases of different specific gravity, it is possible to convert the electromotive force from the outside by the energy converting means and set the solid semiconductor element to be always present at a desired position, so that the solid semiconductor element can be used regardless of the environment in which it is placed.

Moreover, it is possible to combine this embodiment with each of the above-mentioned embodiment as appropriate.

Fifth Embodiment

Figure 33A:
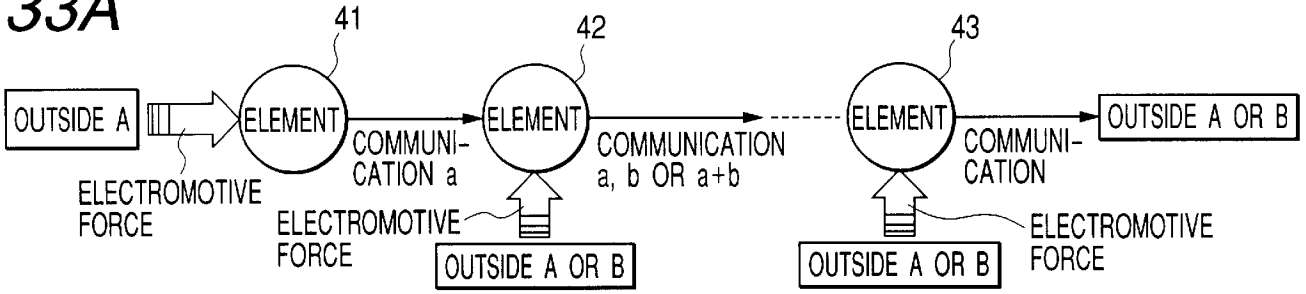
FIGS. 33A, 33B and 33C are conceptual renderings for explaining how to use the solid semiconductor element of a fifth embodiment of the present invention.
Figure 33B:
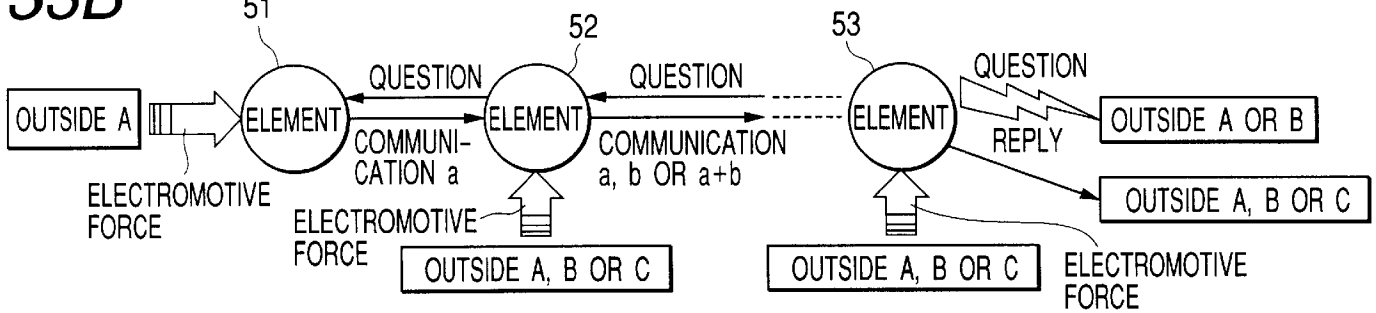
Figure 33C:
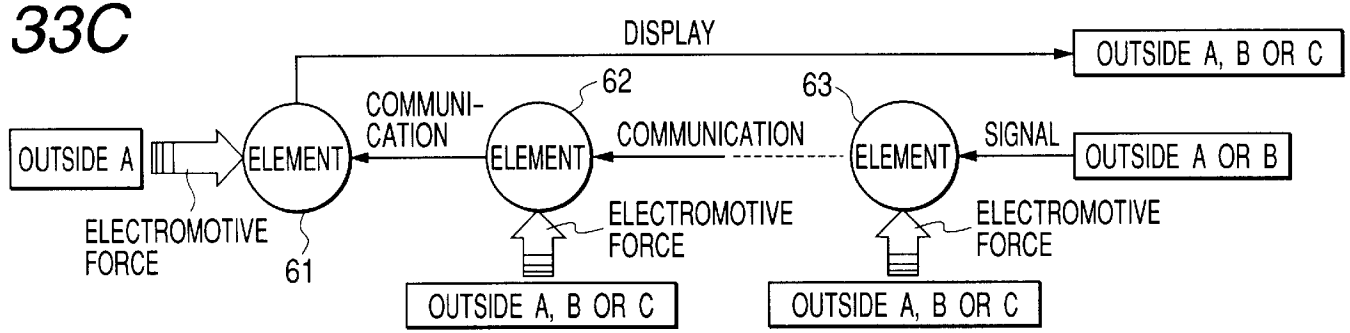

FIGS. 33A to 33C are conceptual renderings for explaining how to use the solid semiconductor element of a fifth embodiment of the present invention. Moreover, as this embodiment is the same as the second embodiment as to the constitution other than the solid semiconductor element, such description is omitted.

This embodiment has a configuration wherein the solid semiconductor element is given a function of transmitting information to other solid semiconductor elements, and a plurality of them are placed in the object.

In the example of FIG. 33A, a plurality of the solid semiconductor elements of the second embodiment are placed in the object, and if the electromotive force is supplied to the solid semiconductor elements by the electromotive force supply means of the outside A or the outside B, the solid semiconductor elements acquire environmental information respectively, where acquired information is sequentially transmitted, that is, acquired information a of a solid semiconductor element 41 is transmitted to a solid semiconductor element 42, acquired information a and b of the solid semiconductor element 41 and the solid semiconductor element 42 is transmitted to the next solid semiconductor element, and the last solid semiconductor element 43 transmits all the acquired information to the outside A or the outside B.

In addition, in the example of FIG. 33B, a plurality of solid semiconductor elements of the third embodiment are placed in the object, and the electromotive force is supplied to the solid semiconductor elements by the electromotive force supply means of the outside A or the outside B, and if a predetermined question by a signal is inputted to a solid semiconductor element 53 for instance by the communication means of the outside A or the outside B, a solid semiconductor element 51 or 52 corresponding to the question contents acquires information according to the question so as to answer it, and the answer to the question of the solid semiconductor element 51 or 52 is sequentially transmitted to the other solid semiconductor elements, which answer is given to the outside A, the outside B or the outside C by the desired solid semiconductor element 53.

Furthermore, in the example of FIG. 33C, a plurality of solid semiconductor elements of the third embodiment are placed in the object, and the electromotive force is supplied to the solid semiconductor elements by the electromotive force supply means of the outside A or the outside B, and if a certain signal is inputted to a solid semiconductor element 63 for instance by the communication means of the outside A or the outside B, that signal is sequentially transmitted to a solid semiconductor element 62 and a solid semiconductor element 61, and is displayed to the outside A, the outside B or the outside C by the solid semiconductor element 63.

Moreover, in the examples of FIGS. 33A to 33C, it is possible to use the solid semiconductor element having the buoyancy force generating means of the fourth embodiment as one of the plurality of solid semiconductor elements.

Figure 34:
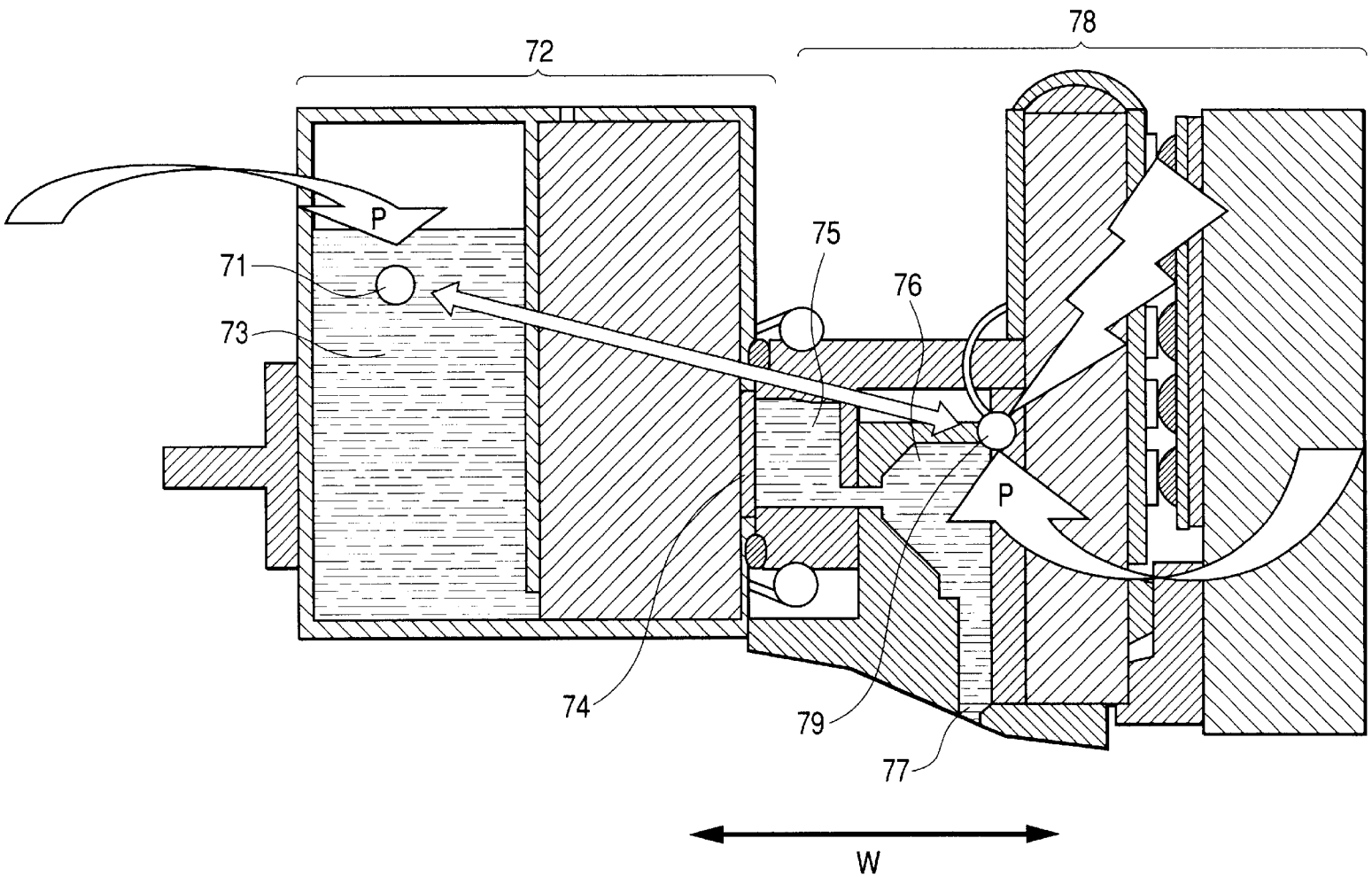
FIG. 34 is a diagram showing an example of placing the solid semiconductor elements combining the embodiments as appropriate in the ink tank and in the ink jet head connected to it respectively.

In addition, FIG. 34 shows an example of placing the solid semiconductor elements combining the second, third and fourth embodiments as appropriate in the ink tank and in the ink jet head connected to it respectively. In this example, a solid semiconductor element 71 wherein the buoyancy force generating means of the fourth embodiment and a function of transmitting information to another solid semiconductor element 79 are added to the second embodiment is placed at a desired position in the ink 73 of the ink tank 72. On the other hand, the solid semiconductor element 79 of the third embodiment having an ID function (authentication function) is placed on a recording head 78 for discharging from a discharge port 77 for printing purposes the ink supplied through a liquid path 75 and a liquid chamber 76 connected to an ink supply port 74 of an ink tank 72. It is also possible to supply power to this solid semiconductor element 79 by contacting an electrode portion placed on the surface of the solid semiconductor element with a contact portion on an electrical substrate for driving the recording head 78. In FIG. 34, reference character P indicates the electromotive force, and W indicates a direction of a printing scan.

And if the electromotive force is supplied to the solid semiconductor elements 71 and 79 by the electromotive force supply means of the outside, the solid semiconductor element 71 in the ink acquires information on the ink residual amount for instance, and the solid semiconductor element 79 on the recording head side transmits to the solid semiconductor elements 71 ID information for determining the ink residual amount for tank replacement for instance. And then, the solid semiconductor element 71 compares the acquired ink residual amount with the ID, and gives a transmission instruction to the solid semiconductor element 79, only when they coincide, to inform the outside of the tank replacement. The solid semiconductor element 79 receives it and transmits to the outside a signal for notifying the tank replacement or outputs sound, light and so on appealing to the human sense of sight or hearing.

As described above, it becomes possible to set complicated conditions of information by placing a plurality of solid semiconductor elements in an object.

Figure 35:
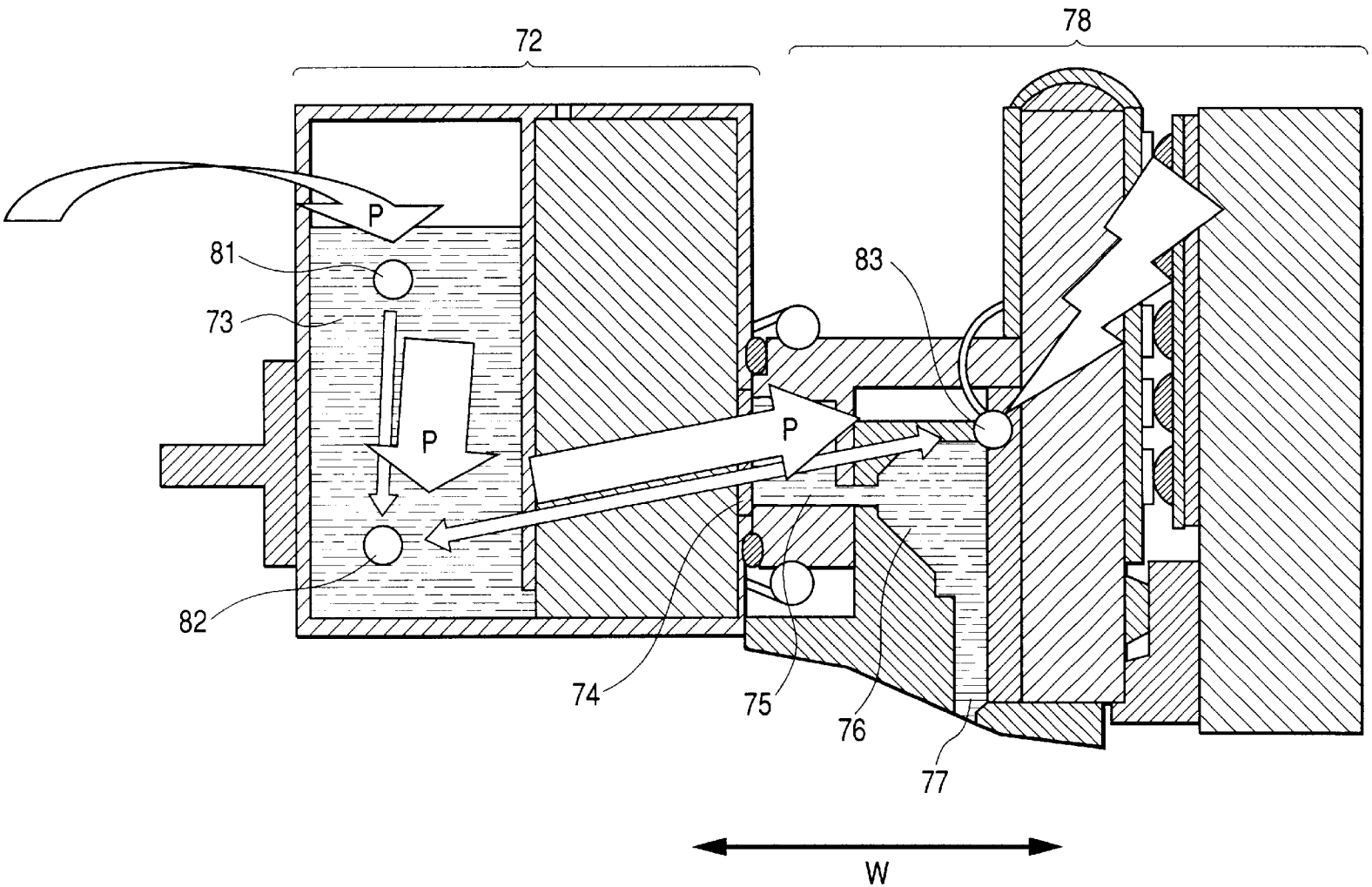
FIG. 35 is a diagram showing an example of configuration wherein the electromotive force supplied to a certain solid semiconductor element is sequentially transmitted together with information to other solid semiconductor elements in the ink tank and in the ink jet head connected to it.

In addition, while the example shown in FIGS. 33A to 33C and FIG. 34 show a configuration wherein the electromotive force is supplied to the respective solid semiconductor elements, there is no such limitation and it may be a configuration wherein the electromotive force supplied to a certain solid semiconductor element is sequentially transmitted to other solid semiconductor elements together with information. For instance, as shown in FIG. 35, a solid semiconductor element 81 wherein the buoyancy force generating means of the fourth embodiment, the function of transmitting information to other solid semiconductor elements and the function of supplying the electromotive force are added to the second embodiment, and a solid semiconductor element 82 wherein the buoyancy force generating means of the fourth embodiment, the function of transmitting information to other solid semiconductor elements and the function of supplying the electromotive force are added to the third embodiment are placed at desired positions in the ink 73 in the ink tank 72 that is the same in FIG. 34. On the other hand, on the recording head 78 coupled to the ink tank 72, a solid semiconductor element 83 of the third embodiment having the ID function (authentication function) is placed. It is also possible to supply power to this solid semiconductor element 83 by contacting the electrode portion placed on the surface of the solid semiconductor element with the contact portion on the electrical substrate for driving the recording head 78. In the FIG. 35, P indicates the electromotive force, and W indicates a direction of a printing scan.

And if the electromotive force is supplied to the solid semiconductor element 81 from the outside, the solid semiconductor element 81 in the ink acquires the ink residual amount information for instance and compares such information with its internally defined conditions, and in the case where it is necessary to transmit the acquired ink residual amount information to the other solid semiconductor elements, it transmits the acquired ink residual amount information to the solid semiconductor element 82 together with the electromotive force for operating the solid semiconductor element 82. The solid semiconductor element 82 to which the electromotive force was supplied receives the ink residual amount information transmitted from the solid semiconductor element 81, and also acquires information on pH of the ink for instance and transmits to the solid semiconductor element 83 on the recording head side the electromotive force for operating the solid semiconductor element 83. And then, the solid semiconductor element 83 on the recording head side to which the electromotive force was supplied transmits the ID information for determining the ink residual amount or pH of the ink for the tank replacement for instance to the solid semiconductor element 82. And the solid semiconductor element 82 compares the acquired ink residual amount information and the pH information with the ID, and only when they coincide, it gives a transmission instruction to the solid semiconductor element 83 to inform the outside of the tank replacement. The solid semiconductor element 83 receives it and transmits a signal for notifying the tank replacement to the outside or outputs sound, light and so on appealing to the human sense of sight or hearing. Thus, a method of supplying the electromotive force together with information from one solid semiconductor element to another solid semiconductor element is also thinkable.

The present invention allows the ink discharge position in the ink jet recording apparatus to be three-dimensionally detected, which can be used for controlling the ink discharge to render the records high-precision and high-quality. In particular, it allows the position to be detected not only one-dimensionally but also three-dimensionally in the carriage movement direction and thus it is highly effective in terms of improvement in printing quality since the space between the record medium and the discharge position can also be known.

Use of the solid semiconductor element makes it no longer necessary to install a linear encoder and so on on the recording apparatus body, and thus increases a degree of freedom of designing the ink jet recording apparatus, such as making carriage speed changeable. In addition, it does not require expensive components such as the linear encoder, and also allows the solid semiconductor element used for another purpose to additionally have a function of detecting a position, so that it can render the product further multi-function and low-cost by sharing components.

In addition, the present invention allows the electromotive force for driving the solid semiconductor element in the ink tank to be supplied in a non-contact manner with a relatively easy configuration and without providing electrical wiring and so on in the ink tank. In the case of a configuration having the standstill electromotive force supply means, it is efficient since the electromotive force can be provided to the solid semiconductor element when the carriage stops, that is, when no printing is performed. Also, if the standstill electromotive force supply means is placed at the home position, there are certainly occasions for supplying the electromotive force to the solid semiconductor element between completion of printing and start of printing of a magnetic field, and consequently there is little possibility that the electromotive force supply is delayed.

In addition, in the case of a configuration having the movement time electromotive force supply means, it is possible to supply electromotive force for driving the solid semiconductor element by exploiting operation of the recording apparatus (the carriage movement). In addition, kinetic energy of the carriage can be effectively utilized in order to supply the electromotive force.

According to these configurations, a malfunction of the solid semiconductor element when performing no printing can be prevented since there is no electromotive force for operating the solid semiconductor element except when the carriage is stopping at the home position or while printing.

It is desirable that the solid semiconductor element should partially contact the above described ink accommodated in the above described ink tank, and be hollow-structured and floating in the above described ink accommodated in the above described ink tank so that the above described inductor constantly faces a fixed direction. By doing so, the electromotive force can be certainly and stably generated by utilizing electromagnetic induction.

In particular, it is possible to three-dimensionally construct the inductor with fine patterns exploiting the solid semiconductor element structure, and in that case, the inductance can be made higher by increasing the number of turns or using a substance of high permeability as a core.

Here, as a concrete example of the above described configuration utilizing the solid semiconductor element, detection of the ink type of the ink stored in the ink tank will be described.

Figure 36:
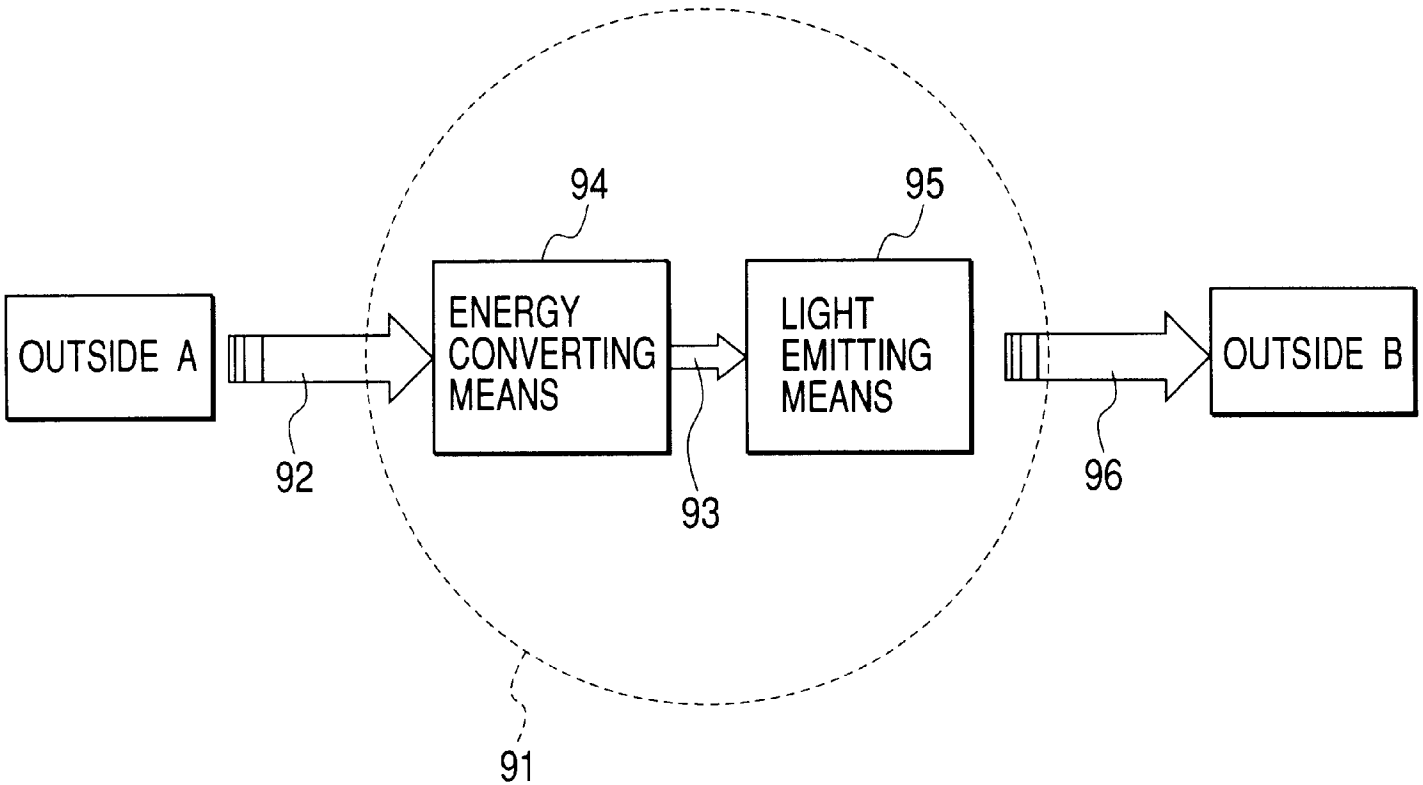
FIG. 36 is a block diagram showing internal configuration of the solid semiconductor element of an embodiment of the present invention and its exchanges with the outside.

FIG. 36 is a block diagram showing internal configuration of the solid semiconductor element of an embodiment of the present invention and its exchanges with the outside. A solid semiconductor element 91 in the form shown in this diagram has energy converting means 94 for converting into power 93 electromotive force 92 that is external energy supplied from the outside A toward an element 91 in a non-contact manner and light-emitting means 95 for emitting light by using the power acquired by the energy converting means 94, and is placed in the ink in the ink tank. The light-emitting means 95 is comprised of photodiodes and so on.

Moreover, as for the electromotive force supplied for operating the element, electromagnetic induction, heat, light, radiation and so on are applicable. In addition, the energy converting means 94 and the light-emitting means 95 should preferably be formed on or near the surface of the element.

In such a form, if the electromotive force 92 is given from the outside A to the element 91, the energy converting means 94 converts electromotive force 92 into the power 93, and the light-emitting means 95 radiates light 96 by using the power 93. The light 96 radiated from the light-emitting means 95 has its strength detected by the outside B.

Moreover, "solid" of the "solid semiconductor element" herein includes all of various solid shapes such as a triangle pole, a sphere, a hemisphere, a square pole, an ellipsoid of revolution and a uniaxial spinning body.

Furthermore, as for means for supplying external energy, in the case of being used for the ink jet recording apparatus, the means for supplying the electromotive force as the external energy to the element can be placed at a recovery position, a return position or the carriage, the recording head and so on. In addition, it is possible to know the internal state of the ink tank without the ink jet recording apparatus by using the apparatus having the means for supplying the electromotive force, which can be used for inspection (quality assurance) if used by a factory or a distributor for instance.

Figure 37:
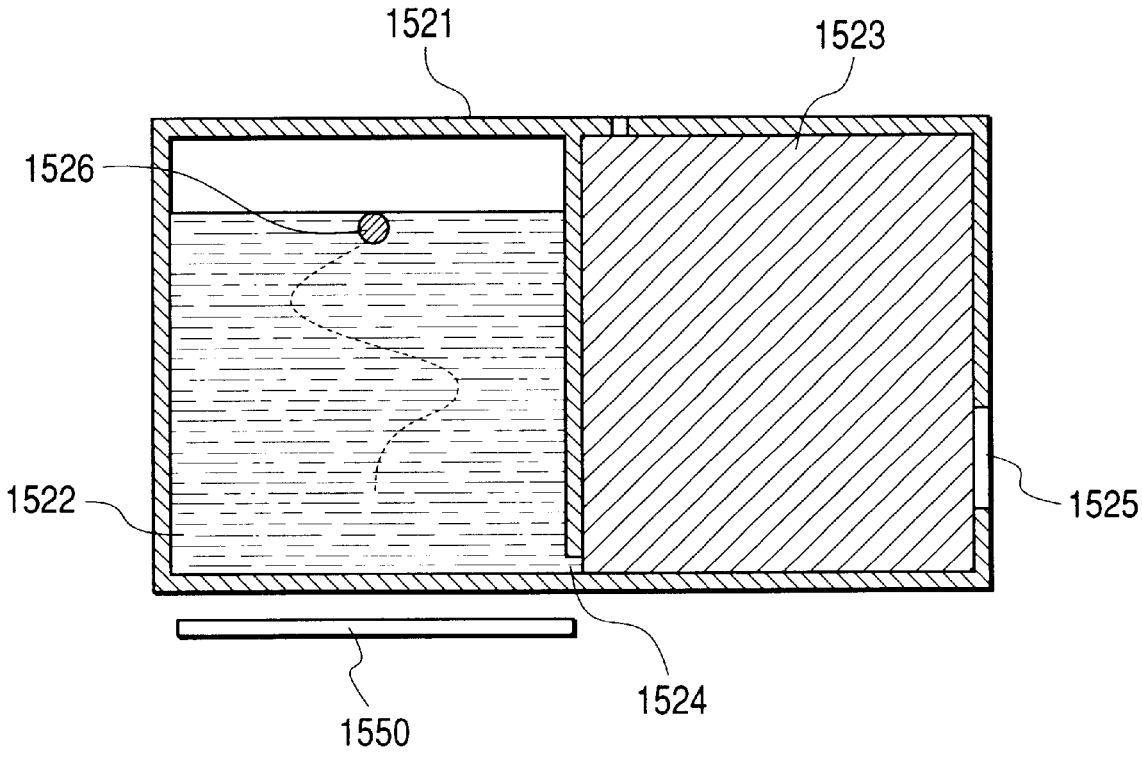
FIG. 37 is a sketchy block diagram of the ink tank using the solid semiconductor element of the present invention.

FIG. 37 is a sketchy block diagram of the ink tank using the solid semiconductor element of the present invention. A solid semiconductor element 1526 shown in this diagram is floating near the liquid level of raw ink 1522 in an ink tank 1521, and is caused to induce the electromotive force due to electromagnetic induction by the external resonance circuit (unillustrated) outside the ink tank 1521 and emits light if the photodiode placed near the surface of the solid semiconductor element 1526 is driven. That light transmits through the ink 1522 and is received by an optical sensor 1550 outside the ink tank 1521.

Figure 38:
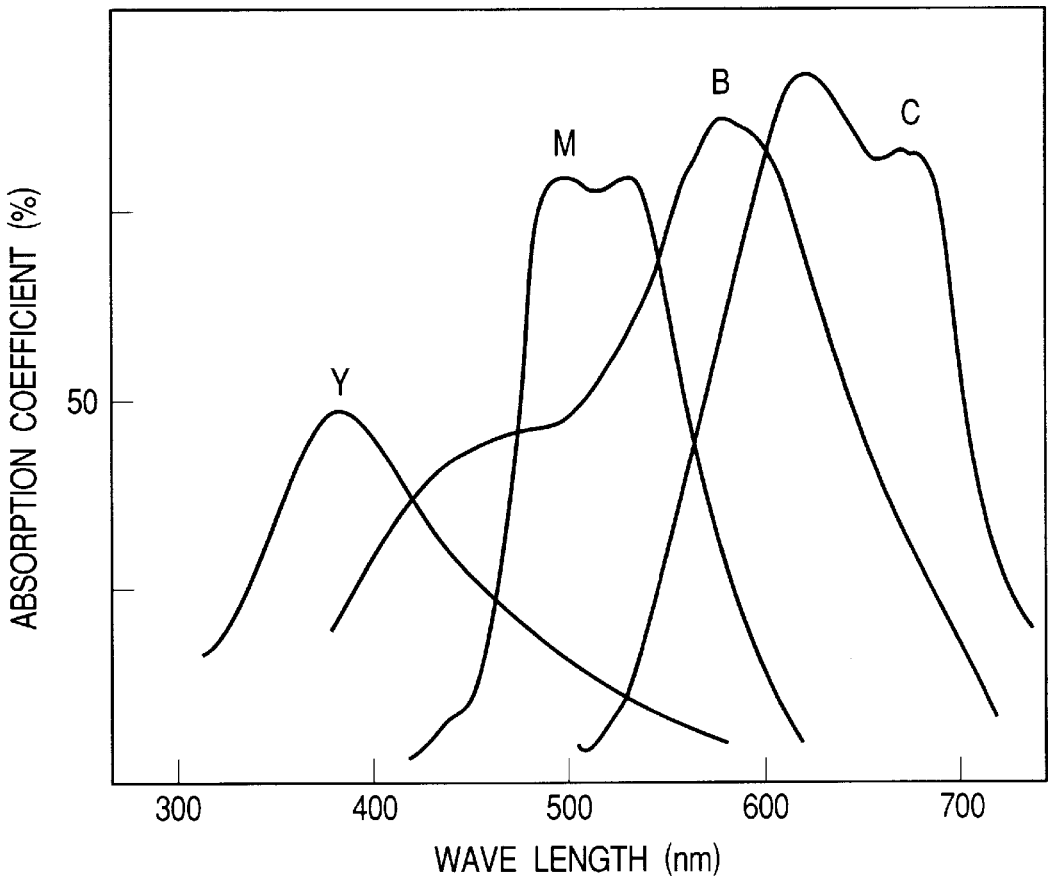
FIG. 38 is a graph showing absorbance wavelengths of representative types of ink (yellow, magenta, cyan and black).

FIG. 38 shows an absorption spectrum of the ink and also shows absorbance wavelengths of representative types of ink (yellow (Y), magenta (M), cyan (C) and black (B)). As shown in FIG. 38, the ink of the colors of yellow, magenta, cyan and black has peaks of absorptivity distributed in a wave band of 300 to 700 nm. The peaks of absorptivity of the ink of these colors are approximately 390 nm for yellow, approximately 500 nm for magenta, approximately 590 nm for black and approximately 620 nm for cyan. For this reason, it is possible to determine which of the above colors the ink that the light passed through has by emitting the light having a wavelength in the range of 300 to 700 nm from the solid semiconductor element and transmitting the light through the ink to receive it with the optical sensor 1550 (see FIG. 37) located outside the ink tank and detect which wavelength was absorbed most.

In addition, as shown in FIG. 38, the ink of yellow, magenta, cyan and black has clearly different absorptivity from one another among these colors at the wavelength of 500 nm. The absorptivity of the ink of these colors at the wavelength of 500 nm is approximately 80 percent for magenta, approximately 50 percent for black, approximately 20 percent for yellow, and approximately 5 percent for cyan. Thus, it is possible, as to the 500 nm-wavelength light, to determine which of the above colors the ink that the light passed through has by detecting a ratio of strength (absorptivity) of the ink-transmitted light to strength of the light emitted by the solid semiconductor element.

Moreover, in any of the above cases, it is possible to determine a plurality of ink types by placing one type of the solid semiconductor element in each of the different ink tanks.

In addition, as for the ink jet recording apparatus having a configuration wherein each of a plurality of the ink tanks is placed at a predetermined position according to a ink type accommodated in each of the ink tanks, it may have means for warning the user when the placement of the ink tank at an inadequate position is detected by the optical sensor 1550 having received the light transmitted through the ink in the ink tank. As the means of warning in this case, light-emitting means such as a lamp or sounding means such as a beeper may be employed. The user can be informed by a warning by the means of warning that the ink tank has been placed at a wrong position, and is able to place it at its original position.

Or it is also possible to have control means for controlling according to the ink type the recording head to which the ink is supplied from the placed ink tank when it is detected, in such an ink let recording apparatus, that the ink tank is placed at an inadequate position, by the optical sensor light having received the light transmitted through the ink in the ink tank. This automatically records images in an appropriate manner even in the case where the user has placed the ink tank at a wrong position, so that the user no longer needs to pay attention to the placement position of the ink tank.

As described above, in the present invention, as the solid semiconductor element has the energy converting means for converting energy from the outside into a different kind of energy and the light-emitting means for emitting light with the energy converted by the energy converting means, it is possible to determine the ink type by transmitting the light radiated from the solid semiconductor element through the ink and detecting the strength of the transmitted light at a certain wavelength.

What is claimed is:

1. An ink jet recording apparatus provided with a carriage to be movingly scanned, wherein a component is mounted to said carriage and a solid semiconductor element is placed in the component, the apparatus comprising:

communication means for communicating with the solid semiconductor element, wherein said communication means is fixedly placed at a predetermined position in a path where said carriage is movingly scanned, wherein positional information of the solid semiconductor element is detected as three-dimensional position information by said solid semiconductor element.

2. The ink jet recording apparatus according to claim 1, wherein said component is an ink jet recording head.

3. The ink jet recording apparatus according to claim 1, wherein said component is an ink tank.

4. The ink jet recording apparatus according to claim 1, wherein a distance between said communication means and said solid semiconductor element is measured by a phase deviation when said solid semiconductor element receives an electric wave having a predetermined phase transmitted from said communication means.

5. The ink jet recording apparatus according to claim 4, wherein a position of said solid semiconductor element specified with respect to a discharge portion of said recording means is specified from a communication distance acquired by the ink jet recording apparatus of claim 7 to detect said discharge position of said recording means.

6. The ink jet recording apparatus according to claim 1, wherein said component performs an ink discharge operation based on the detected positional information of the solid semiconductor element.

7. The ink jet recording apparatus according to claim 1, comprising at least three of said fixedly placed communication means, wherein all of the communication means transmit electric waves to said solid semiconductor element.

8. The ink jet recording apparatus according to claim 7, wherein said at least three fixed communication means transmit electric waves of which a frequency, an amplitude, or a signal pattern is different respectively.

9. The ink jet recording apparatus according to claim 7, wherein an ink discharge position of said recording apparatus is performed by a trilateration method.

10. An ink jet recording method in which a carriage is provided for mounting an ink jet recording head thereon and recording is made by discharging ink from recording means of said ink jet recording head while the carriage moves, wherein communication means is fixedly placed at a predetermined position in a moving path of said carriage, and in said ink jet recording head, a solid semiconductor element is placed at a predetermined position, the ink jet recording method comprising the steps of:

transmitting an electric wave from said fixedly placed communication means to said solid semiconductor element, detecting a three-dimensional position of said recording means of said ink jet recording head; and controlling a timing of ink discharge in accordance with the detected three-dimensional position of said recording means.

11. The ink jet recording method according to claim 10, wherein said solid semiconductor element is further capable of acquiring a discharge position of ink discharged by said recording means of said ink jet recording head and corrects a timing of ink discharge to offset a deviation between a detected discharge position and a desired discharge position.

12. The ink jet recording method according to claim 11, wherein said solid semiconductor element is capable of transmitting a discharge timing control signal for controlling an ink discharge with respect to the recording means of said ink jet recording head, thereby correcting the timing of ink discharge.

13. An ink jet recording head, comprising:

recording means for producing recordings by discharging ink; and a solid semiconductor element for detecting an ink discharge position of said recording means and controlling a timing of ink discharge according to said ink discharge position, wherein said solid semiconductor element comprises:

a position detection portion for acquiring the ink discharge position of said recording means;

a discharge timing control portion for correcting discharge timing in order to make up for a deviation of said discharge position detected by the position detection portion from a desired discharge position;

an electric wave receiving portion for receiving an electric wave; and an electric wave analyzing portion for identifying said electric wave and analyzing a phase deviation of the received electric wave to acquire a communication distance of the electric wave.

14. The ink jet recording head according to claim 13, wherein said discharge timing control portion transmits to said recording means a discharge timing control signal for controlling the ink discharge.

15. The ink jet recording head according to claim 13, wherein a position of said solid semiconductor element specified with respect to said discharge portion of said recording means is specified from a communication distance acquired by the ink jet recording head of claim 14 to detect said discharge position of said recording means.

16. The ink jet recording head according to claim 13, wherein said electric wave analyzing portion identifies at least one of a frequency and an amplitude of the received electric wave.

17. The ink jet recording head according to claim 13, wherein said solid semiconductor element has a clock.

18. The ink jet recording head according to claim 17, wherein a time of said clock is adjustable by a signal from the outside.

19. The ink jet recording head according to claim 13, wherein said solid semiconductor element is provided with a memory for storing data necessary for calculation of a position detection and for calculation of discharge control.

20. The ink jet recording head according to claim 19, wherein said memory stores a desired ink discharge position and data for correcting said ink discharge timing based on a positional relation between the desired ink discharge position and said actual discharge position detected by said position detection means.

21. The ink jet recording head according to claim 13, further comprising a plurality of said solid semiconductor elements.

22. An ink jet recording apparatus having the ink jet recording head according to any one of claims 13 to 21, and further comprising a moving carriage on which said ink jet recording head is mounted and a recording apparatus body having fixed communication means for transmitting an electric wave to said solid semiconductor element.

23. The ink jet recording apparatus according to claim 22, wherein said recording apparatus body has driving signal supply means provided for supplying a driving signal to said recording means, and said recording means performs ink discharge operation based on said driving signal and said solid semiconductor element.

24. The ink jet recording apparatus according to claim 22, wherein said recording apparatus body has at least three of said fixed communication means placed for transmitting electric waves to said solid semiconductor element.

25. The ink jet recording apparatus according to claim 24, wherein the electric waves transmitted from said respective fixed communication means have different frequency, amplitude or signal pattern respectively.

26. The ink jet recording apparatus according to claim 22, wherein a recording area on a recording medium for recording by said recording means is an area extending two-dimensionally.

27. The ink jet recording apparatus according to claim 22, wherein a recording area on a recording medium for recording by said recording means is an area extending three-dimensionally.

28. The ink jet recording apparatus according to claim 27, wherein said recording area is an outer surface of a cube.

29. The ink jet recording apparatus according to claim 27, wherein said recording area is a spherical surface.

30. An ink jet recording apparatus, comprising:

a recording head;

an ink tank for accommodating ink to be supplied to the recording head;

a moving carriage on which said recording head and said ink tank are mounted;

a solid semiconductor element having an inductor, accommodated in said ink tank; and movement time electromotive force supply means placed in a movement range of said carriage for supplying electrical energy to said solid semiconductor element in a non-contact manner during movement of said carriage.

31. The ink jet recording apparatus according to claim 30, wherein said movement time electromotive force supply means includes a plurality of electromagnetic apparatuses.

32. The ink jet recording apparatus according to claim 30, wherein said movement time electromotive force supply means includes a plurality of permanent magnets.

33. An ink jet recording apparatus comprising:

a recording head;

an ink tank for accommodating ink to be supplied to the recording head; and a moving carriage on which said recording head and said ink tank are mounted, wherein said ink tank is provided with a solid semiconductor element having an inductor built therein by utilizing a semiconductor manufacturing process, and wherein said solid semiconductor element at least partially contacts said ink accommodated in said ink tank.

34. The ink jet recording apparatus according to claim 33, wherein said solid semiconductor element is sphere-shaped, the inside thereof is hollow-structured and said solid semiconductor element is floating in said ink accommodated in said ink tank so that said inductor constantly faces a fixed direction.

35. An ink jet recording apparatus comprising:

a recording head;

an ink tank for accommodating ink to be supplied to the recording head; and a moving carriage on which said recording head and said ink tank are mounted, wherein said ink tank is provided with a solid semiconductor element having an inductor built therein by utilizing a semiconductor manufacturing process, and wherein said solid semiconductor element includes power accumulating means mounted thereon.

36. An ink jet recording apparatus comprising:

a recording head;

an ink tank for accommodating ink to be supplied to the recording head; and a moving carriage on which said recording head and said ink tank are mounted, wherein said ink tank is provided with a solid semiconductor element having an inductor built therein by utilizing a semiconductor manufacturing process, and further comprising communication means for sending a signal to said solid semiconductor element, said solid semiconductor element having a function of transmitting whether or not there is sufficient electrical energy for driving said solid semiconductor element in response to a request from said communication means.

37. An ink jet recording apparatus comprising:

a recording head;

an ink tank for accommodating ink to be supplied to the recording head; and a moving carriage on which said recording head and said ink tank are mounted, wherein said ink tank is provided with a solid semiconductor element having an inductor built therein by utilizing a semiconductor manufacturing process, and further comprising communication means for sending a signal to said solid semiconductor element, wherein said solid semiconductor element detects and transmits at least one of the amount, type, ingredients, and state of said ink in said ink in tank in response to a request from said communication means.

38. An ink jet recording apparatus comprising:

a recording head;

an ink tank for accommodating ink to be supplied to the recording head; and a moving carriage on which said recording head and said ink tank are mounted, wherein said ink tank is provided with a solid semiconductor element having an inductor built therein by utilizing a semiconductor manufacturing process, and wherein said solid semiconductor element further comprises light-emitting means emitting light in a manner that energy from the outside is converted by energy converting means and light emitting is made by converted energy.

39. The ink jet recording apparatus according to claim 38, wherein said light-emitting means is configured to emit light including a wavelength in the range of 300 to 700 nm.

40. The ink jet recording apparatus according to claim 38, wherein said light-emitting means is configured to emit light having a wavelength of 500 nm.

41. The ink jet recording apparatus according to claim 38, wherein the external energy converted by said energy converting means is supplied in a non-contact manner.

42. The ink jet recording apparatus according to claim 38, wherein the energy converted by said energy converting means is power.

43. A method of gathering information on ink of an ink jet recording apparatus having a recording head, and ink tank for accommodating ink to be supplied to the recording head, and a moving carriage on which said recording head and said ink tank are mounted, said ink tank being provided with a solid semiconductor element having an inductor, said method comprising the steps of:

supplying electrical energy in a non-contact manner to said solid semiconductor element when said carriage is at a standstill at a specific position in a movement range; and activating said solid semiconductor element with said electrical energy so as to gather information in said ink tank.

44. The method according to claim 43, wherein said specific position is a home position.

45. A method of gathering information on ink of an ink jet recording apparatus having a recording head, an ink tank for holding ink to be supplied to the recording head, a moving carriage on which said recording head and said ink tank are mounted, and a solid semiconductor element having an inductor and accommodated in said ink tank, the method comprising the steps of:

supplying electrical energy in a non-contact manner to said solid semiconductor element when said carriage is moving; and activating said solid semiconductor element with said electrical energy so as to gather said information in said ink tank.

46. The method according to claim 45, wherein electrical energy is supplied to said solid semiconductor element by electromagnetic induction.

47. The method according to claim 46, wherein said solid semiconductor element is sphere-shaped, the inside thereof is hollow-structured and said solid semiconductor element is floating in said ink accomodated in said ink tank so that said inductor constantly faces a fixed direction.

48. The method according to claim 45, wherein said solid semiconductor element as least partially contacts said ink accommodated in said ink tank.

49. The method according to claim 45, wherein the information on said ink to be gathered by said solid semiconductor element is whether or not there is sufficient electrical energy for driving said solid semiconductor element.

50. The method according to claim 45, wherein the information to be gathered by said solid semiconductor element is at least one of an amount, a type, ingredients, and a state of said ink in said ink tank.

* * * * *

UNITED STATES PATENT AND TRADEMARK OFFICE

CERTIFICATE OF CORRECTION

PATENT NO. : 6,769,754 B2 
DATED : August 3, 2004
INVENTOR(S) : Yoshiyuki Imanaka et al.

It is certified that error appears in the above-identified patent and that said Letters Patent is hereby corrected as shown below:

Drawings,
Sheets 3, Figure 4, “TRANSMISION” should read -- TRANSMISSION --.

Column 1,
Line 9, “an” should read -- in --.

Column 3,
Line 61, “function” should read -- functional --.

Column 4,
Line 45, “function” should read -- functional --.

Column 11,
Line 54, “calculation” should read -- calculations --.

Column 13,
Line 14, “element” should read -- elements --.

Column 14,
Line 9, “above described” should read -- above-described --.

Column 17,
Line 57, “-*M{dIa/dt}(2)*” should read -- *M{dIa/dt}* *(2)* --.

Column 18,
Line 24, “of” should read -- *f*0 --; and
Line 65, “above described” should read -- above-described --.

Column 20,
Line 35, “above described” should read -- above-described --.

Column 26,
Line 5, “embodiment” should read -- embodiments --.

UNITED STATES PATENT AND TRADEMARK OFFICE

CERTIFICATE OF CORRECTION

PATENT NO. : 6,769,754 B2 
DATED : August 3, 2004
INVENTOR(S) : Yoshiyuki Imanaka et al.

It is certified that error appears in the above-identified patent and that said Letters Patent is hereby corrected as shown below:

Column 30,
Line 28 “ink” should read -- inks --;
Line 29, “has”should read -- have --;
Line 46, “a” (second occurrence) should read -- an --; and
Line 61, “let” should read -- jet --.

Signed and Sealed this

Third Day of May, 2005

JON W. DUDAS
*Director of the United States Patent and Trademark Office*